US006703549B1

(12) United States Patent
Nishimoto et al.

(10) Patent No.: US 6,703,549 B1
(45) Date of Patent: Mar. 9, 2004

(54) PERFORMANCE DATA GENERATING APPARATUS AND METHOD AND STORAGE MEDIUM

(75) Inventors: Tetsuo Nishimoto, Hamamatsu (JP); Masahiro Kakishita, Hamamatsu (JP); Yutaka Tohgi, Hamamatsu (JP); Toru Kitayama, Hamamatsu (JP); Toshiyuki Iwamoto, Hamamatsu (JP); Norio Suzuki, Hamamatsu (JP); Akane Iyatomi, Hamamatsu (JP); Akira Yamauchi, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 94 days.

(21) Appl. No.: 09/634,147

(22) Filed: Aug. 8, 2000

(30) Foreign Application Priority Data

| | | |
|---|---|---|
| Aug. 9, 1999 | (JP) | 11-224782 |
| Sep. 24, 1999 | (JP) | 11-271400 |
| Mar. 21, 2000 | (JP) | 2000-077340 |

(51) Int. Cl.[7] ..... A63H 5/00; G04B 13/00; G10H 7/00

(52) U.S. Cl. ..... 84/609; 84/612; 84/616; 84/626

(58) Field of Search ..... 84/600–606, 609–610, 84/615–616, 622–634, 649–650, 653–654, 659–660, 662–666

(56) References Cited

U.S. PATENT DOCUMENTS

| | | | | |
|---|---|---|---|---|
| 5,571,981 A | | 11/1996 | Miyamoto | |
| 5,654,517 A | | 8/1997 | Miyamoto | |
| 6,150,598 A | * | 11/2000 | Suzuki et al. | 84/626 |
| 6,362,411 B1 | * | 3/2002 | Suzuki et al. | 84/626 |

* cited by examiner

*Primary Examiner*—Marlon T. Fletcher
(74) *Attorney, Agent, or Firm*—Morrison & Foerster LLP

(57) ABSTRACT

There are provided a performance data generating apparatus and method which is capable of automatically converting original performance data providing an expressionless performance into performance data that enable a variety of musically excellent performances, by means of a novel expression adding converter using various modularized rules and procedures to add expressions based on temporal changes such as tempo and timing, as well as a storage medium that stores a program for executing the method. Performance data are supplied, characteristic information is obtained from the supplied performance data, generating method information is stored which corresponds to predetermined characteristic information and representative of at least one method of generating musical tone control information, generating method information corresponding to the obtained characteristic information is obtained from the stored generating method information, the musical tone control information from the obtained characteristic information and generating method information corresponding to the obtained characteristic information is obtained, and the generated musical tone control information is added to the supplied performance data.

114 Claims, 37 Drawing Sheets

FIG.38

| TONE | CONTROL AFTER SOUNDING NOTE |
|---|---|
| PIANO | NOT ALLOWED |
| GUITAR | NOT ALLOWED |
| VIOLIN | ALLOWED |
| FLUTE | ALLOWED |

PERFORMANCE DATA GENERATING APPARATUS AND METHOD AND STORAGE MEDIUM

BACKGROUND OF THE INVENTION

1. Field of the Invention

The present invention relates to a performance data generating apparatus and method which generate performance data with expressions applied, as well as a storage medium storing a program for executing the method, and in particular, to a performance data generating apparatus and method having an automatic parameter editing function of automatically editing, based on characteristics of supplied performance data, values of parameters for adding various expressions to the performance data, as well as a storage medium storing a program for executing the method.

2. Prior Art

Composing MIDI data only of musical note information may result in mechanical expressionless performances. To obtain performance outputs with a variety of expressions such as more natural performance, beautiful performance, vivid performance, or peculiar individualistic performance, various musical expressions or instrumental impressions have to be added as control data. Systems for adding various expressions may include a method of adding expressions through musical scores, and others. There are, however, various expressions as described above. A useful system has to be able to accommodate various expressions.

Further, with more types of expressions, a user is at a loss what expressions to add unless an automatic addition system is developed. Accordingly, addition of expressions is preferably modularized in order to realize an automatic system. It is thus appreciated that a module storing characteristics of various musical expressions as rules may be used to generate musical MIDI data.

Known performance data generating apparatuses and parameter editing apparatuses for editing the values of parameters for adding various expressions to performances reproduced from supplied performance data are listed below.

(1) Manual inputs are provided to modify the values of parameters already set for supplied performance data or add new parameters to the supplied performance data in order to add expressions (musical expressions such as natural, beautiful performance, or vivid performance) to mechanical expressionless performances reproduced from the performance data.

(2) Performance expressions (for example, crescendos and decrescendos) are automatically added to a range of supplied performance data which is designated by a user.

With the conventional performance data generating apparatus or parameter editing apparatus (1), however, the user himself must select parameters to be modified or added, and particularly if the user is a beginner, it is difficult to select parameters for adding his favorite expressions and to determine parameter values optimal for the expressions. Moreover, to manually input parameters one by one is cumbersome. Further, with the conventional performance data generating apparatus or parameter editing apparatus (2), since the range of performance data which can be designated by the user is local and partial with respect to the entire music data, performance expressions added based on the performance data belonging to this range will be necessarily simple (for example, such performance expressions only linearly increase or reduce the volume of the corresponding portion). Consequently, to add a variety of desired performance expressions, the user has to carry out similar operations many times while sequentially changing the range of performance data to which the performance expressions are to be added. As a result, the user cannot add a variety of performance expressions using simple operations. Further, since the user himself has to designate the range of performance data to which the performance expressions are to be added, he has to know what expressions to add and to which performance sections these expressions are to be added in order to provide optimal expressions for the music. This task is difficult for beginners to perform.

SUMMARY OF THE INVENTION

It is an object of the present invention to provide a performance data generating apparatus and method which is capable of automatically converting original performance data providing an expressionless performance into performance data that enable a variety of musically excellent performances, by means of a novel expression adding converter using various modularized rules and procedures to add expressions based on temporal changes such as tempo and timing, as well as storage medium that stores a program for executing the method.

It is another object of the present invention to provide a performance data generating apparatus and method which enables even a beginner to add a variety of expressions to music using simple operations, as well as a storage medium that stores a program for executing the method.

It is a further object of the present invention to provide a performance data generating apparatus and method which is capable of automatically editing various control parameters for a performance such as temporally changing parameters for tempo, timing, or the like, a volume parameter, and musical interval parameters for pitch and the like to enable even a beginner to add a variety of expressions to music using simple operations, as well as a storage medium that stores a program for executing the method.

In the present invention, the term "musical tone control variable" refers to a variable such as a temporal musical-tone variable, a musical musical-tone variable, or a volume musical-tone variable which is used to control musical tones. Further, the term "musical tone control information" refers to variable information such as temporal musical-tone control information (temporal parameters) on tempo, gate time, tone generation timing, or the like, musical-interval musical-tone control information (a musical interval parameter and the like), or volume control information which controls musical tones for performance. The musical tone control information is also referred to as "performance parameters" or simply "parameters". Further, "the performance data generating apparatus" according to the present invention may act as "an automatic parameter editing apparatus" from the viewpoint of edition of the performance parameters.

According to a first feature (claims 1, 38 and 58) of the present invention, performance data are supplied, characteristic information is obtained from the supplied performance data, generating method information is stored which corresponds to predetermined characteristic information and representative of at least one method of generating musical tone control information, generating method information corresponding to the obtained characteristic information is obtained from the stored generating method information, the musical tone control information from the obtained characteristic information and generating method information corresponding to the obtained characteristic information is obtained, and the generated musical tone control information is added to the supplied performance data. That is, generating method information is stored beforehand, and based on the generating method information corresponding to characteristic information obtained from performance data, musical tone control information is generated and added to the performance data. In other words, according to the present invention, correspondence between predetermined characteristic information and musical tone control information for addition of expressions is set as rules in an expression adding module (an expression addition algorithm), and generating method information representing these expression addition rules is stored in a storage device beforehand. When the characteristic information is obtained from the supplied performance data, musical tone control information (various performance parameters such as the time parameters, the musical interval parameter, and the volume parameter) is generated and added to the performance data based on the generating method information corresponding to the obtained characteristic information and in accordance with the expression adding module (the expression addition algorithm). Thus, even a beginner can add a variety of expressions to music using simple operations depending on the obtained characteristic information, thereby automatically generating more musically excellent performance data [this corresponds to FIGS. 2, 20 and 21 in the embodiments].

Further, the performance data with the musical tone control information added are output and evaluated so that the musical tone control information is adjusted based on results of the evaluation (claim 2). As a result, addition of expressions can be performed based on the optimal musical tone control information [this corresponds to Examples (1) to (6), (8), and (9)].

According to a second feature (claims 3, 39 and 59) of the present invention, characteristic information corresponding to time intervals of occurrence of notes (this characteristic information is called "note time information") is extracted from the supplied performance data, and based on the characteristic information and generating method information corresponding to this characteristic information, musical tone control information is generated and added to the supplied performance data. As a result, a variety of expressive performance outputs can be obtained based on the note time information (note density, interval between two notes or tones, and the like) (this corresponds to Example (1)).

An embodiment according to this feature (claim 4) is configured to extract, as the characteristic information, note density information (for example, "the number of notes in one bar÷the number of beats in the bar") representing the number of notes per predetermined unit time, and the musical control information is generated to control such that if the number of notes per predetermined unit time exceeds a predetermined value, a value of tempo with which the performance data are reproduced is increased. Accordingly, addition of expressions can be performed such that the tempo is changed depending on the note density (acceleration of the tempo with an increase in the number of notes) [this corresponds to Example (1)]. In a specific form of this embodiment, a tempo change amount for each section calculated based on a set tempo dynamic value $\alpha$, a tempo coefficient K determined from the note density and a table, and the currently set tempo value (the currently set tempo value$\times\alpha\times$K) can be applied to MIDI data. Further, by displaying the original performance data on a display and then displaying applied parameter values and their positions on the displayed original data in an overlapping manner, results of the application can be checked. Further, if performance data composed of a plurality of parts are supplied, the reproduction tempo may be changed based on note density information extracted from a selected predetermined part of the performance data or it may be changed based on note density information obtained by comprehensively evaluating the plurality of parts.

According to a third feature (claims 5, 40, and 60) according to the present invention, based on progress of the supplied performance data and generating method information corresponding to the progress of the supplied performance data, musical tone control information is generated and added to the supplied performance data. A variety of expressive performance outputs can be obtained based on evaluation of the progress of performance of the performance data [this corresponds to Example (B)].

In an embodiment according to this feature (claim 6), the volume (the value of the volume parameter) is progressively increased in accordance with the progress of the performance data. As a result, addition of expressions can be performed such that listeners' excitement grows as the music progresses. Specifically, in this embodiment, based on pattern data representing a tendency of change in the volume of the entire music, a value of volume change amount for each section where the volume change is to occur is calculated and inserted into each corresponding position of the performance data. In this case, in a system including a plurality of tracks, the same pattern or different changing patterns may be used for each track. This method is applicable to changing of the musical interval parameter: for example, the value of the musical interval may be progressively increased with the progress of the music to enhance listeners' excitement.

According to a fourth feature (claims 7, 41, 61) of the present invention, based on breaks in phrases (borders of phrases) extracted from the supplied performance data and generating method information corresponding to the breaks in phrases, musical tone control information is generated and added to the supplied performance data. As a result, performance outputs can be obtained with a variety of expressions at breaks in phrases (trailing ends of phrases, for example) [this corresponds to Example (D)].

An embodiment according to this feature (claim 8) is configured to progressively decrease the volume at each break in phrases, such that the volume is progressively diminished at an end position of a phrase. Thus, addition of expressions can be performed so as to make listeners feel a cadence of the phrase, i.e. that the phrase has been completed [this corresponds to Example (D)]. In this embodiment, the volume at the end position is preferably calculated from a tempo set for the phrase. Alternatively, the volume of a note at a leading end of the phrase may be increased.

According to a fifth feature (claims 9, 42, and 62) of the present invention, characteristic information corresponding to a tendency of pitch change is extracted from the supplied performance data as pitch change tendency information, and based on the extracted characteristic information (pitch change information) and generating method information corresponding to the pitch change tendency information, musical tone control information is generated and added to the supplied performance data. As a result, a variety of expressive performance outputs can be obtained based on the tendency of pitch change [this corresponds to Example (A)].

An embodiment according to this feature (claim 10) is configured to use as characteristic information pitch change tendency information representative of switching positions of the supplied performance data where a tendency for pitch to rise and a tendency for pitch to fall are switched, and apply an accent to the volume of a note at each of the switching positions where the tendency for pitch to rise and the tendency for pitch to fall are switched (when, for example, the tendency to rise changes to the tendency to fall, an accent is applied to a note event at the change point). As a result, addition of expressions can be performed such that the end of a note rise portion has an accent [this corresponds to Example (A)].

Another embodiment according to this feature (claim 11) is configured to use as characteristic information pitch change tendency information representative of at least one portion of the supplied performance data where pitch shows a tendency to rise, and progressively increase the volume at this portion. As a result, addition of expressions can be performed such that the volume increases progressively while the pitch of a train of note events shows a tendency to increase [this corresponds to Example (A)]. Specifically, for example, the user sets an analyzing section in the performance data, retrieves from the analyzing section subsections where the pitch of the note event train shows a tendency to rise or fall (in this case, a portion where the pitch generally shows a tendency to rise is assumed to be a pitch rise tendency portion), calculates for each retrieved subsection a speed at which the pitch changes, determines, depending on a result of the calculation, a changing pattern for the volume parameter which is to be applied to the note event, and based on the determined changing pattern, changes the volume parameter value within the subsection. This method is also applicable to changing of the musical interval parameter.

According to a sixth feature (claims 12, 43, and 63) of the present invention, at least one portion of the supplied performance data where identical or similar data trains exist continuously is extracted as characteristic information, and based on the extracted portions and generating method information corresponding to this characteristic information, musical tone control information is generated and added to the performance data. As a result, a variety of expressive performance outputs can be obtained if identical or similar data trains exist continuously [this corresponds to Example (C)].

An embodiment according to this feature (claim 13) is configured to change the volume of volume of a trailing one of the identical or similar data trains which exist continuously, depending on degrees of similarity of the identical or similar data trains. As a result, if identical or similar patterns appear continuously, addition of expressions can be performed such that the volume parameter is changed depending on the similarity of the patterns [this corresponds to Example (C)]. For example, if similar phrases appear repeatedly, the volume parameter values of the second and subsequent similar phrases are changed depending on their similarities and on how they appear. More specifically, if similar phrases appear continuously, the volume parameter values of the second and subsequent similar phrases are reduced below that of the first similar phrase. If similar phrases appear repeatedly but not continuously for the first time, the volume parameter values of the second and subsequent similar phrases are changed changed to values similar to that of the first similar phrase and depending on their similarities. This method is applicable to addition of expressions that change the musical interval parameter.

According to a seventh feature (claims 14, 45, and 65) of the present invention, similar data trains are extracted from the supplied performance data, and the value of tempo with which the performance data are reproduced is changed based on a difference between the similar data trains. As a result, addition of expressions can be performed such that similar phrases have identical or similar values of tempo [this corresponds to Example (2)]. Specifically, a difference between similar phrases is detected and a tempo change based on the difference is applied to the original performance data.

According to an eighth feature (claims 15, 45, and 65) of the present invention, at least one previously registered figure is extracted from the supplied performance data, and based on the extracted figure and generating method information corresponding to the extracted figures, musical tone control information is generated and added to the performance data. Thus, addition of expressions can be performed such that the tempo is set correspondingly to the registered figure [this corresponds to Example (3)]. Specifically, a predetermined tempo is set, for example, for portions of the performance data with the previously registered figure=a rhythm pattern (phrase). A parameter to be registered for phrases is not limited to the figure but may be a train of expression events. This method is applicable not only to changing the tempo but also to changing of the musical interval parameter. This method can be also used to apply a slur to performance depending on the type of a musical instrument used, as described later in Examples.

According to a ninth feature (claims 16, 46, and 66) of the present invention, at least one portion of the supplied performance data where a plurality of tones are simultaneously sounded is extracted, and based on the extracted portion and generating method information corresponding to this portion, musical tone control information is generated and added to the performance data. As a result, performance outputs can be obtained which can have a variety of expressions at portions where a plurality of tones are simultaneously sounded [this corresponds to Example (F)].

An embodiment according to this feature (claim 17) is configured to define the importance of each of the simultaneous sounded tones and change the volume of each of the tones depending on the defined importance. As a result, expressions can be effectively added to a performance where a plurality of tones are simultaneously sounded [this corresponds to Example (F)]. For example, templates for respective degrees of importance are provided beforehand, and component notes of a chord have their volume changed in such a manner that the volume of each note is increased according to the level of importance, i.e. as the latter is higher. In this embodiment, only the lowest and highest notes of the chord may be set to a larger volume than the other component notes or only a fundamental note of the chord may be set to a larger volume. This method is further applicable to octave unisons. This method can also be applied to changing of the musical interval to automatically change the chord to a pure temperament.

According to a tenth feature (claims 18, 47, and 67) of the present invention, information on fingering is extracted from the supplied performance data, and based on teh extracted information on fingering and generating method information corresponding to the information on fingering, musical tone control information is generated and added to the performance data. As a result, performance outputs that can have a variety of expressions in terms of fingering can be obtained [this corresponds to Example (I)].

An embodiment according to this feature (claim 19) is configured to define the information on fingering corresponding to portions of the supplied performance data that are difficult to play and reduce the volume at these portions. As a result, addition of expressions can be performed such that the volume of a pitch that is considered to be difficult to play depending on fingering is set to a smaller volume than the other pitches [this corresponds to Example (I)].

Another embodiment according to this feature (claim 20) is configured to define the information on fingering corresponding to at least one portion of movement of position of fingering and change musical interval at the portion of movement of position of fingering. As a result, addition of expressions can be performed such that the musical interval is automatically changed in response to fingering position movement [this corresponds to Example (I)]. In view of the fingering, a method is also applicable which adds a noise sound to the performance data in the case of a large volume at a low position.

According to an eleventh feature (claims 21, 48, and 68) of the present invention, at least one portion of the supplied performance data which corresponds to a particular instrument playing method is extracted, and based on the extracted portion and generating method information corresponding to the particular instrument playing method, musical tone control information is generated and added to the performance data. As a result, performance outputs which can have a variety of expressions can be obtained correspondingly to the particular instrument playing method [this corresponds to Examples (4), (5), and (E)].

An embodiment according to this feature (claim 22) is configured so that the particular instrument playing method is a piano sustain pedal method and the value of the reproduction tempo is reduced at portions of the performance data which correspond to the piano sustain pedal method. As a result, addition of expressions can be performed such that the tempo is set in response to a piano sustain pedal operation, for example, the tempo is slightly reduced in response to the sustain pedal operation [this corresponds to Example (4)]. To achieve this, for example, operation of a sustain pedal is detected so that a tempo change based on a result of the detection can be applied to the performance data.

Another embodiment according to this feature (claim 23) is configured so that the particular instrument playing method is a strings trill method, portions of the performance data which correspond to the strings trill method, which maintains a slightly changing (vibration) sound, are each divided into a plurality of parts, and a different value of the reproduction tempo is set between these parts. As a result, addition of expressions can be performed such that timing for the strings trill is set to be slightly different between the plurality of parts [this corresponds to Example (5)]. To achieve this, for example, trill portions are detected and the detected trill portions are copied for a plurality of parts, and timing for the MIDI data is changed so to be different between these parts. In this case, each part may have a different tone color characteristic. This method is also applicable to changing of the musical interval parameter, in which case the musical interval of the trill may be set to be slightly different between the divided parts.

A further embodiment according to this feature (claim 24) is configured so that the particular instrument playing method is a trill playing method or a drum roll playing method and values of volume of notes at portions of the performance data corresponding to the trill or drum roll playing method are set to be uneven or irregular. As a result, addition of expressions can be performed such that the volumes of individual notes are irregular [this corresponds to Example (E)].

According to a twelfth feature (claims 25, 49, and 69) of the present invention, lyrics information is extracted from the supplied performance data, and based on the extracted rylics information and generating method information corresponding to the lyrics information, musical tone control information is generated and added to performance data. As a result, performance outputs with a variety of expressions can be obtained if the music contains lyrics information [this corresponds to Examples (8) and (J)].

An embodiment according to this feature (claim 26) is configured so as to define a tempo control value for at least one particular word and change the value of the reproduction tempo of the performance data based on the defined tempo control value, thereby enabling expressions to be added such that the tempo is set depending on the lyrics [this corresponds to Example (8)]. The addition of expressions can be carried out, for example, by previously registering predetermined words with corresponding tempo coefficients, detecting the predetermined words from the lyrics data in the original performance data, and if any of the predetermined words appears, changing the tempo for the performance data based on this word. In this case, quick tempos are set for happy words, while slow tempos are set for gloomy or important words.

Another embodiment according to this feature (claim 27) is configured so as to define a volume change for at least one particular word and change the volume of the supplied performance data based on the defined volume change, thereby enabling expressions to be added such that the volume of the particular word is changed [this corresponds to Example (J)]. This parameter processing method associated with the lyrics information is also applicable to changing of the musical interval.

According to a thirteenth feature of the present invention (claims 28, 50, and 70), information on at least one performance symbol is extracted from the supplied performance data, and based on the extracted information on the performance symbol and generating method information corresponding to the performance symbol, musical tone control information is generated and added to the performance data. As a result, performance outputs with a variety of expressions can be obtained correspondingly to the performance symbol in the performance data [this corresponds to Experiments (9) and (G)].

Another embodiment according to this feature (claim 29) is configured so that the performance symbol is a staccato symbol and the sounding length of a note immediately before a note marked with the staccato symbol is changed. As a result, addition of expressions can be performed such that the sounding length of a note immediately before a staccato is increased [this corresponds to Example (9)]. To achieve this, for example, the staccato is detected, and the gate time for a note immediately before the staccato is increased depending on a dynamic value $\alpha$. Then, a tempo change is applied to the performance data based on a result of the increase in gate time.

A further embodiment according to this feature (claim 30) is configured so that the performance symbol is a staccato symbol and the volume of a note immediately after a note marked with the staccato symbol is reduced. As a result, addition of expressions can be performed such that the volume of the note immediately after the note marked with the staccato is decreased to emphasize a note immediately after sounding with staccato [this corresponds to Example (G)]. In this staccato performance, the extent to which the volume is changed is preferably adjusted depending on the note value or tempo of the staccato note.

According to a fourteenth feature (claims 31, 51, and 71) of the present invention, the relationship between predetermined characteristic information and musical tone control information of already supplied performance data is stored, and when predetermined characteristic information is extracted from newly supplied performance data, musical tone control information is generated based on the extracted predetermined characteristic information and in accordance with the stored relationship and is then added to the newly supplied performance data. Accordingly, addition of expressions can be performed such that the tempo is set using a learning function [this corresponds to Example (6)]. This method comprises constructing a system for automatically predicting the relationship between pitch change and tempo change, allowing part of the tempo change to be manually input until an intermediate portion of music, and then automatically inputting the remaining part of the tempo change using the learning function. For example, a learning routine learns the relationship between phrases and tempo change from MIDI data to which tempo change has already been applied, and stores results of the learning. For MIDI data for phrases to which no tempo has not yet been applied, tempo change is applied to the performance data based on the stored learning results.

According to a fifteenth feature of the present invention (claims 32, 52, and 72), a plurality of relationships between predetermined characteristic information and musical tone control information for performance data are stored as a library, and when characteristic information is extracted from the supplied performance data, musical tone control information is generated by referring to the library and is added to the performance data. As a result, addition of expressions can be performed such that the tempo is set using the library [this corresponds to Example (7)]. According to this method, tempo changes once generated correspondingly to various characteristic information of the performance data are cut out for a certain section of time and registered as a library. The registered tempo changes are then similarly applied to other portions of the performance data. For example, tempo changes are extracted from MIDI data to which tempo changes have already been applied and converted into relative values, which are then stored as a library. Then, a tempo change is selected from the library, which corresponds to predetermined characteristic information of the MIDI data, and the selected tempo change is elongated or shortened in a time direction and/or in a tempo value direction and applied to the performance data. This method is also applicable to changing of the musical interval parameter.

According to a sixteenth feature of the present invention (claims 33, 53, and 73), musical tone control information is generated based on predetermined characteristic information from the supplied performance data, the generated musical tone control information is compared with musical tone control information from the supplied performance data in terms of the entirety of the performance data, and the generated musical tone control information is modified based on results of the comparison. As a result, performance outputs containing expressions which are well-balanced and optimal in terms of the entire performance data can be obtained [this corresponds to Examples (10) and (K)]. For example, results of tempo change applied throughout the music are checked and the tempo of the entire music is generally corrected so that the average of the results equals an originally set tempo value. The general tempo correction comprises correcting the tempo of the entire music to a uniform value, or instead of the general and uniform correction, preferentially correcting the tempo in sections where the tempo is frequently changed. [see Example (10)]. Further, the average value of the volume of the entire performance data is calculated, and an offset is added to the entire volume so as to obtain a desired average value [see Example (K)].

According to a seventeenth feature of the present invention (claims 34, 54, and 74), at least one portion of supplied performance data which indicates sounding and has a sounding length larger than a predetermined value is extracted, and based on the extracted portion of the performance data and generating method information corresponding to the portion of the performance data indicating sounding and having a sounding length larger than a predetermined value, such musical tone control information as to make uneven or irregular the volume of the same portion is generated and added to the performance data. As a result, addition of expressions can be performed such that the volume of long tones are fluctuated or randomized [this corresponds to Example (H)]. In this case, the fluctuation is preferably determined based on a random number counter and a predetermined changing pattern. This method is also applicable to the musical interval parameter.

According to an eighteenth feature of the present invention (claims 35, 55, and 75), at least one portion of the supplied performance data to which is added a volume change is extracted, and based on the extracted portion and generating method information corresponding to the same portion, such musical tone control information as to apply a musical interval change corresponding to the added volume change, to the extracted portion, is generated and added to the performance data. As a result, expressions can be added to the portion to which is added the volume change (that is, an accent) such that the musical interval change corresponding to the volume change is determined to slightly increase the musical interval of the accented note or tone [this corresponds to Example (a)].

According to a nineteenth feature of the present invention (claims 36, 56, and 76), at least one portion of the supplied performance data where double bending is performed is extracted, and based on the extracted double bending-performed portion of the performance data and generating method information corresponding to the double bending-performed portion, such musical tone control information as to divide the extracted double bending-performed portion into two parts with a higher tone and a lower tone and apply different volume changes, respectively, to the parts is generated and added to the performance data. As a result, addition of expressions can be performed such that when double bending is performed, the double bending-performed portion is divided into two parts with a higher tone and a lower tone and the timing of temporal change in the volume is intentionally shifted between these two parts [this corresponds to Example (b)).

According to a twentieth feature of the present invention (claims 37, 57, and 77), at least one portion of the supplied performance data corresponding to at least one predetermined musical symbol indicative of a tone color change is extracted, and based on the extracted portion and generating method information corresponding to the predetermined musical symbol, such musical tone control information as to change a tone color already set for the portion to a tone color corresponding to the musical symbol is generated and added to the performance data. As a result, addition of expressions can be performed such that the tone color is selected based on a score symbol [this corresponds to Example (c)]. For example, where "pizz." is displayed, the tone color is automatically changed to a pizzicato string and then returned to a rubbed string tone at a position where "arco" is displayed.

[Various Features]

The present invention can be configured as described in the following paragraphs (1) to (23) according to various features of the present invention:

(1) A performance data generating apparatus comprising a device that receives input performance data, a device that obtains characteristic information from the input performance data, a device that supplies an expression adding module storing rules representative of correspondence between predetermined characteristic information and musical tone control information for performance data, a device that sets musical tone control information based on the obtained characteristic information and in accordance with the rules of the supplied expression adding module, a device that adds the set musical tone control information to the input performance data, and a device that outputs the performance data with the musical tone control information added [FIG. 2]. That is, according to the configuration (1), various expression adding modules are provided, which store rules representative of procedures for setting musical tone control information corresponding to characteristics from the input performance data, which information constitutes musical tone control factors, and musical tone control information is set based on these expression adding modules. As a result, more musical performance data can be automatically generated.

(2) A performance data generating apparatus comprising a device that receives input performance data, a device that obtains characteristic information from the input performance data, a device that sets a musical tone variable based on the obtained characteristic information and in accordance with predetermined rules, a device that adjusts a control parameter for the set musical tone variable, a device that determines musical tone control information based on the set musical tone variable and the adjusted control parameter, a device that adds the determined musical tone control information to the input performance data, and a device that outputs the performance data with the musical tone control information added, wherein the parameter adjusting device evaluates the output performance data and adjusts the control parameter again based on results of the evaluation [Examples (1) to (5), (8), and (9)]. That is, according to the configuration (2), in setting various musical tone control information, the control parameter for the musical tone variable (various musical tone variables for time, musical interval, volume, and others which are required for performance) set based on the characteristic information and in accordance with the rules can be adjusted, and the musical tone control information (various performance parameters such as a time parameter, a musical interval parameter, and a volume parameter) is determined based on the musical tone variable and the adjusted control parameter. As a result, addition of expressions can be performed based on optimal musical tone control information.

(3) A performance data generating apparatus which sets musical tone control information such as a time parameter and a musical interval parameter in accordance with rules of correspondence between characteristics of characteristic information and temporal musical tone control contents and/or musical-interval musical tone control contents, based on the characteristic information obtained using a method of extracting note time information from the input performance data (Example (1)), a method of evaluating the progress of a performance of the input performance data, a method of extracting small vibration tone information from the input performance data, a method of recognizing breaks in phrases from the input performance data, a method of calculating pitch information for each predetermined section or smoothed pitch information, from the input performance data, a method of obtaining pitch change direction-turning information from the input performance data, a method of detecting identical or similar patterns or the like from the input performance data [Example (2)], a method of detecting previously registered figures from the input performance data [Example (3)], a method of calculating volume information for each predetermined section or smoothed volume information from the input performance data, a method of obtaining atmosphere information from the input performance data, a method of extracting predetermined note group/train information from the input performance data, a method of extracting chord note number information from the input performance data, a method of extracting fingering information from the input performance data, a method of extracting playing method information corresponding to a particular instrument playing method, from the input performance data [Example (4)], a method of extracting small vibration tone information for strings or the like from the input performance data [Example (5)], a method of obtaining lyrics information from the input performance data [Example (8)], a method of obtaining tone generator output waveform information from the input performance data, and/or a method of extracting predetermined performance symbol information from the input performance data [Example (9)]. With this configuration, by obtaining, as characteristics of the input performance data, note time information (note density or interval between two notes or tones), the progress of the performance, small vibration tone information (trill/vibrato of long tones, pitch bend, or the like), breaks in phrases or phrase borders (trailing ends of phrases or the like), pitch information, pitch change direction-turning information (pitch rise-to-fall turning points), identical or similar patterns (sequence of identical patterns, similar phrases, or the like), registered figures (phrase templates or the like), volume information, atmosphere information ("tense feeling" or the like), note group/train information (a group of notes, long tuplets, or the like), chord note number information, tone color information, fingering information (fingers, position movement, positions, or the like), playing method information (guitar pulling-off, hammering-on, piano sustain pedal, and others), small vibration tone information (trill by a plurality of parts or the like), and/or lyrics information, predetermined performance symbols (accent symbol, staccato, and others), and setting musical tone control information based on these characteristics, performance outputs with a variety of expressions can be obtained based on the characteristic information.

(4) A performance data generating apparatus comprising a device that receives input performance data, a device that stores the relationship between predetermined characteristic information and musical tone control information of already input performance data, a device that obtains characteristic information from newly input performance data, a device that sets musical tone control information based on the obtained characteristic information and in accordance with the stored relationship, a device that adds the set musical tone control information to the newly input performance data, and a device that outputs the performance data with the musical tone control information added [Example 6], and a performance data generating apparatus comprising a library that stores a plurality of relationships between predetermined characteristic information and musical tone control information for performance data, a device that receives input performance data, a device that obtains characteristic information from the input performance data, a device that sets musical tone control information by referring to the library based on the obtained characteristic information, a device that adds the set musical tone control information to the input performance data, and a device that outputs the performance data with the musical tone control information added [Example (7)]. With these configurations, the relationship between the predetermined characteristic information and musical tone control information of the already input performance data is stored and the musical tone control information is set using results of learning in accordance with the stored relationship, based on the characteristic information of the newly input performance data, or the musical tone control information is set by referring to the library that stores the plurality of relationships between the predetermined characteristic information and musical tone control information for performance data, based on the characteristic information obtained from the input performance data. As a result, adaptability of the addition of expressions can be improved using the leaning function or the library.

(5) A performance data generating apparatus comprising a device that receives input performance data, a device that sets musical tone control information based on predetermined characteristic information of the input performance data, a device that compares the set musical tone control information with the musical tone control information of the input performance data in terms of the entire performance data, and a device that modifies the set musical tone control information based on results of the comparison [Example (10)]. With the configuration (5), the set music control information is modified based on results of the comparison between the set musical tone control information and the musical tone control information of the input performance data, so that the musical tone control information can be set to values that are optimal in terms of the entire performance data.

(6) An automatic parameter editing apparatus comprising a supply device that supplies performance data, an analysis device that analyzes the supplied performance data and extracts subsections of the entire section containing all the performance data, to which one of plural types of expressions can be added, a determination device that selects and determines from the plural types of expressions an expression to be applied to the performance data contained in the extracted subsections, and a parameter editing device that automatically edits parameters for the performance data contained in the extracted subsections, in accordance with an expression addition algorithm corresponding to the determined expression, and a parameter storage medium that stores a program that can be realized by a computer, the parameter storage medium comprising a supply module for supplying performance data from a supply device, an analyzing module for analyzing the supplied performance data extracting subsections of the entire section including all the performance data to which one of plural types of expressions can be added, a determining module for selecting and determining from the plural types of expressions an expression to be applied to the performance data contained in the extracted subsections, and a parameter editing module for automatically editing parameters for the performance data contained in the extracted subsections, in accordance with an expression addition algorithm corresponding to the determined expression. The performance data are assumed to be sequence data. Thus, the performance data can be arranged in time series, and the concept "section" can be introduced thereinto. Further, "the parameters" refer to variable information such as temporal musical tone control information such as tempo or timing, musical-interval musical tone control information, or volume musical tone control information which is used to control musical tones during performance and is also referred to as "performance parameters". This is also applicable to the following configurations.

(7) An automatic parameter editing apparatus comprising a supply device that supplies performance data, an extraction device that extracts data regions of the supplied data where the pitch shows a tendency to rise, and a parameter editing device that edits the volume or musical-interval parameter value for each of performance data contained in each extracted data region in such a manner that the pitch or musical interval of the performance data progressively increases or decreases from performance data located at the beginning of the data region to performance data located at the end thereof [Example (A)]. In this apparatus, the tendency to rise includes what can be regarded as "a rise tone system" as a result of evaluation of the entire data region, though it is not a simple rise tone system. This is also applicable to the following configurations.

(8) An automatic parameter editing apparatus comprising a supply device that supplies performance data, an extracting device that extracts data regions from the supplied performance data where the pitch shows a tendency to rise or fall, and further extracts a data region including performance data located at a change point where the pitch changes from a tendency to rise to a tendency to fall, and a parameter editing device that edits a volume parameter value of the performance data located at the change point, out of the performance data contained in the extracted data regions, in such a manner that an accent is applied to the volume of the performance data located at the change point [Example (A)]. In this apparatus, the tendency to fall includes what can be regarded as "a fall tone system" as a result of evaluation of the entire data region, though it is not a simple fall tone system. This is also applicable to the following configurations.

(9) An automatic parameter editing means comprising a supply device that supplies performance data, a storage device that stores plural types of volume or musical-interval change patterns defining a tendency of change in volume or musical-interval parameter value from performance data located at the beginning of the supplied performance data to performance data located at the end thereof, a selecting device that selects one of the plural types of stored volume or musical-interval change patterns, and a parameter editing device that edits the volume or musical-interval parameter value of each of the supplied performance data in such a manner that the volume or musical-interval parameter value of the supplied performance data has a change tendency defined by the selected-volume or musical-interval change pattern [Example (B)]. In this apparatus, the change tendency includes, for example, a tendency to increase the volume or musical-interval parameter value in accordance with the progress of the music. Such a change tendency enhances listeners' excitement as the music progresses. The characteristic of increasing the volume or musical-interval parameter value is desirably such that the parameter value converges to a predetermined finite value as the music progresses. This prevents the output range of the tone generator from being exceeded, thereby enabling natural addition of expressions. This is also applicable to the following configurations.

(10) An automatic parameter editing apparatus comprising a supply device that supplies performance data, an extracting device that extracts data regions from the supplied performance data where an occurrence density of performance data indicating sounding is equal to or larger than a predetermined value, and a parameter editing device that edits a volume or musical-interval instability parameter value for performance data contained in each extracted data region, to a value dependent on the occurrence density. The occurrence density means an occurrence density per unit time. The occurrence density being equal to or larger than a predetermined value means that the performance is difficult to play, and therefore the value dependent on the occurrence density typically means a value smaller than that of the original volume parameter, that is, a decrease in volume, for the volume parameter, and means an increase in volume for the musical-interval instability parameter value.

(11) An automatic parameter editing apparatus comprising a calculation device that calculates a musical interval based on performance data contained in an extracted data region and calculates a musical-interval change width between a minimum value and a maximum value of the calculated musical interval, and a parameter editing device that edits the volume or musical-interval instability parameter value for the performance data contained in the data region, to a value dependent on the occurrence density and the calculated musical interval change width. In this apparatus, the musical-interval change width can be used as an indicator for changing the volume parameter value or the musical-interval instability parameter value, and typically the volume parameter value is changed in a decreasing direction and the musical-interval instability parameter value is changed in an increasing direction with an increase in the musical interval or musical-interval instability change width. This is also applicable to the following configurations.

(12) An automatic parameter editing apparatus comprising a supply device that supplies performance data, a device that extracts data regions from the supplied performance data which each have similar phrases, a calculating device that calculates a similarity between similar phrases contained in each extracted similar-phrase region, and a parameter editing device operable when similar phrases appear continuously, to edit and set a volume parameter value for a second or subsequent similar phrase to a value dependent on the calculated similarity but smaller than that for a first similar phrase, and operable when similar phrases appear discretely or separately, to edit and set the volume parameter value for the second or subsequent similar phrase to a value dependent on the calculated similarity but similar to that for the first similar phrase [Example (C)]. The similarity is easy to understand if it is set to four level values according to the following respective cases: in terms of phrases to be compared, ① all the performance data are the same, ② the performance data are partly different, ③ the performance data are partly the same, and ④ all the performance data are different. However, there may be more or less levels. This is also applicable to the following configurations.

(13) An automatic parameter editing apparatus comprising a supply device that supplies performance data, an extracting device that extracts data regions from the supplied performance data which each have simple triple time and such a bar length that all performance data indicating sounding have the same sounding length, a determining device that determines beat positions of each extracted data region to which dynamics are to be applied, and a parameter editing device that increases a volume parameter value of performance data located at beat positions that have been determined by the determining device to have a strong or high degree of dynamics while, reducing the volume parameter value of performance data located at beat positions that have been determined by the determining device to have a weak or low degree of dynamics. Criteria for determining the beat positions to which dynamics are to be applied include the style and composer of the music selected as the performance data, as well as the age when the music was composed, and others. This is also applicable to the following configurations.

(14) An automatic parameter editing apparatus comprising a supply device that supplies performance data, an extracting device that extracts data regions from the supplied performance data which each correspond to a phrase, a calculating device that calculates a value of tempo set for each extracted data region, a detecting device that detects performance data indicating sounding and located at the end of the extracted data region as well as a sounding length of the performance data, and a parameter editing device that edits a volume parameter value for the detected performance data in such a manner that the volume of the performance data progressively attenuates for a duration dependent on the calculated tempo value and the detected sounding length [Example (D)].

(15) An automatic parameter editing apparatus comprising a supply device that supplies performance data, an extracting device that extracts data regions from the supplied performance data which each indicate sounding, contains a trill or vibrato, and have a sounding length equal to or larger than a predetermined sounding length, a storage device that stores a volume change pattern or a musical-interval change speed pattern defining a volume change or a musical-interval change speed, respectively, both of which are to be assumed during trill performance of the performance data with the predetermined or larger sounding length, and a volume change pattern or a musical-interval change speed pattern defining a volume change or a musical-interval change speed, respectively, both of which are to be assumed during vibrato performance of the performance data with the predetermined or larger sounding length, each volume change pattern or musical-interval change pattern being stored in types corresponding to respective different sounding lengths, a readout device that reads out a volume change pattern or a musical-interval change speed pattern from the storage device depending on the extracted performance data, and a parameter editing device that edits a volume parameter value or a musical-interval change speed parameter value for the extracted performance data in such a manner that a change of the volume of the extracted performance data or a speed at which the musical interval thereof changes is equal to a corresponding value defined by the readout volume change pattern or musical-interval change speed pattern.

(16) An automatic parameter editing apparatus comprising a supply device that supplies performance data, an extracting device that extracts data regions from the supplied performance data where a trill performance or a roll performance is performed, and a parameter editing device that edits and sets volume parameter values for performance data contained in each extracted data region, to uneven or irregular values [Example (E)].

(17) An automatic parameter editing apparatus comprising a supply device that supplies performance data, an extracting device that extracts data regions from the supplied performance data which each comprise a plurality of performance data indicating simultaneous sounding, a storage device that stores patterns indicating positions of performance data to be emphasized, in types corresponding to the number of the performance data indicating simultaneous sounding and pitches of the performance data, a readout device that reads out from the storage device a pattern corresponding to the number of performance data contained in each extracted data region and the pitch of the performance data, and a parameter editing device that edits a volume or musical-interval parameter value for the extracted performance data in such a manner that performance data of the extracted performance data at positions indicated by the read pattern are emphasized [Example (D)]. In this apparatus, the plurality of performance data indicating simultaneous sounding are typically performance data constituting a chord, but are not limited to this but may be an octave unison. This is also applicable to the following configurations.

(18) An automatic parameter editing apparatus comprising a supply device that supplies performance data, an extracting device that extracts data regions from the supplied performance data which each indicate sounding and are located immediately after a data region to be sounded with a staccato, and a parameter editing device that edits a volume parameter value for the extracted data region or performance data in a manner decreasing the volume of the performance data [Example (G)].

(19) An automatic parameter editing apparatus comprising a supply device that supplies performance data, an extracting device that extracts data regions from the supplied performance data which each indicate sounding and have a sounding length equal to or larger than a predetermined sounding length, an output device that outputs an irregular value and changes a change width of the irregular value depending on time elapsed from the start, of the sounding, and a parameter editing device that edits and sets a volume or musical-interval parameter value for each extracted data region or performance data to the irregular value output from the output device in such a manner that the volume or musical interval of the performance data is irregular or irregular but lasts for a duration corresponding to the sounding length with the change width of the volume or musical interval changing [Example (H)]. The extracted performance data are what is called "long tone". The volume of a long tone is changed during sounding of the long tone while it is set to the irregular value and its amplitude is progressively changed so that fluctuations are applied to the long tone. This is also applicable to the following configurations.

(20) An automatic parameter editing apparatus comprising a supply device that supplies performance data, a detecting device that detects parts having the same tone color and the number of the parts from the supplied performance data, a calculating device that calculates a volume value for each part assumed during performance depending on the detected number of the parts, and a setting device that sets the calculated volume value for each part as a volume parameter value for the part. When a performance of a score with a part division designated is carried out, the conventional parameter editing apparatus does not add any change to the volume parameter value at all, which causes an increase in the volume to a larger value than when no part division is designated, whereas the present apparatus "calculates the volume value for each part assumed during performance, depending on the detected number of parts", to solve the above problem. This is also applicable to the following configurations.

(21) An automatic parameter editing apparatus comprising a supply device that supplies performance data, an extracting device that extracts data regions from the supplied performance data for which a pitch change based on a pitch bend is designated, a determining device that calculates a tendency of change in the pitch bend in each extracted data region or performance data and determines a change amount of the volume depending on results of the calculation, and a parameter editing device that edits a volume parameter value for the extracted performance data in such a manner that a change in the volume of the performance data becomes equal to the determined change amount.

(22) An automatic parameter editing apparatus comprising a supply device that supplies performance data, an extracting device that extracts melody parts from the supplied performance data, a determining device that compares each extracted melody part with other parts to determine a change amount of a performance parameter so that the melody part stands out from the other parts, and a parameter editing device that edits the performance parameter for the extracted melody part based on the determined change amount of the performance parameter. In this apparatus, the performance data are assumed to be composed of a plurality of parts. However, for performance data in which a single tone color is used both for melody and accompaniment, for example, performance data for the piano, the configuration of claim 23 can be directly applied without any change if a top note is extracted from the performance data as a melody part. This is applicable to the following configuration.

(23) An automatic parameter editing apparatus comprising a supply device that supplies performance data, an extracting device that extracts lyrics information from the supplied performance data, a detecting device that detects one of words contained in the extracted lyrics information of which the volume or musical interval is to be changed, a storage device that stores, for each word, a volume or musical-interval change pattern indicating a pattern of change in the volume or musical interval to be applied to the word, a readout device that reads out a volume or musical-interval change pattern corresponding to the detected word, from the storage device, and a parameter editing device that edits the readout volume or musical-interval parameter value for the performance data in such a manner that a change in the volume or musical interval of the detected word becomes equal to a change in volume or musical interval indicated by the readout volume or musical-interval change pattern [Example (J)].

According to the automatic parameter editing apparatuses having the configurations (6) to (23), the performance data supplied from the supply device are analyzed, subsections to which one of plural types of expressions can be applied are extracted from the entire section containing all the performance data, one of the plural types of expressions is selected and determined as a type of expression to be applied to performance data contained in each extracted subsection, and a a parameter or parameters for the performance data contained in the extracted subsection are automatically edited in accordance with an expression addition algorithm corresponding to the determined type of expression. Therefore, even a beginner can add a variety of expressions to music using simple operations.

The above and other objects of the invention will become more apparent from the following drawings taken in conjunction with the accompanying drawings.

BRIEF DESCRIPTION OF THE DRAWINGS

FIG. 38 is a view showing an example of table data for defining volume control after tone generation;

DETAILED DESCRIPTION OF PREFERRED EMBODIMENTS

The present invention will now be described with reference to the drawings showing preferred embodiments thereof. The embodiments given below are only for illustrative purposes and may be subject to various changes and alterations without deviating from the spirits of the present invention.

[Hardware Construction]

Figure 1:
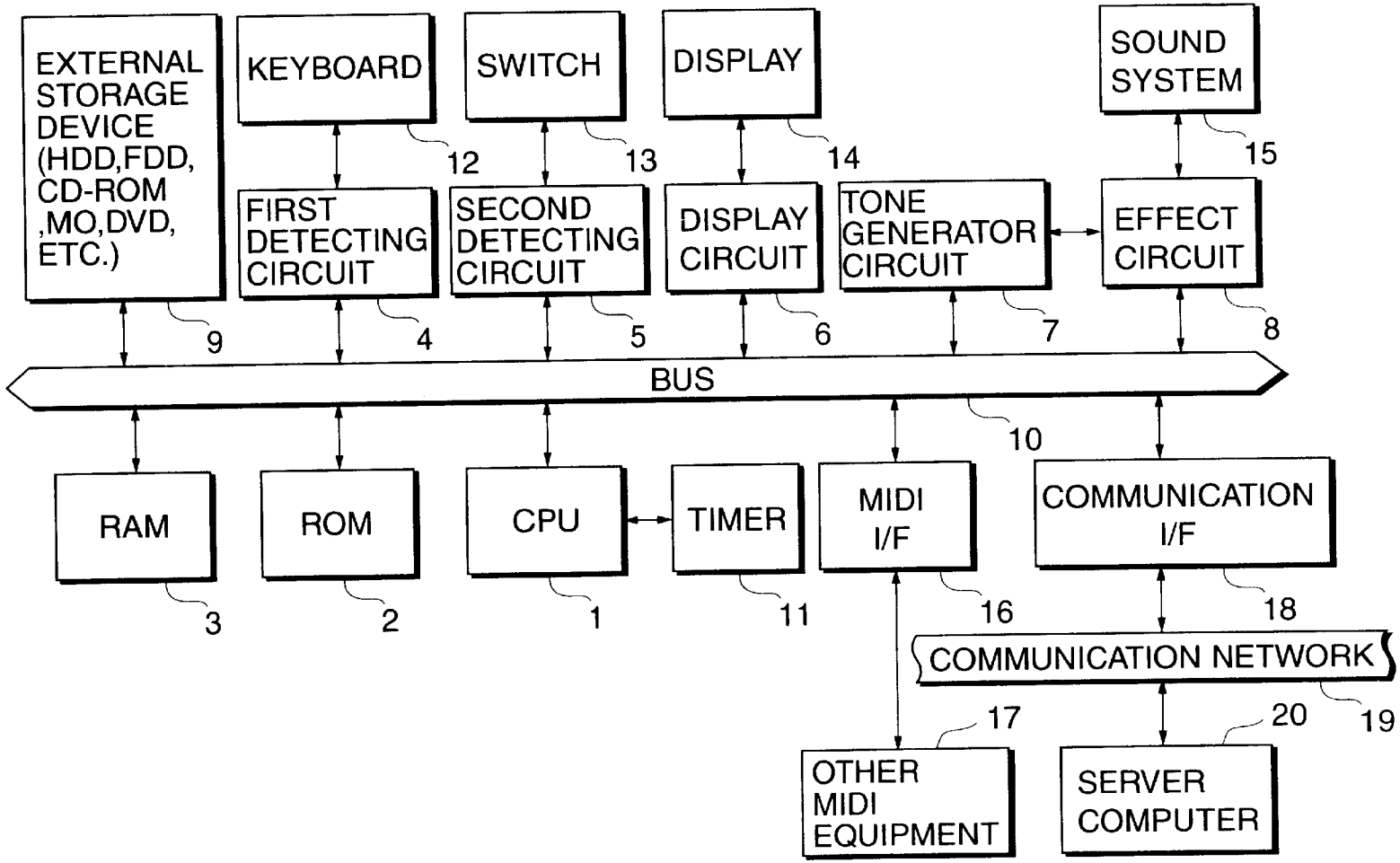
FIG. 1 is a block diagram showing the hardware construction of a performance data generating apparatus according to an embodiment of the present invention.

FIG. 1 is a block diagram of the hardware construction of a performance data generating apparatus (that is, an automatic parameter editing apparatus) according to an embodiment of the present invention. The performance data generating apparatus is comprised of a central processing unit (CPU) 1, a read-only memory (ROM), a random access memory (RAM) 3, first and second detecting circuits 4, 5, a display circuit 6, a tone generator circuit 7, an effect circuit 8, an external storage device 9, and other elements. The elements 1 to 9 are connected to each other via a bus 10 to constitute a performance data generating system for executing a performance data generating process or an automatic parameter editing system for executing an automatic parameter editing process.

The CPU 1, which controls the entire system (that is, the entire apparatus), includes a timer 11 used, for example, to generate tempo clocks or interrupt clocks (that is, to clock an interrupt time for a timer interrupt process or various other times), in order to provide various controls in accordance with predetermined programs and particularly to centrally execute various processes for tempo change, volume changes, or musical interval changes, described later. The ROM 2 stores predetermined control programs for controlling this performance data generating (automatic parameter editing) system, and these control programs can include a basic performance information process program, conversion process programs for various tempos/timing, volume or musical-interval changes, and others according to the present invention, various tables and various data (that control programs and various tables and data that are executed by the CPU 1). The RAM 3 is used as a work area for storing data and parameters required for these processes and temporarily storing various registers, flags, and various data being processed (that is, performance data, various input information, results of calculations, and others).

The first detecting circuit 4 is connected to a performance operation device 12 comprised of performance operators such as a keyboard. The second detecting circuit 5 is connected to an operation switch device 13 which is comprised of operators such as numerical value/character keys for setting various modes, parameters, and others. For example, the performance operation device 12 has a keyboard for principally inputting voice information and character information, the operation switch device 13 has a mouse that is a pointing device, and the first and second detecting circuits 4, 5 have a key operation detecting circuit for detecting the operative state of each key on the keyboard and a mouse operation detecting circuit for detecting the operative state of the mouse, respectively.

The display circuit 6 is comprised of a display 14 formed, for example, of a large crystal display (LCD) or a CRT (Cathode Ray Tube) display, and various indicators formed, for example, of light emitting diodes (LED) or the like for displaying various information and others. The display 14 and the indicators may be arranged on an operation panel of the operation switch device 13 in juxtaposition with various operators thereof. The display 14 can display various setting screens and various operator buttons to allow a user to set and display various modes and parameter values.

A sound system 15 is connected to the effect circuit 8, and is comprised of a DSP or the like. The sound system 15 cooperates with the effect circuit 8 and the tone generator circuit 7 to constitute a musical tone output section to generate musical tones based on various performance data generated during execution of various processes according to the present invention so that a listener can listen to or monitor performances based on output performance data to which expressions have been added. For example, the tone generator circuit 7 converts performance data input from the keyboard of the performance operation device 12, previously recorded performance data, or the like into musical tone signals, the effect circuit 8 applies various effects to the musical tone signals from the tone generator circuit 7, and the sound system 15 includes a DAC (Digital-to-Analog Converter), an amplifier, a speaker, or the like to convert musical tone signals from the effect circuit 8 into sounds.

The external storage device 9 is comprised of a storage device such as a hard disk drive (HDD), a compact disk read-only memory (CD-ROM) drive, a floppy disk drive (FDD), a magnet-optic (MO) disk drive, a digital versatile disk (DVD) drive, or the like, and stores various control programs or data. Thus, the ROM 2 is not the only storage medium used to store various programs and data required to process performance data but such programs and data can also be loaded into the RAM 3 from the external storage device 9 to process performance data, and results of the processes can also be recorded in the external storage device 9 via the RAM 3 as required. For example, the FDD drives a floppy disk (FD) that is a storage medium, the HDD drives a hard disk that stores various application programs including control programs as well as various data, and the CD-ROM drive drives a CD-ROM that stores various application programs including control programs as well as various data.

The hard disk in the HDD (9) can also store control programs executed by the CPU 1 as described above, and if a control program or control programs are not stored in the ROM 2, it/they can be stored in the hard disk and then loaded in the RAM 3 to allow the CPU 1 to operate in the same manner as when the control program(s) is(are) stored in the ROM 2. This allows control program(s) to be added or upgraded with ease.

The control programs and various data read from the CD-ROM in the CD-ROM drive (9) are stored in the hard disk in the HDD (9). This allows control program(s) to be newly installed or upgraded with ease. Further to the CD-ROM drive, various other devices such as a magnet-optic disk (MO) device can be provided as the external storage device 9 to enable the use of various forms of media.

In the illustrated example, a MIDI interface (I/F) 16 is connected to the bus 10 to allow the system to communicate with another MIDI equipment 17 to receive external MIDI (Musical Instrument Digital Interface) signals or output MIDI signals from or to the MIDI equipment 17. Further, a communication interface 18 is also connected to the bus 10 to transmit and receive data to and from a server computer 20 via a communication network 19 and to allow control programs or various data from the server computer 20 to be stored in the external storage device 9. Besides the server computer 20, other client computers can be connected to the communication network 19.

The MIDI I/F 16 is not limited to a dedicated type but may be a general-purpose interface such as an RS-232C, a USB (universal serial bus), or an IEEE1394. In this case, data other than MIDI messages may be simultaneously transmitted or received.

The communication I/F 18 is connected to the communication network, which may be, for example, a LAN (Local Area Network), the Internet, or a telephone line as described above so that the communication I/F 18 can be connected to the server computer 20 via the communication network 19. If the hard disk in the HDD (9) stores none of the above described programs or various parameters, the communication I/F18 is used to download programs or parameters from the server computer 20. A computer acting as a client (in this embodiment, the performance data generating apparatus or the automatic parameter editing apparatus) transmits a command for downloading of programs or parameters to the server computer 20 via the communication I/F18 and the communication network 19. The server computer 20 receives this command and delivers the requested programs or parameters to the computer via the communication network 19, and the computer receives these programs or parameters via the communication I/F18 and stores them in the hard disk in the HDD (9), thereby completing the downloading.

Another interface may be provided for transmitting and receiving data to and from external computers or the like.

The performance data generating apparatus or automatic parameter editing apparatus according to the present embodiment is constructed on a general-purpose computer as is apparent from the above described construction, but is not limited to this and may be constructed on a dedicated apparatus comprised of minimum required elements that can implement the present invention.

The performance data generating (automatic parameter editing) apparatus according to the present invention can be implemented in the form of an electronic musical instrument but can also be implemented in the form of a personal computer (PC) incorporating application programs for processing musical tones. Further, the tone generator circuit 7 need not be comprised of hardware but may be comprised of a software tone generator (although in the present embodiment, the tone generator circuit 7 is comprised entirely of hardware as indicated by its own name, it is not limited to this but may be comprised partly of hardware with the remaining part comprised of software or may be comprised totally of software), and the other MIDI equipment 17 may be responsible for the functions of the musical tone output section including the tone generator function.

EMBODIMENT 1

First, "Embodiment 1" will be explained, which adds expressions mainly using as specific performance parameters, temporal musical tone control information such as tempo change, gate time, or tone generation start timing (sounding, start timing) (other specific examples of performance parameters include a musical interval parameter (hereinafter referred to as "interval parameter") and a volume parameter).

[Summary of System Functions]

Figure 2:
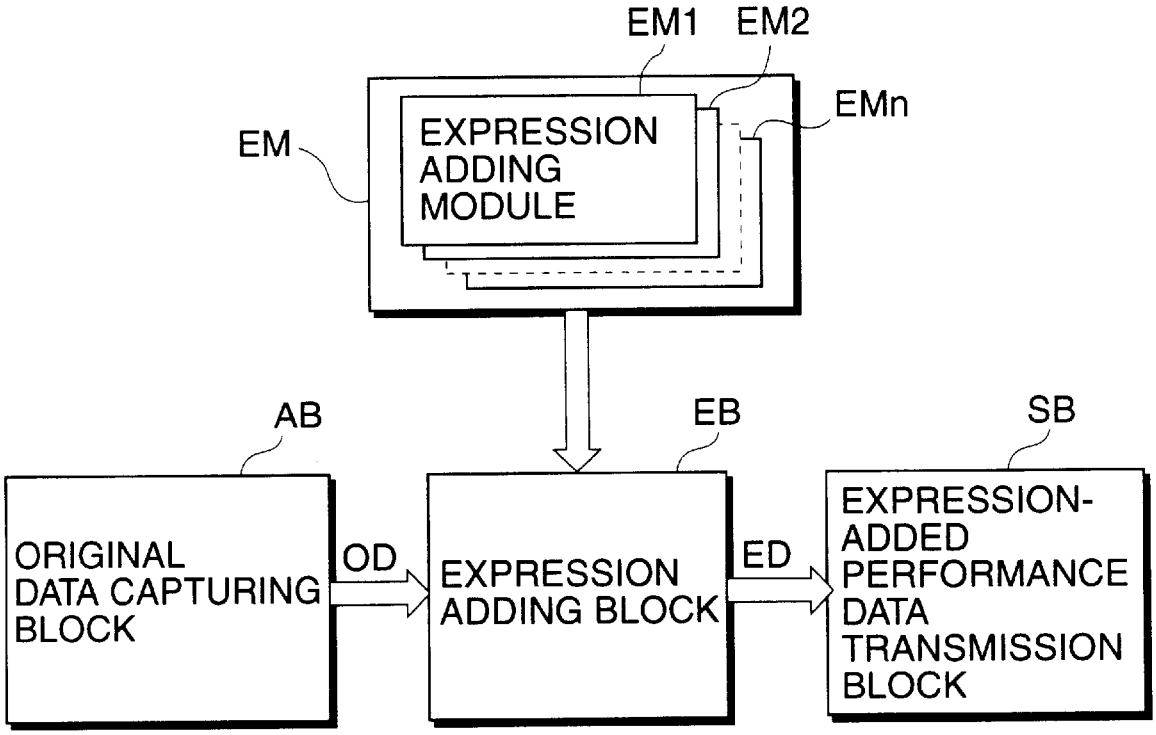
FIG. 2 is a block diagram showing an outline of functions provided by the performance data generating apparatus according to the present invention.

FIG. 2 shows an outline of functions provided by the performance data generating (automatic parameter editing) system. The functions of the system are comprised of an original performance data capturing block AB for capturing original performance data OD, an expression adding block EB for adding temporal expressions to the original performance data supplied by the block AB by mainly using tempo conversion, an expression adding module EM that stores expression addition rules and manners corresponding to various expressions supplied to the expression adding block EB, and an expression-added performance data transmission block SB for transmitting the performance data with the expressions ED added to the tone generator section or the like. The expression adding module EM stores rules for characteristics of various musical expressions, mainly of tempo change and in accordance with these rules, adds temporal expressions mainly including timing shifts such as tempo change, gate time, and tone generation timing, to the original performance data OD, to convert the original performance data OD into performance data ED with musical expressions added. Various expression adding modules EM1, EM2, . . . are provided beforehand as the expression adding module EM so that the user can select and supply any one or more expression adding modules to the expression adding block EB.

The functions of the expression adding module EM can be realized by the performance data generating (automatic parameter editing) system in FIG. 1 by operating various tempo or timing conversion process programs in the ROM 2 or loading desired tempo or timing conversion process programs from the external storage device 9. In this manner, the external storage device 9 can supply the expression adding module, so that only those of the large number of expression adding modules which are desired by the user can be installed in the performance data generating (automatic parameter editing) system or expression adding modules newly supplied by a manufacturer or the like can be newly installed therein. The original performance data OD can also be arbitrarily input by the original performance data loading block AB, one of the system functions, from the keyboard-type operator device 12, the external storage device 9, or the MIDI equipment such as a sequencer or performance equipment, while the expression-added performance data ED can be arbitrarily output by the expression-added performance data transmission block SB to the musical tone output section, the external storage section 9, the MIDI equipment, or the like. The performance data are typically MIDI data.

That is, the expression adding module EM according to the present invention stores as rules characteristics of performance data which constitute factors for temporally controlling musical tones. When the original performance data OD are input to the expression adding block EB, temporal control information (tempo or timing) is set based on the characteristic information obtained from the original performance data OD and in accordance with the rules. The musical tone control information is added to the original performance data OD, which is then output as performance data ED with expressions (hereinafter referred to "expression-added performance data ED"). The temporal musical-tone control variable can be adjusted using control parameters so as to add optimal temporal expressions to the musical tones. Further, a learning function or a library can be used to expand the range of addition of expressions or the musical tone control information can be modified with respect to the entire performance data to make settings appropriate for the entire performance data.

The expression adding module EM can also store as rules characteristics of performance data such as volume or musical interval (hereinafter referred to as "interval") of musical tones which constitute other performance controlling factors. Accordingly, when the original performance data OD are input to the expression adding block EB, performance control information (musical tone control information and performance parameters) is set based on the characteristic information obtained from the original performance data OD and in accordance with the rules. The performance control information is added to the original performance data OD, which are then output as the expression-added performance data ED. The musical tone control variable based on the performance control information can also be adjusted using control parameters so as to add optimal temporal expressions to the musical tones. Further, the learning function or the library can be used to expand the range of addition of expressions or the performance control information can be modified with respect to the entire performance data to make settings appropriate for the entire performance data.

[Various Examples of Expression Adding Module]

Rules and procedures for tempo change or the like which are executed by the various expression adding modules EM (EM1, EM2, . . . EMn) according to an embodiment of the present invention will be described below with reference to individual examples (1) to (31). In these examples, the module EM converts the original performance data OD into the MIDI expression-added performance data ED, but the present invention is applicable independently of the data format such as the MIDI. The method of applying tempo change to the performance data includes insertion of tempo change event(s) and shifting of a time point of each note. Although the following description mainly refers to the insertion of tempo change event(s), it may be replaced by the shifting of time point of each note. Conversely, the shifting of time point of each note may be replaced by the insertion of tempo change event(s).

(1) "Increase Tempo with Increase of Number of Notes"

In general, one is likely to consider that more notes to refer to make the performance more difficult to perform, to thereby decelerate the tempo. In actual performance, however, such a psychology makes the player conscious of the need to maintain the tempo, so that he accelerates the tempo against his will. More notes also tend to make the performance sound more active. Accordingly, it is human and natural to accelerate the tempo with an increase in the number of notes to refer to. Thus, according to this tempo change rule, to reproduce expressions such as ones described above, performance data are evaluated, for example, in terms of bars depending on the note density, so that the tempo is changed depending on the number of notes per beat.

Figure 3:
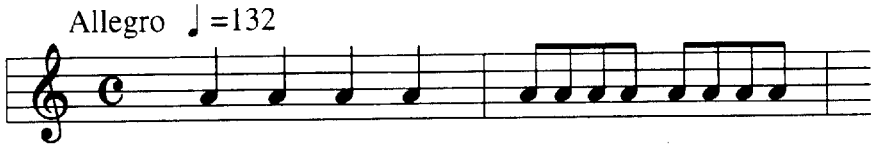
FIG. 3 is a view showing an example of a score used in Example (1) of the present invention.
Figure 4:
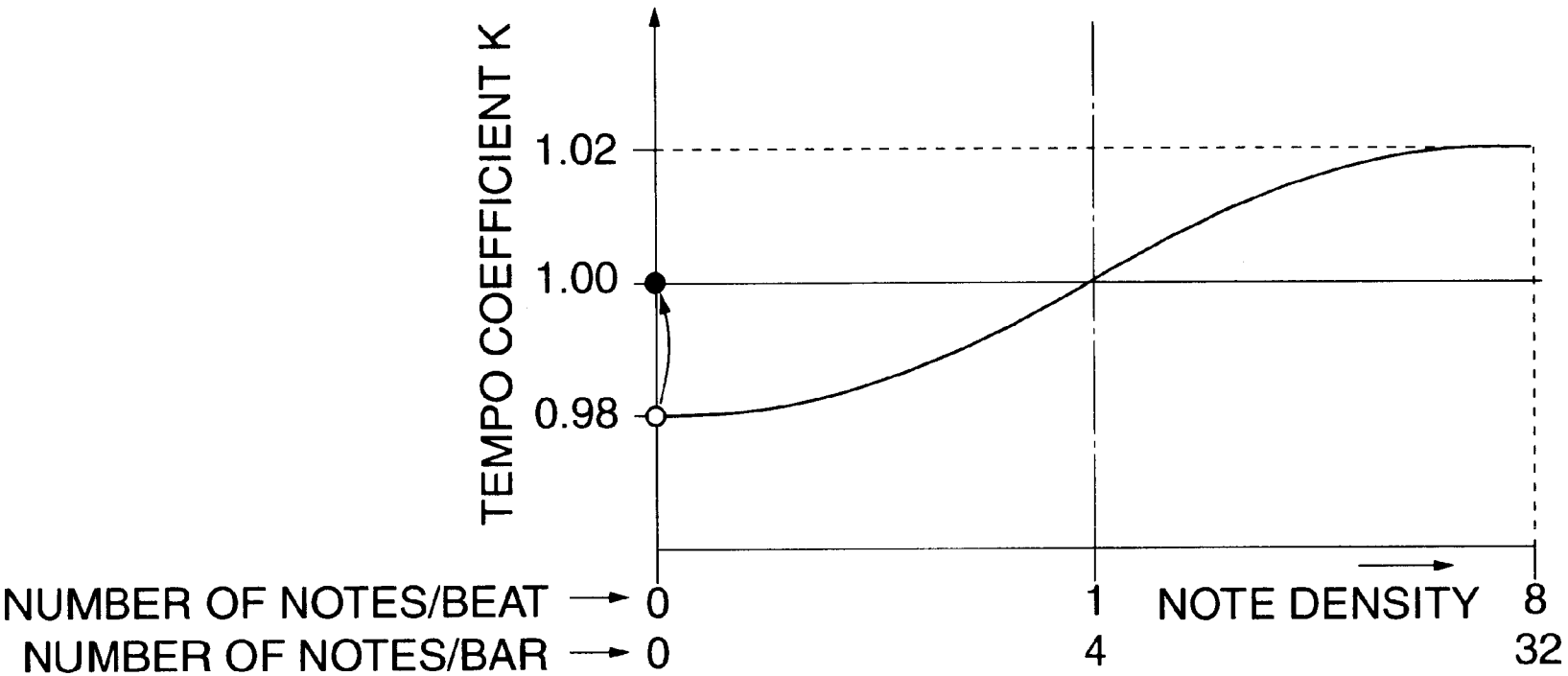
FIG. 4 is a chart showing an example of a "note density-tempo coefficient" table used in Example (1) of the present invention.

For example, in an example of a score shown in FIG. 3, the first bar has one note per beat but the second bar has two notes per beat. Thus, this value (the number of notes per bar)/(the number of beats per bar) is used as a note density so that the tempo is changed depending on this note density. Since the first bar has a note density of "1", quarter notes "132" result with the tempo unchanged. On the other hand, the second bar has a note density of "2", and the tempo value is set through a table depending on the note density. Such a table may be, for example, a "note density-tempo coefficient (multiplying factor)" table such as one shown in FIG. 4. Therefore, for the second bar in the example of score in FIG. 3, the table in FIG. 4 shows, for example, a tempo coefficient K=1.02 (2% acceleration) for the note density "2". Then, the tempo value for the original performance is multiplied by this tempo coefficient K to determine a desired tempo value.

Figure 5:
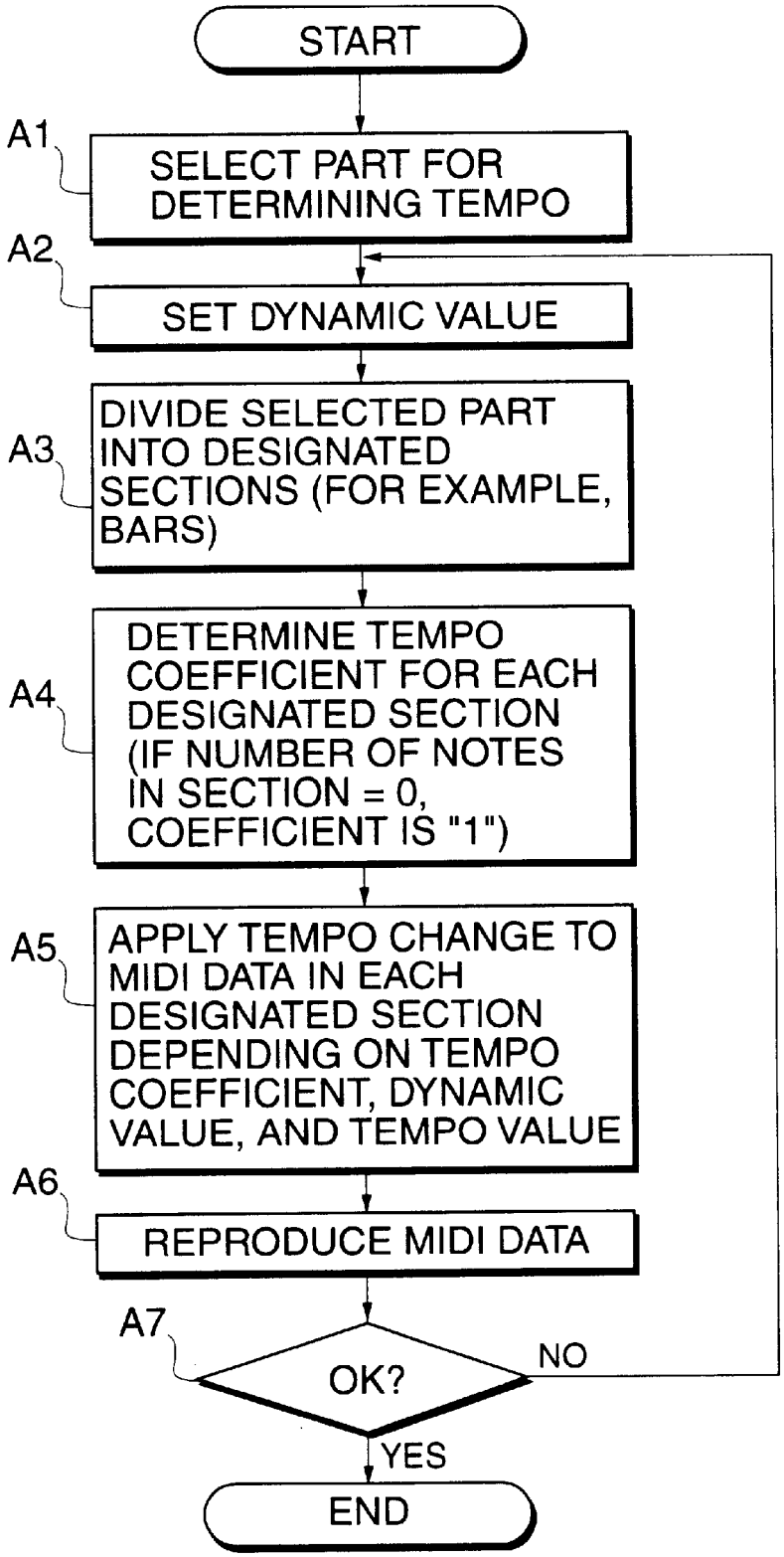
FIG. 5 is a flow chart showing an example of a note density responsive process according to Example (1) of the present invention.

FIG. 5 is a flow chart showing an example of a note density responsive process executed according to the expression adding module EM to accelerate the tempo depending on the note density. At a first step A1 in this process flow, one of a plurality of performance parts is selected from the original MIDI data as an object part for which the tempo is to be determined. At the next step A2, a dynamic value $\alpha$ for the tempo is set (when the process initially proceeds from the step A1 to the step A2, the initial value of $\alpha$ is set, for example, to "1"), and the process proceeds to a step A3.

At the step A3, the selected part is divided into designated sections (for example, sections corresponding respectively to bars), and at the next step A4, the value of the tempo coefficient K for each designated section is determined to evaluate the note density for each designated section. The evaluation of the note density or the number of notes of the steps A3 and A4 may be carried out, for example, in terms of bars with each bar set as the designated section or may be carried out in terms of beats or in terms of a reference time for the tempo (Tick=minimum time resolution, which is also called "clock" or "step time"). The tempo coefficient K for each designated section can be determined, for example, from the above described "note density-tempo coefficient" table in FIG. 4.

To determine the tempo coefficient K at the step S4, if the number of notes per section is "0", the tempo coefficient K is exceptionally set to "1" as shown by ○→● in FIG. 4. Since in MIDI data in general, rests are not handled as notes, a bar composed only of rests will have a slow tempo. Thus, when there is no note within a section to be evaluated (that is, the section is composed of rests), the exceptional processing is required; that is, the tempo coefficient K has to be evaluated to be "1".

Then, the process proceeds from the step A4 to a step A5, wherein a currently set tempo change amount (for example, "132"×$\alpha$×K) is determined based on the determined tempo coefficient K for each designated section, the dynamic value $\alpha$, and the currently set tempo value (for, example, "132" in the example of score in FIG. 3) and is then applied to the MIDI data in each designated section. At the next step A6, the MIDI data with the tempo change applied are reproduced for an entire piece of music or only for a required portion thereof, and the reproduced sound is generated via the musical tone output section so that the listener can listen to a performance based on these MIDI data. Subsequently, the process proceeds to a step A7, to determine whether the reproduced MIDI data with the tempo change applied are satisfactory. If the reproduced MIDI data are determined to be satisfactory, the note density responsive process is terminated. On the other hand, if the reproduced MIDI data are determined to be unsatisfactory in terms of tempo setting, the process returns to the step A2 to again set the dynamic value $\alpha$, followed by repeating the processing from the step A3 to the step A7.

The MIDI data determining step A7 to the dynamic value setting step A2 can be automated by, for example, using a predetermined determination reference to automatically carry out the determination of the reproduced MIDI data and automatically increase or reduce the dynamic value a by a predetermined value so as to obtain satisfactory results. Further, the dynamic value $\alpha$ may be set to different values between the sections. Furthermore, both a method of setting the dynamic value $\alpha$ collectively for all the sections and a method of setting the value a separately for the individual sections may be used together. For example, with the dynamic value $\alpha$ initialized to 1, the present tempo change rule is applied to the entire music, and the resulting MIDI data with expressions applied are reproduced (step A6), followed by carrying out an edition of the MIDI data as follows: If the reproduced MIDI data are unsatisfactory and the process returns to the step A2, then for each section with excessive expressions, the dynamic value $\alpha$ is again set to a value less than "1" depending on the level of excessiveness. Conversely, for each section with insufficient expressions, the dynamic value $\alpha$ is again set to a value more than "1" depending on the level of insufficiency. These manners of edition may also be implemented if rules for tempo change/timing shift or the like according to Example (2) and subsequent examples are applied to apply performance parameter values to performance data.

In this case, the original performance data (MIDI data) OD are displayed on the display 14 and applied parameter values (the tempo change amount or the like) or their applied positions are displayed on the displayed performance data OD in an overlapping manner so that the user can check the results of parameter value settings. Further, during this checking, the user can designate positions that are not to be subjected to the parameter changing process.

When a plurality of performance parts (a rhythm/accompaniment, a melody, and others) are performed, the same tempo is generally used for all the parts. Accordingly, although in the above described note density responsive process in FIG. 5, a particular part for which the tempo is to be determined is selectively set at the step A1, a method of comprehensively evaluating information on the plurality of parts and determining the tempo according to the evaluated information can also be employed as described hereinbelow. By reproducing tempo change by shifting the time point of each note instead of changing tempo events, the tempo can be also set independently between the plurality of parts.

Figure 6:
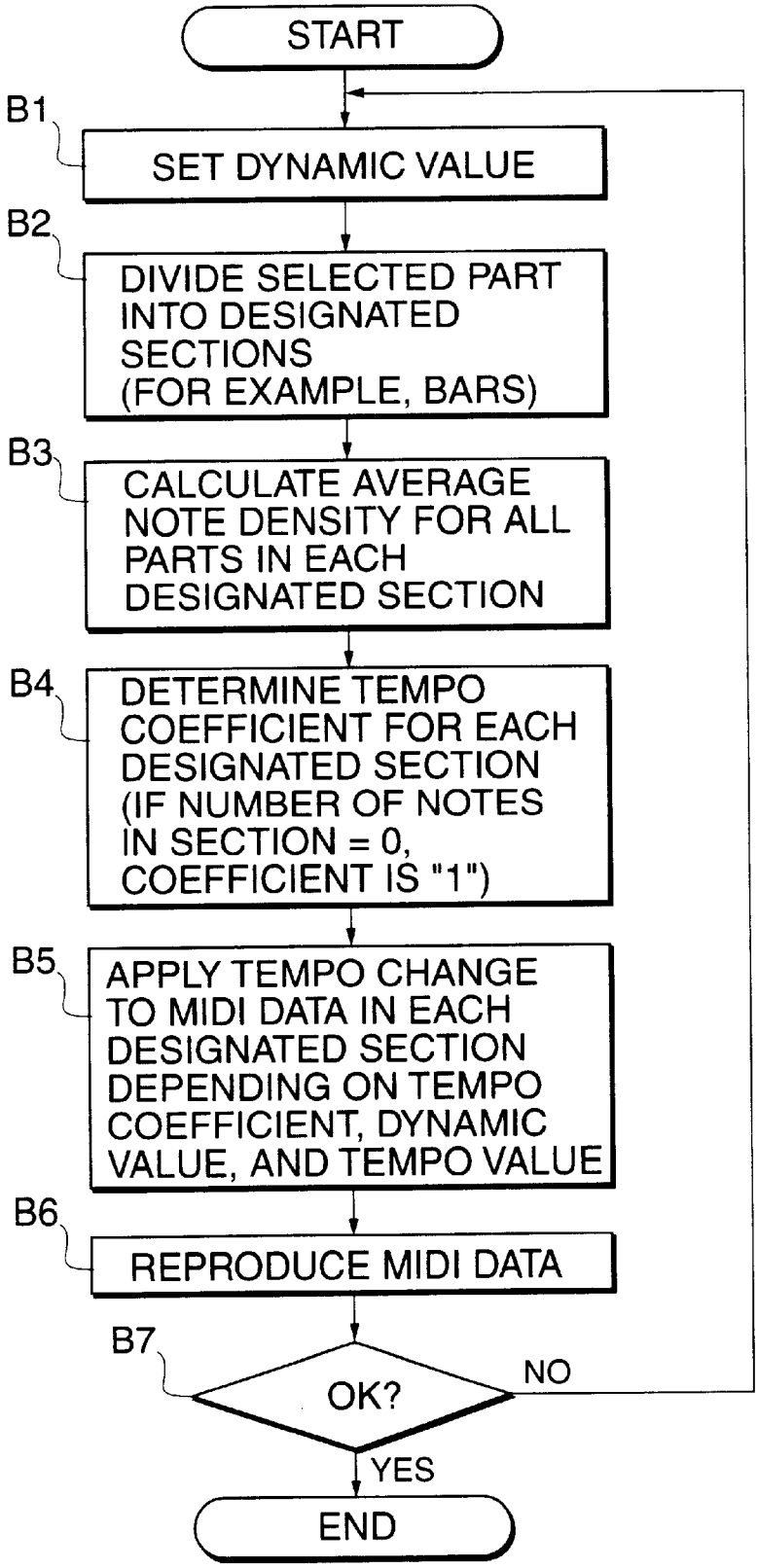
FIG. 6 is a flow chart showing another example of the note density responsive process according to Example (1) of the present invention.

FIG. 6 is a flow chart showing another example of the note density responsive process executed by the expression adding module EM to accelerate the tempo depending on the note density. This process is applied to determination of the tempo based on comprehensive evaluation of information on all the parts without selective designation of a part. In this process flow, at a first step B1, the dynamic value $\alpha$ is set for the tempo, and the process proceeds to a step B1. At the step B2, each part is divided into designated sections (corresponding, for example, to bars, respectively), and at the next step B3, an average note density for each designated section of all the parts is calculated. At a step B4, the tempo coefficient K for each designated section is determined from the calculated note density to evaluate the note density for each designated section. Of course, in the steps B2 and B4, the number of notes may be evaluated in terms of beats or tempo reference time (Tick) instead of bars, and the tempo coefficient K may be set to "1" for designated sections with no note.

Then, the process proceeds from the step B4 to a step B5, wherein a tempo change corresponding to the determined tempo coefficient K, dynamic value $\alpha$, and current tempo value is applied to the MIDI data in each designated section, and the MIDI data are reproduced at the next step B6. Subsequently, if the reproduced MIDI data are determined to be satisfactory at a step B7, the note density responsive process is terminated, and if the data are unsatisfactory, the process returns to the step B1 to repeat the processing from the step B1 to the step B7.

(2) "Set Identical or Similar Tempo Expression for Similar Phrases"

If a tempo expression for applying a slight or fine tempo change to a certain phrase has been set and an identical or similar phrase is reproduced at a different location, then according to this tempo change rule, good expressions can be applied by copying the first tempo expression (the slight tempo change) as it is or setting a similar but slightly different tempo expression. If the second phrase is not exactly the same as the first phrase but is similar thereto, a tempo expression similar (slightly different) to the first one is preferably set. Further, the tempo for the entire phrase is changed between the first and second times in accordance with Example (8).

Figure 7:
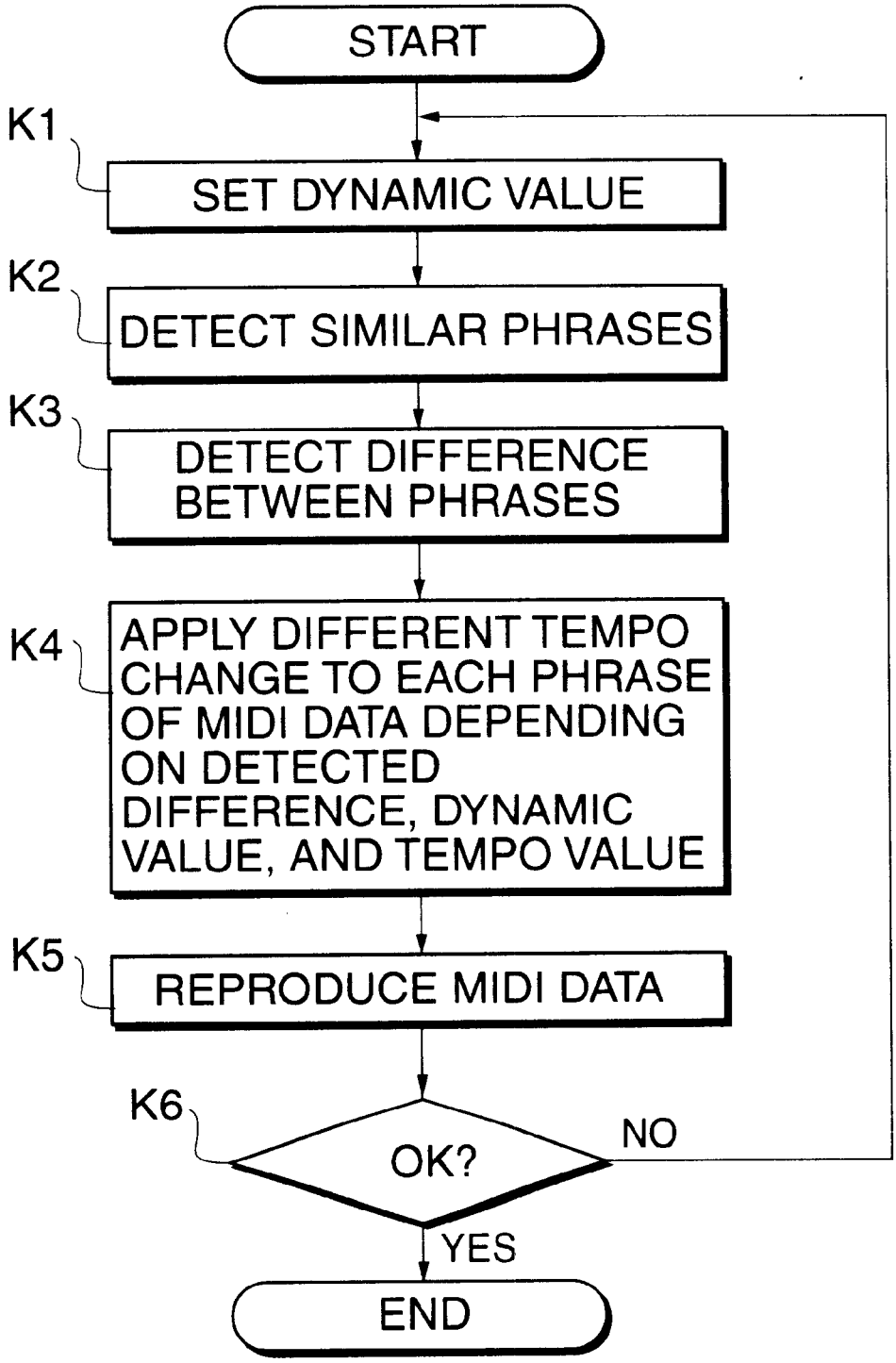
FIG. 7 is a flow chart showing a process for applying identical/similar tempo expressions to identical/similar phrases according to Example (2) of the present invention.

FIG. 7 is a flow chart showing an example of a process executed by the expression adding module EM according to an example of the present invention, to set a similar tempo expression for similar phrases. In this process flow, at a first step K1, the dynamic value $\alpha$ for the tempo is set, then at a step K2, similar phrases are detected, and at the next step K3, a difference between the similar phrases is detected. That is, at the steps K2 and K3, the original MIDI data are sequentially interpreted in terms of phrases, the interpreted phrases are sequentially stored, and a newly interpreted phrase is compared with already stored phrases to determine similarity therebetween. If some phrases are determined to be similar to each other, then a difference between them is determined.

At the next step K4, a different tempo change corresponding to the detected difference, the currently set dynamic value $\alpha$, and the current tempo value is applied to each detected phrase of the MIDI data, and the process then proceeds to a step K5 to reproduce the MIDI data. If the reproduced MIDI data are determined to be satisfactory or good at a step K6, the process for setting a similar tempo expression for similar phrases is terminated, and if the data are unsatisfactory, the process returns to the step K1 to repeat the processing from the step K1 to the step K6.

(3) "Set Tempo for Registered Figure"

Figure 8A:
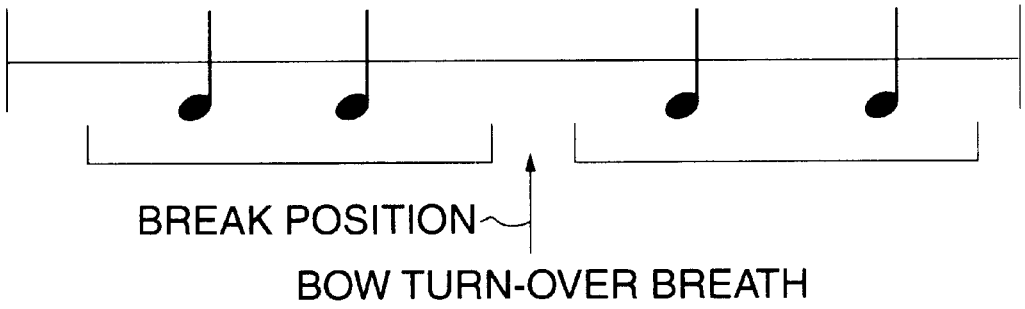
FIGS. 8A to 8C are views showing examples of a phrase template according to Example (3) of the present invention.
Figure 8B:
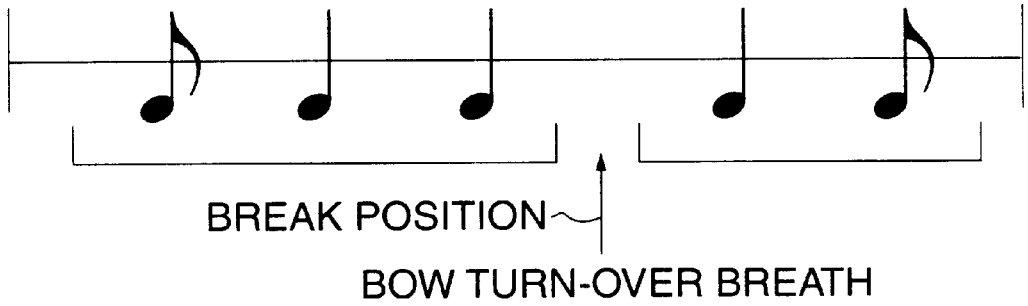
Figure 8C:
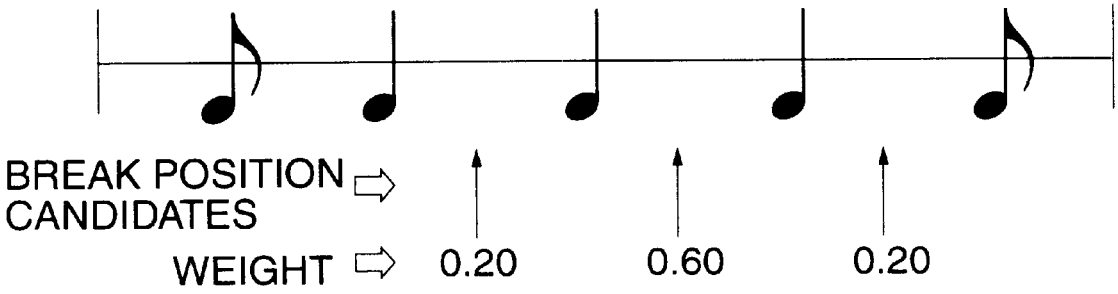

With this tempo expression method, when a previously registered figure (for example, rhythm pattern) appears, a predetermined tempo is set for this portion. This method is similar to a method (9) but is employed because identical phrases can be properly identified by previously registering figures or the like as phrase templates and comparing figures from the MIDI data with the previously registered ones. FIGS. 8A to 8C show examples of phrase templates. As illustrated in FIGS. 8A and 8B, a break (↑) exists at a position corresponding to a turn-over of the bow of the violin or to a breath for a wind instrument. As shown in FIG. 8C, however, if there are a plurality of break position candidates (↑), the candidates may be weighted before one of them is randomly selected.

Figure 9:
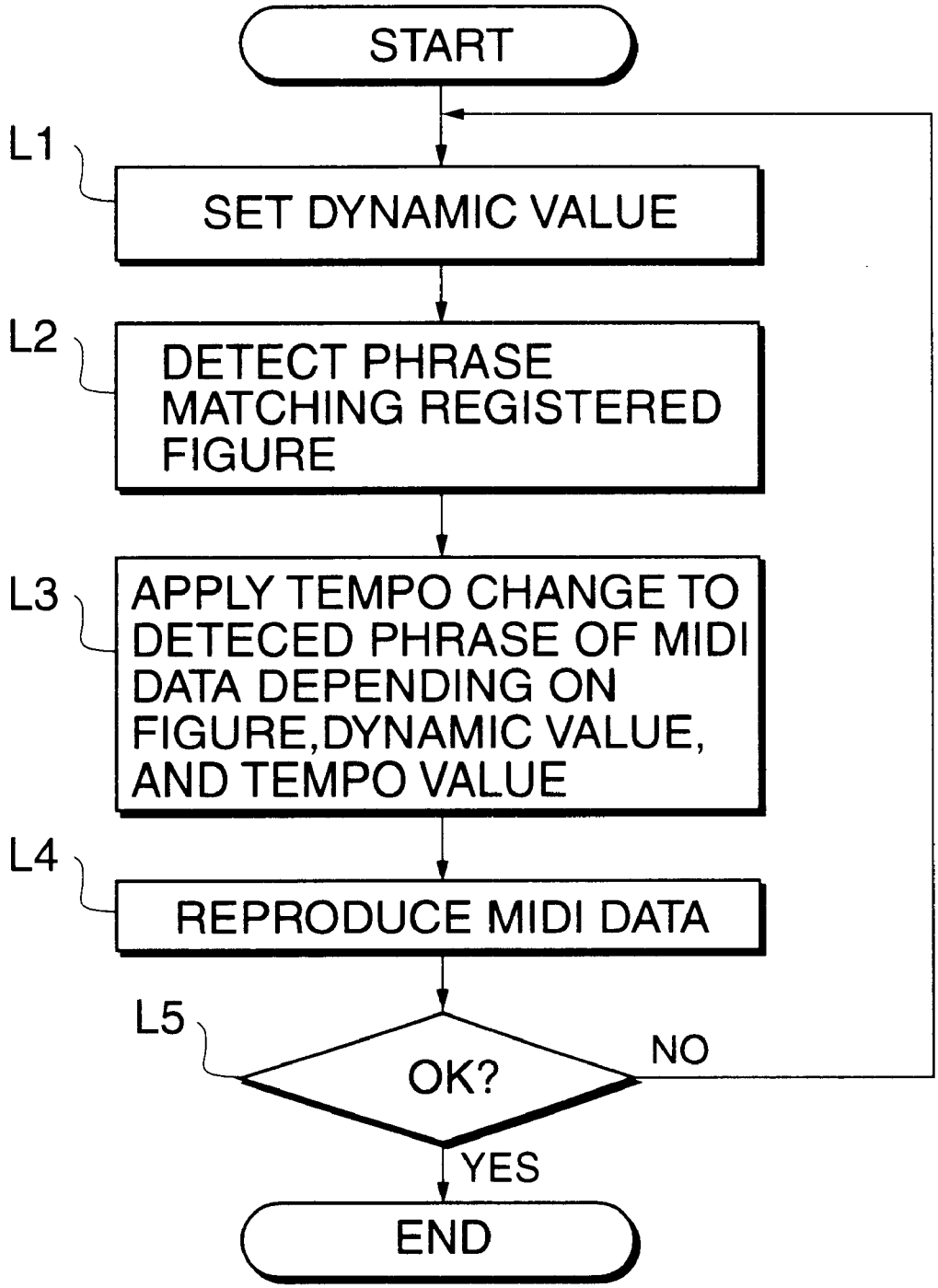
FIG. 9 is a flow chart showing a process using a registered figure according to Example (3) of the present invention.

FIG. 9 is a flow chart showing an example of a process executed by the expression adding module EM according to an example of the present invention to set a predetermined tempo for a registered figure. In the process flow, at a first step L1, the dynamic value $\alpha$ for the tempo is set, at a step L2, a phrase matching a registered figure is detected, and at the next step L3, a predetermined tempo change corresponding to the registered figure, the dynamic value $\alpha$, and the current tempo value is applied to the detected phrase of the MIDI data. Then, the process proceeds to a step L4 to reproduce the MIDI data. If the reproduced MDI data are determined to be satisfactory or good at a step L5, the registered-figure application process is terminated, and if the data are unsatisfactory, the process returns to the step L1 to repeat the processing from the step L1 to the step L5.

Alternatively, the tempo may be properly evaluated by referring to registered expression events or other types of events instead of using only the figures as phrase templates. For example, if an expression event corresponding to a turn-over of the bow of the violin is generated, realistic expressions are obtained but the tempo is likely to become out of order at the very moment of the turn-over; that is, the tempo becomes too slow resulting in a long interval. In order to automatically add this situation, a tempo change can be synchronized with an expression event for reproducing a bow turn-over (for example, the volume declines a moment because the bow stops a moment) to achieve a more realistic performance. Likewise, for wind instruments, an expression event for expressing a breath feeling (that is, the volume declines a moment because of the breath) may be used but also unavoidably results in a long interval before and after the breath. Consequently, a tempo change for expressing this situation may be used.

According to a variation of this example, the process using the registered figures (templates) described with reference to FIGS. 8A to 8C and FIG. 9 can be similarly applied to the interval parameter to set predetermined changes in interval based on comparisons between performance data (MIDI data) and registered phrase templates. In this case, to identify the same or identical phrase, a figure may be registered as a template as in the case of the tempo. Instead of using the figure as a reference, other events such as registered expression events may be referred to to evaluate the interval.

For example, when an expression event corresponding to a turn-over of the bow of the violin is generated, realistic expressions can be generated but the pressure of the bow becomes irregular at the very moment of the turn-over to change the interval. In order to automatically add this situation, a tempo change can be synchronized with an expression event for reproducing a bow turn-over to reproduce a more realistic performance.

For wind instruments, the breath feeling may be expressed using an expression event, but again, the interval changes due to a change in playing pressure.

Portamento times may be registered in terms of phrases or event trains for automatic setting, providing effective results. It is also effective to automatically set interval changes or portamento times by selecting tone colors without depending on phrases or event trains.

According to a variation of this example, as another example of changing a method of expressing the interval depending on the instrument, a method of processing a slur is changed depending on the instrument type. As illustrated hereinbelow, even if the same slur symbol is designated, the reproduction method should desirably be changed depending on the instrument type.

Figure 10:
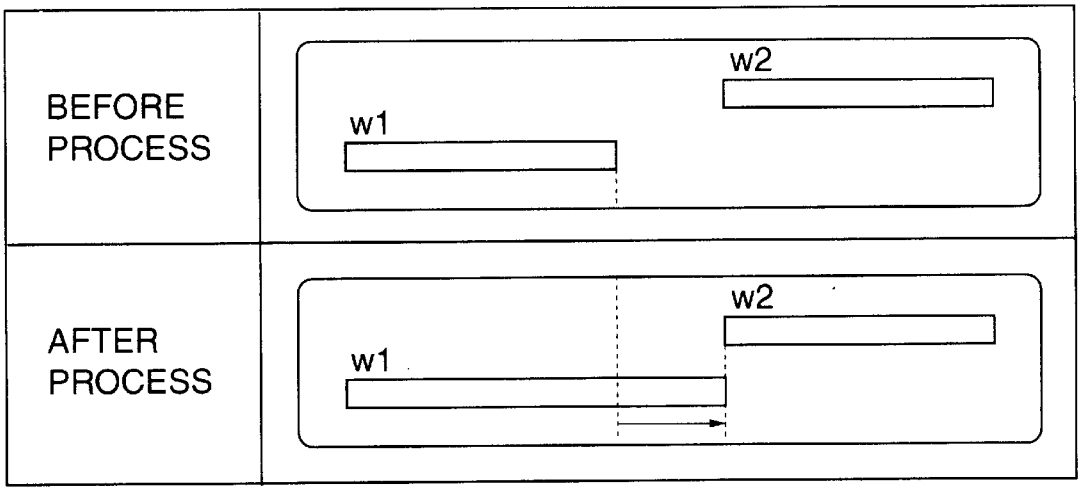
FIG. 10 is a view useful in explaining a slur process for a keyboard instrument according to an example of the present invention.

For keyboard instruments such as piano, if two continuous tones w1, w2 are slurred as shown in an upper half of FIG. 10, then for example, a slur process such as one shown in a lower half of FIG. 10 is executed because the continuous tones may temporally overlap each other and because the reproduced sound should be preferably as long as possible.

Figure 11:
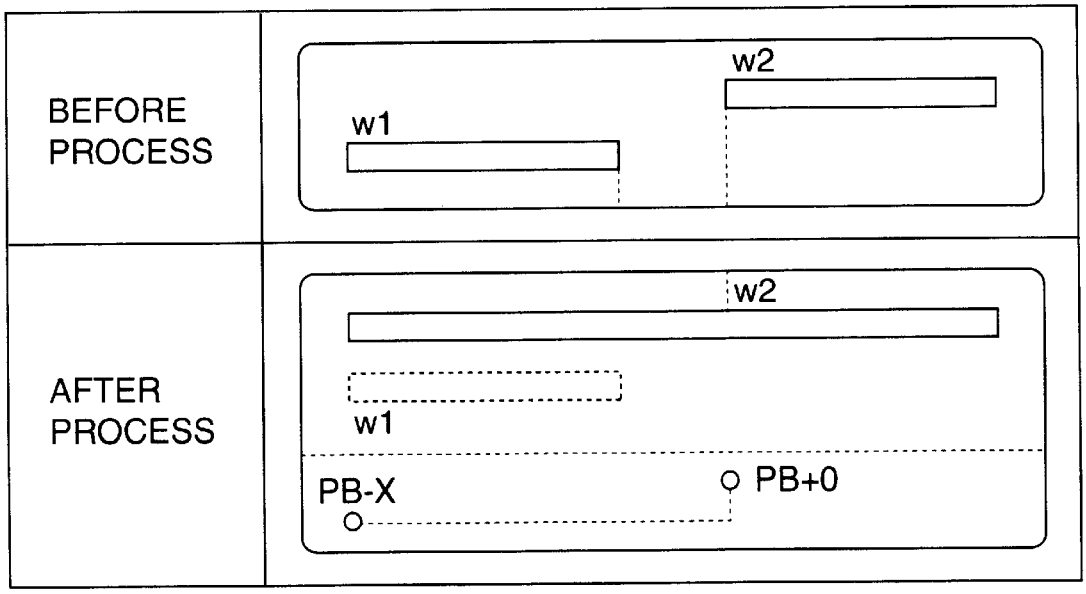
FIG. 11 is a view useful in explaining a slur process for a wind instrument according to an example of the present invention.

On the other hand, for wind instruments such as clarinet and trumpet, it is unnatural that continuous tones in a slur temporally overlap each other and the trailing one of the continuous tones preferably has a small attack tone. To achieve this, performance data such as MIDI data are preferably subjected to the following process: Two continuous tones w1, w2 in an upper half of FIG. 11 are generated as one long note, as shown in a lower half of FIG. 11, and this note has its interval changed in the middle thereof using data such as a pitch bend event.

(4) "Set Tempo Coefficient Depending on Piano Sustain Pedal Operation"

For the piano, applying the sustain pedal results in a rich tone, but in this case, a quick play results in degraded separation of the tones, so that the tempo shows a tendency to be slightly decelerated. Thus, according to this tempo change rule, a predetermined tempo coefficient is set depending on a piano sustain pedal operation. For this purpose, whether the sustain pedal is stepped on or not may be detected by a pitch bend detecting section.

Figure 12:
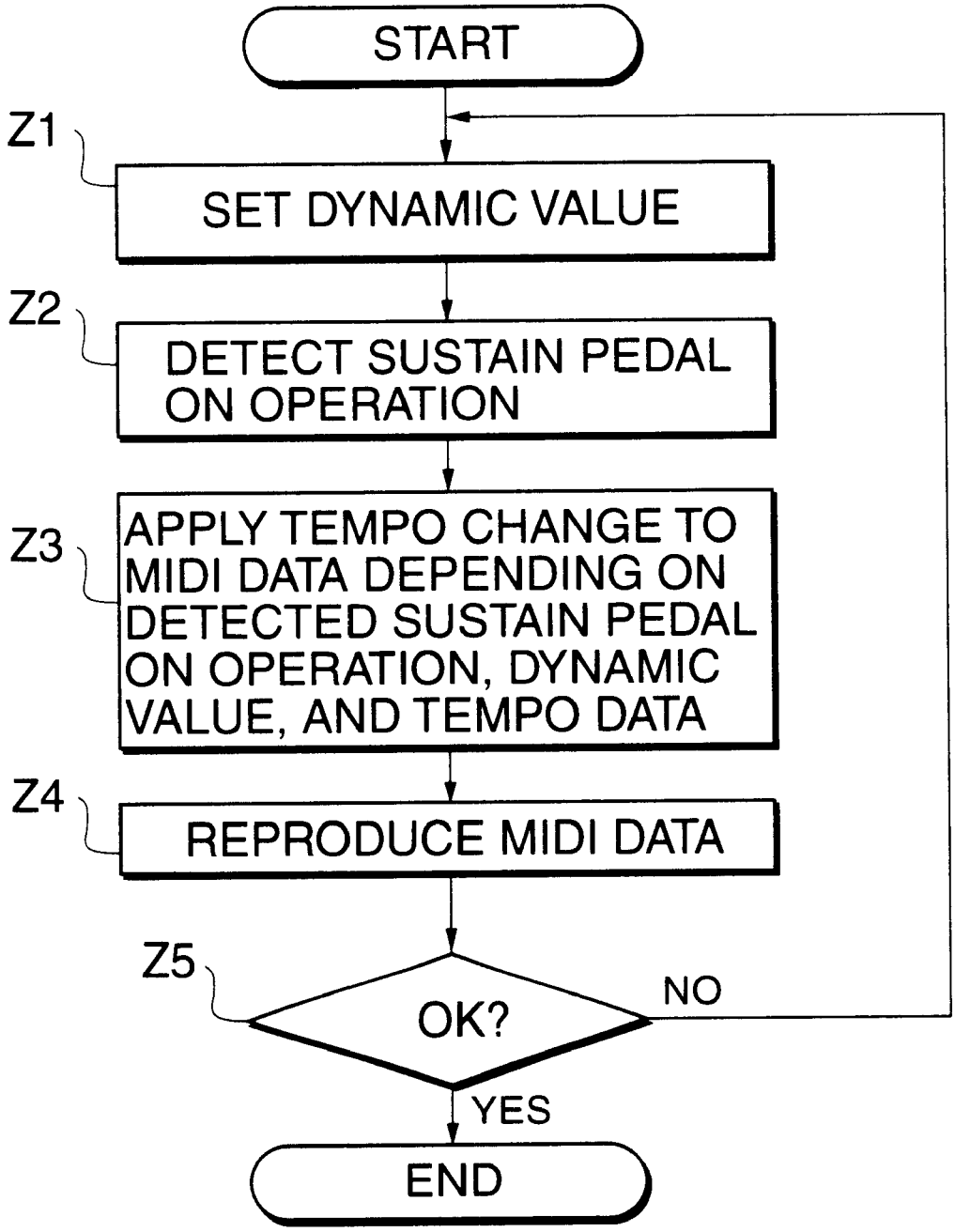
FIG. 12 is a flow chart showing a process responsive to a piano sustain pedal operation according to Example (4) off the present invention.

FIG. 12 is a flow chart showing a process executed by the expression adding module EM to set the tempo coefficient depending on the piano sustain pedal operation according to an example of the present invention. At a first step Z1 of this process flow, the dynamic value α is set, and at a step Z2, whether the sustain pedal is stepped on or not is detected. At the next step Z3, a tempo change is calculated depending on the detected stepping-on of the sustain pedal, the dynamic value α, and tempo data and the calculated tempo change is applied to the MIDI data. Then, at a step Z4, the MIDI data are reproduced, and if the reproduced MIDI data are determined to be satisfactory or good at the next step Z5, the sustain pedal responsive process is terminated, and if the reproduced data are unsatisfactory, the process returns to the step Z1 to repeat the processing from the step Z1 to the step Z5.

(5) "For Strings Trill, Use a Plurality of Parts and Slightly Shift Timing"

Figure 13A:
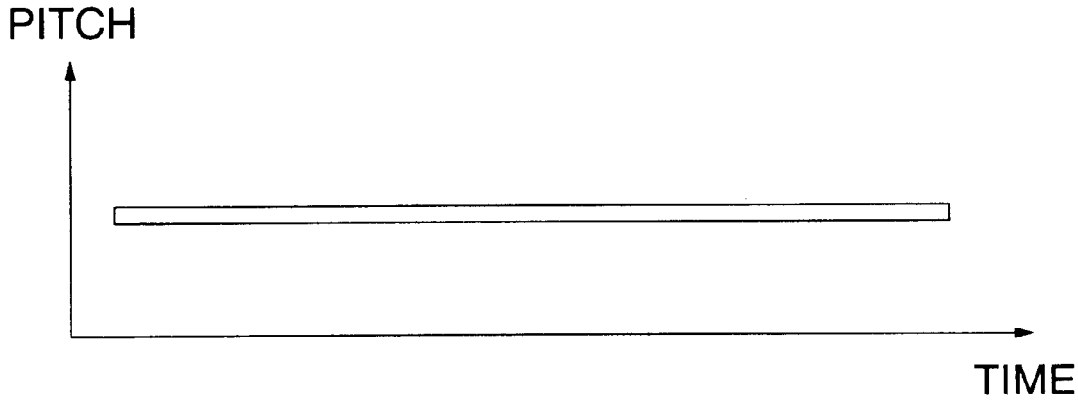
FIGS. 13A and 13B are charts showing an example in which a strings trill is reproduced according to Example (5) of the present invention.
Figure 13B:
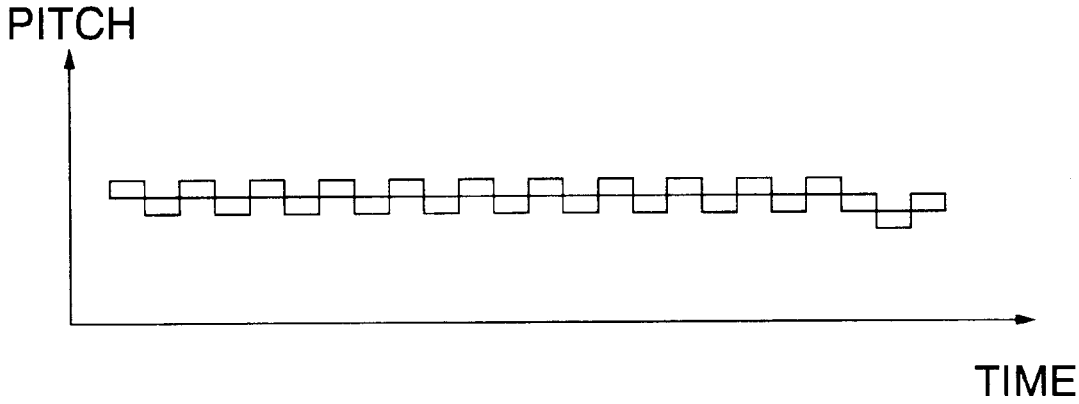

In general, trill of strings or the like is realized by decomposing one long note into a plurality of short notes, for example, by converting "a score note" shown in FIG. 13A into "a performance score" shown in FIG. 13B. An actual strings part, however, is played by a plurality of players, and it is actually not likely that all the players play very short notes of a trill with the same timing because strict synchronization of the strings trill causes unnatural sound. Thus, according to this timing change rule, a plurality of parts are used and timing is slightly shifted between these parts. That is, to avoid such a synchronous performance and reproduce a natural play with the strings of the MIDI tone generator, a plurality of parts are used and trill timing is slightly shifted between these parts to obtain effective results.

The plurality of parts have preferably different tone colors (for example, the violin and the viola). Further, to slightly shift the trill timing, a random number is preferably used to change on-time or duration of very short notes of the trill, to provide effective results.

Figure 14:
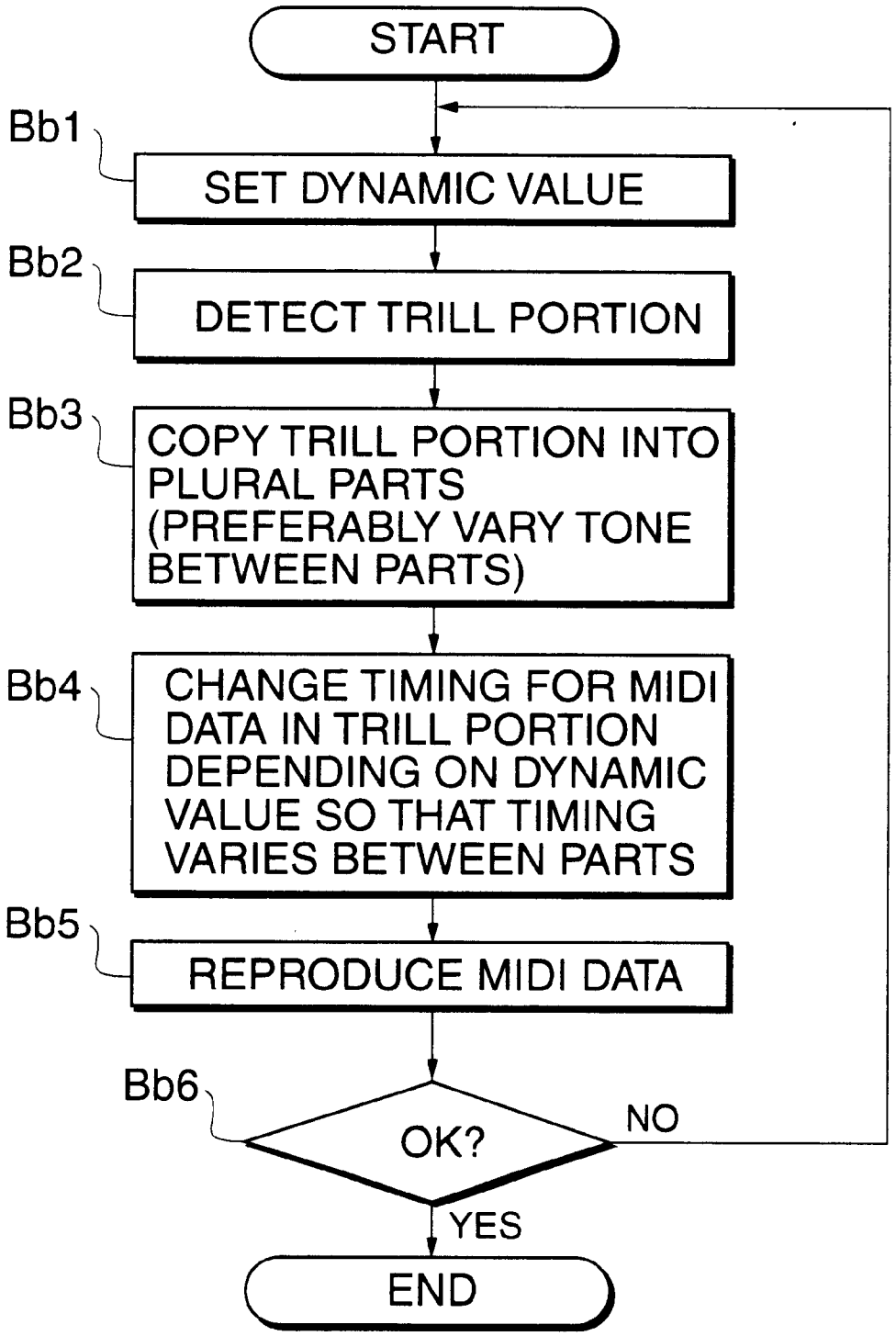
FIG. 14 is a flow chart showing a process for reproducing a strings trill using a plurality of parts according to Example (5) of the present invention.

FIG. 14 is a flow chart showing an example of a process executed by the expression adding module EM to provide a plurality of parts and shift timing between these parts depending on a strings trill according to an example of the present invention. At a first step Bb1 of this process flow, the dynamic value α is set, at a step Bb2, a trill portion is detected, and at the next step Bb3, the trill portion is copied into a plurality of parts. In this case, each part is preferably assigned with a slightly different tone color. Subsequently, at a step Bb4, timing for the MIDI data in the trill portion is changed so as to vary between the parts depending on the dynamic value α. At a step Bb5, the MIDI data are reproduced. If the reproduced MIDI data are determined to be satisfactory or good at the next step Bb6, the strings trill timing process is terminated, and if the reproduced data are unsatisfactory, the process returns to the step Bb1 to repeat the processing from the step Bb1 to the step Bb6.

Figure 43:
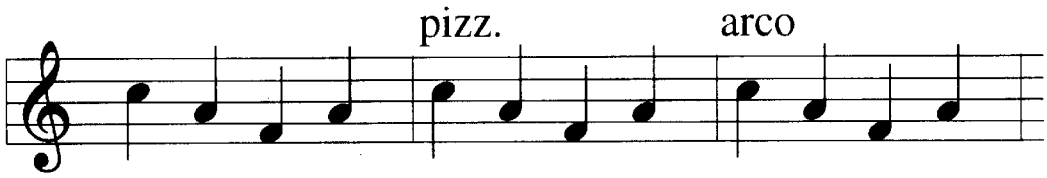
FIG. 43 is a view showing an example of switching between "arco" and "pizz." according to Example (c) of the present invention.

According to a variation of this example, the method of processing trill using a plurality of parts as described with reference to FIGS. 13A, 13B, and 14 can be applied to changing of the interval parameter. That is, since strict synchronization of a strings trill causes unnatural sound, the trill is divided into a plurality of parts and expressions are added so as to slightly shift the interval between these parts. To reproduce this with the strings of the MIDI tone generator, at the step Bb1, the dynamic value α is set for a musical-interval shift width, at the steps Bb2 and Bb3, processing similar to that in FIG. 43 is carried out to decompose (divide) the trill into a plurality of parts, and at the step Bb4, the interval of the trill is slightly shifted between the parts obtained by the decomposition, thereby obtaining effective results. In this case, the parameters to be shifted preferably include not only the interval not also the timing.

(6) "Set Tempo Using Learning Function"

This tempo applying method comprises using a learning function for tempo settings to configure a system for automatically predicting the relationship between pitch change and tempo change, thereby enabling the user to automatically construct a tempo change rule. By way of example, tempo change is manually input up to the middle of music and the learning function is then used to automatically input the remaining part of the tempo change in this case, when the remaining music data are input, the data are interpreted in terms of phrases and these phrases are compared with already processed ones so that the same phrase is provided with the same tempo change as the corresponding processed phrase while a new phrase is provided with a random tempo change. As another example, tempo changes in a certain music are analyzed, another music is interpreted and compared with the tempo-analyzed music, and a corresponding analyzed tempo change is applied to the other music depending on results of the comparison.

Figure 15A:
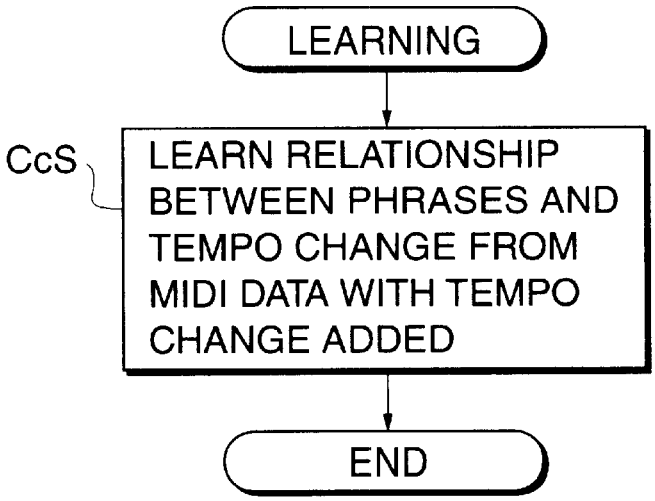
FIGS. 15A and 15B are flow charts showing a process based on a learning function according to Example (6) of the present invention.
Figure 15B:
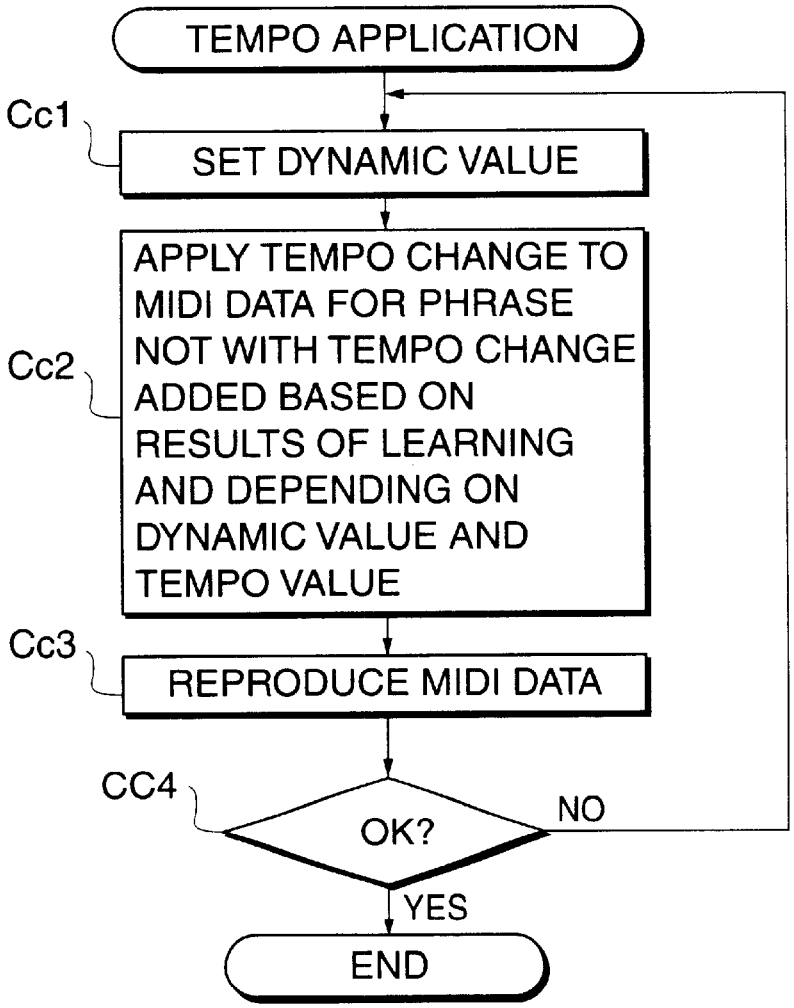

FIGS. 15A and 15B are flow charts showing an example of a process based on the learning function of the expression adding module E according to an example of the present invention. In this process, a learning routine CcS learns the relationship between phrases and tempo change from MIDI data already with tempo change added and stores results of the learning in a predetermined area of the RAM 3.

Next, in changing the tempo, at a step Sc1, the dynamic value $\alpha$ is set, and at a step Cc2, a tempo change corresponding to the dynamic value $\alpha$ and the current tempo value is applied to MIDI data for a phrase to which no tempo change is imparted, based on results of the learning. Then, at a step Cc3, the MIDI data are reproduced. If the reproduced MIDI data are determined to be satisfactory or good at the next step Cc4, the learning-based tempo application process is terminated, and if the reproduced data are unsatisfactory, the process returns to the step Cc1 to repeat the processing from the step Cc1 to the step Cc4.

(7) "Set Tempo Change Using Library"

By cutting out tempo changes generated correspondingly to various characteristic information of performance data for a certain section of time and registering them as a library, the registered tempo changes may be similarly applied to other portions of the performance data. This tempo applying method provides an easy-to-use tempo change method by storing tempo changes corresponding to characteristic information, in the library. The library can be more easily used by saving it with a name. Further, the library or registered tempo changes are preferably stored in terms of relative tempo values or can preferably be elongated or shortened in a time change direction or a tempo value change direction.

Figure 16A:
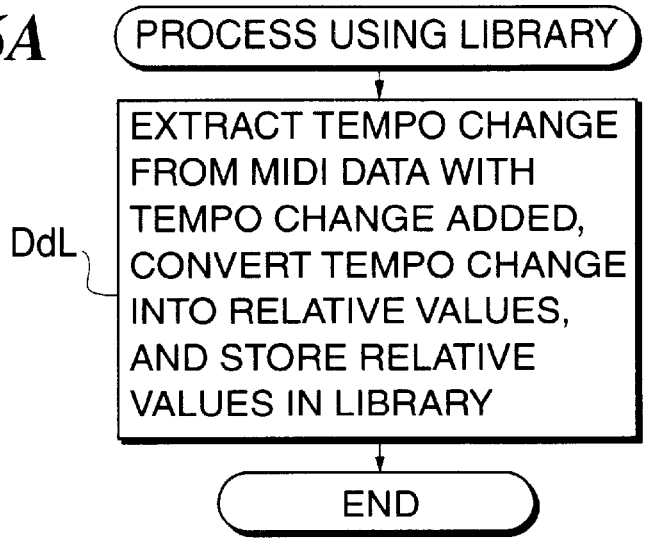
FIGS. 16A and 16B are flow charts showing a process based on a library according to Example (7) of the present invention.
Figure 16B:
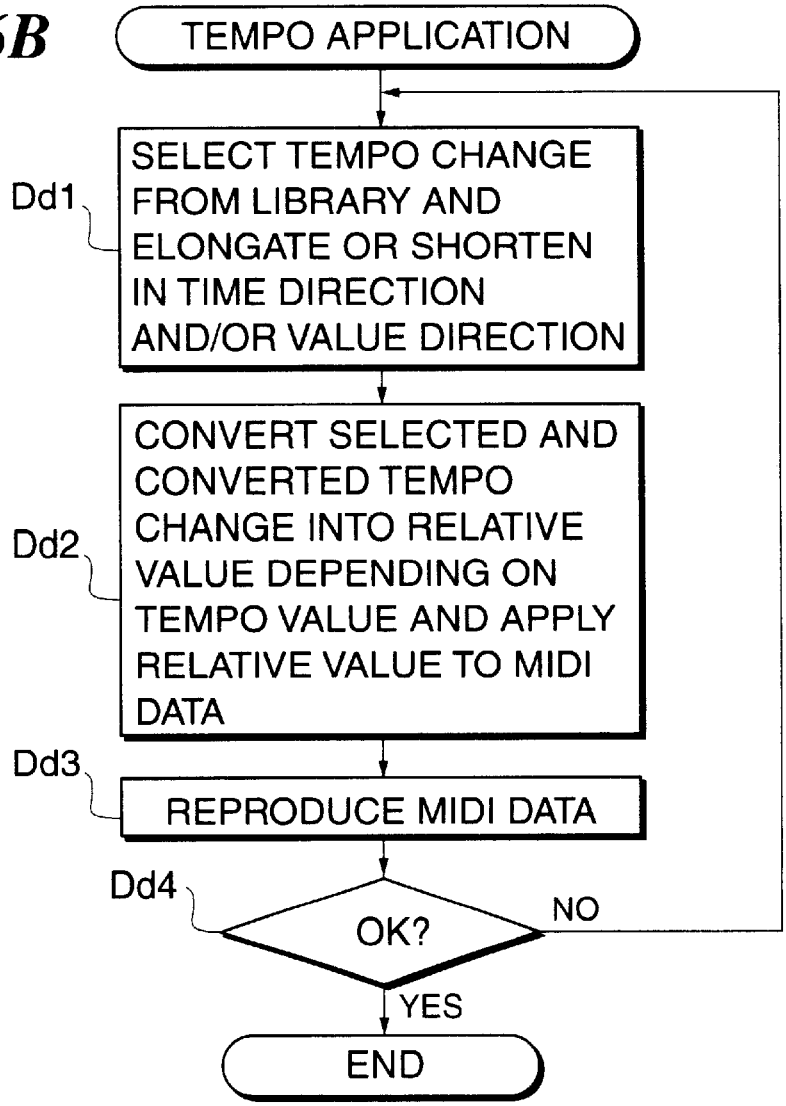

FIGS. 16A and 16B are flow charts showing an example of a process executed by the expression adding module EM to set tempo change using a library according to an example of the present invention. In this process, a library routine DdL extracts a tempo change from MIDI data already with tempo change added, converts the extracted tempo change into a relative value, and saves this value in a predetermined area of the external storage device 9 as a library.

Next, in changing the tempo, at a step Dd1, a tempo change corresponding to predetermined characteristic information from the MIDI data is selected from the library, and the selected tempo change is elongated or shortened in a time direction and/or in a tempo value direction using a predetermined multiplying factor $\alpha$. At the next step Dd2, the selected and elongated or shortened tempo change is converted into an absolute value depending on the current tempo value, and the converted tempo change is applied to the MIDI data. Then, at a step Dd3, the MIDI data are reproduced. If the reproduced MIDI data are determined to be satisfactory or good at the next step Dd4, the library-based tempo application process is terminated, and if the reproduced data are unsatisfactory, the process returns to the step Dd1 to change the multiplying factor a or select another tempo change to repeat the processing from the step Dd1 to the step Dd4.

According to a variation of this example, the library-based process method described with reference to FIGS. 16A and 16B can be applied to changing of the interval parameter in such a manner that interval changes are registered in a library. That is, by cutting out generated interval changes for a certain time section and registering them as a library, these registered interval changes may be similarly applied to other portions. In this case, of course, the library can also be more easily used by saving it with a name.

(8) "Set Tempo Coefficient Depending on Lyrics"

In music with a song, the tempo feeling may vary depending on the lyrics even with the same melody. Thus, this tempo change method comprises setting the tempo coefficient depending on the lyrics using a procedure of previously registering a certain word with a tempo coefficient value and changing the tempo when that word appears. In previously registering tempo coefficient values, coefficient values corresponding to the level of advancement or retardation of the tempo are registered by setting a quick tempo for happy words while setting a slow tempo for gloomy and important words. Further, an object for which a tempo change is set may be designated in such a manner that, for example, only words are subjected to a tempo change or the entire section including a particular word is subjected to a tempo change.

Figure 17:
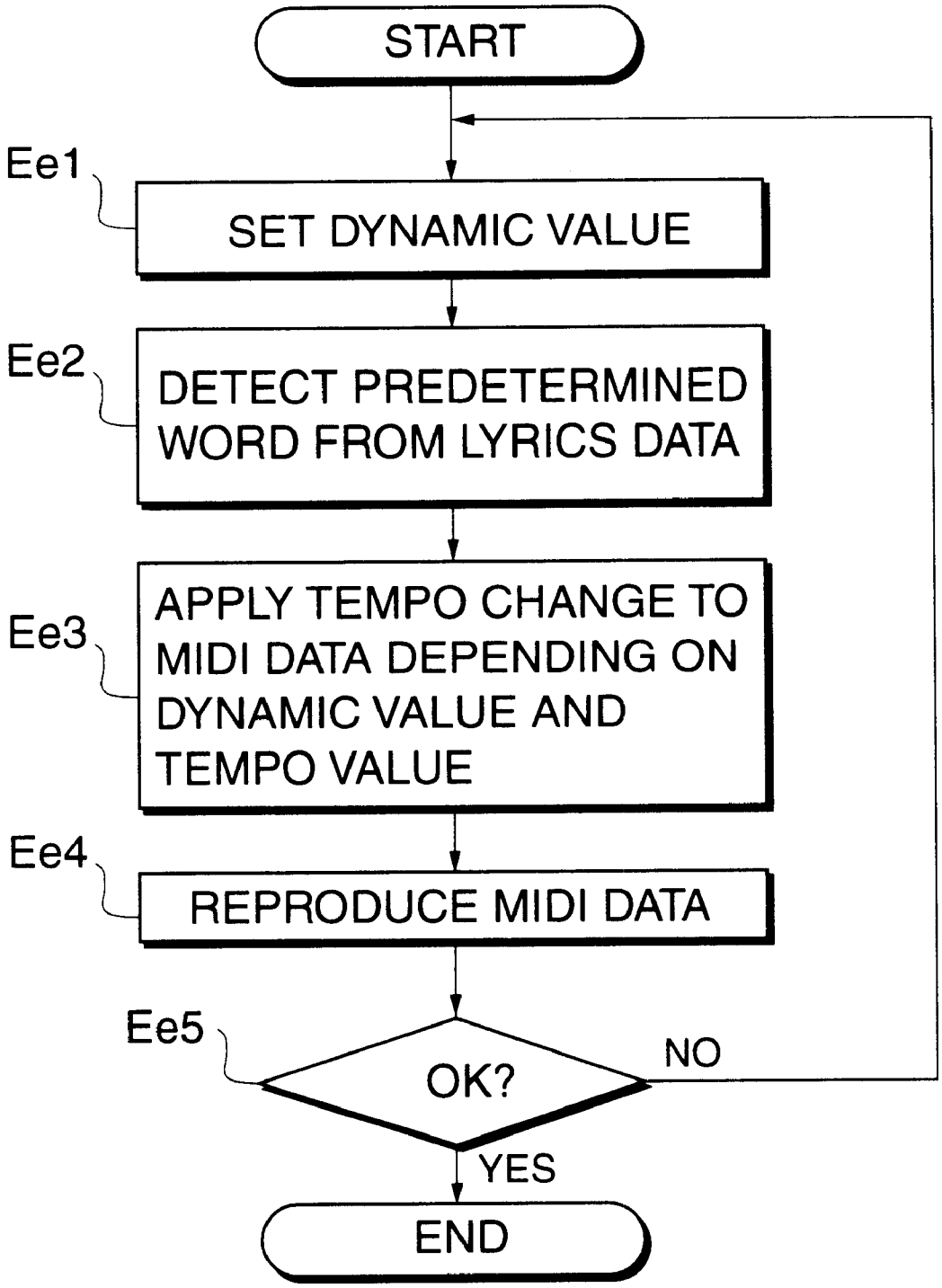
FIG. 17 is a flow chart showing a process based on lyrics according to Example (8) of the present invention.

FIG. 17 is a flow chart showing a process executed by the expression adding module EM to set tempo coefficient values depending on lyrics according to an example of the present invention. In this process, at a first step Ee1, the dynamic value $\alpha$ is set, and at a step Ee2, a predetermined word is detected from lyrics data of the original MIDI data OD. At the next step Ee3, a tempo change corresponding to a tempo coefficient value set correspondingly to the detected word, the set dynamic value $\alpha$, and the current tempo value is applied to the MIDI data. Then, at a step Ee4, the MIDI data are reproduced. If the reproduced MIDI data are determined to be satisfactory or good at the next step Ee5, the lyrics responsive process is terminated, and if the reproduced data are unsatisfactory, the process returns to the step Ee1 to repeat the processing from the step Ee1 to the step Ee5.

(9) "Elongate Tone Immediately Before Staccato"

When a tone immediately before a staccato is somewhat elongated, the staccato sounds sharp. According to this tempo change rule, tempo change for tones with staccatos is controlled.

Figure 18:
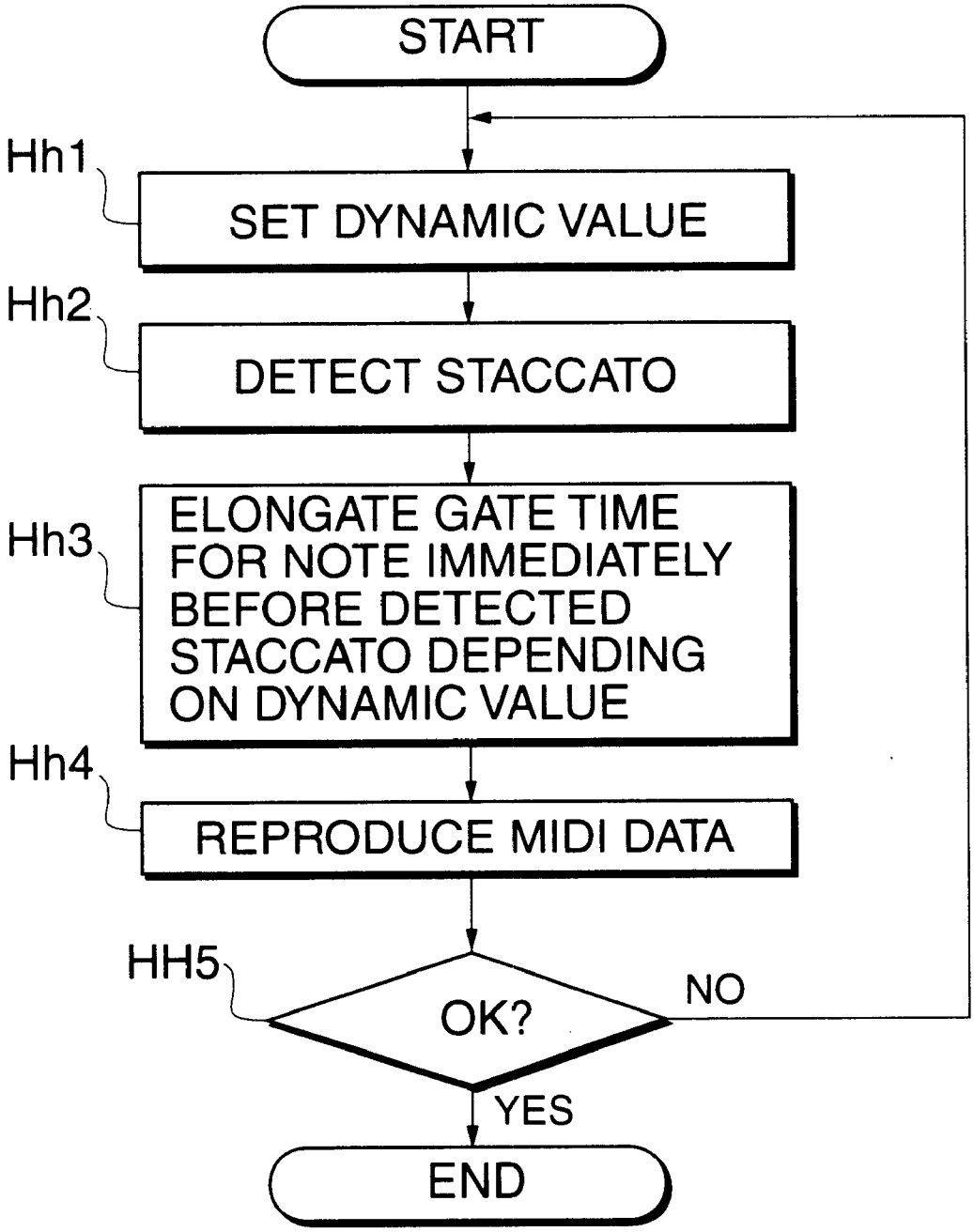
FIG. 18 is a flow chart showing a process responsive to staccato according to Example (9) of the present invention.

FIG. 18 is a flow chart showing an example of a process responsive to staccato executed by the expression adding module EM according to an example of the present invention. In this process, at a first step Hh1, the dynamic value $\alpha$ is set, and at a step Hh2, a staccato is detected from the original MIDI data OD. At the next step Hh3, the gate time of a note immediately before the detected staccato is elongated depending on the dynamic value $\alpha$. Then, at a step Hh4, the MIDI data subjected to the elongation process are reproduced. If the reproduced MIDI data are determined to be satisfactory or good at the next step Hh5, the staccato responsive process is terminated, and if the reproduced data are unsatisfactory, the process returns to the step Hh1 to repeat the processing from the step Hh1 to the step Hh5.

(10) "Determine Tempo with Respect to Entire Music"

As described described, there are various factors for changing the tempo. After various tempo changes have been applied throughout music, some tempos may be significantly different from what they were before the change. To cope with such a situation, this tempo determining method comprises checking results of tempo change throughout the music and generally correcting the tempo so that the average of the results equals an originally set tempo value (the averaging method is arbitrarily selected as required). The general tempo correction comprises correcting the tempo of the entire music to a uniform value, or instead of the general and uniform correction, preferentially correcting the tempo in sections where the tempo is frequently changed. A tolerance may be previously selected or selected by the user such that the tempo is not corrected if the difference between the original tempo and the average tempo is within a predetermined range.

Figure 19:
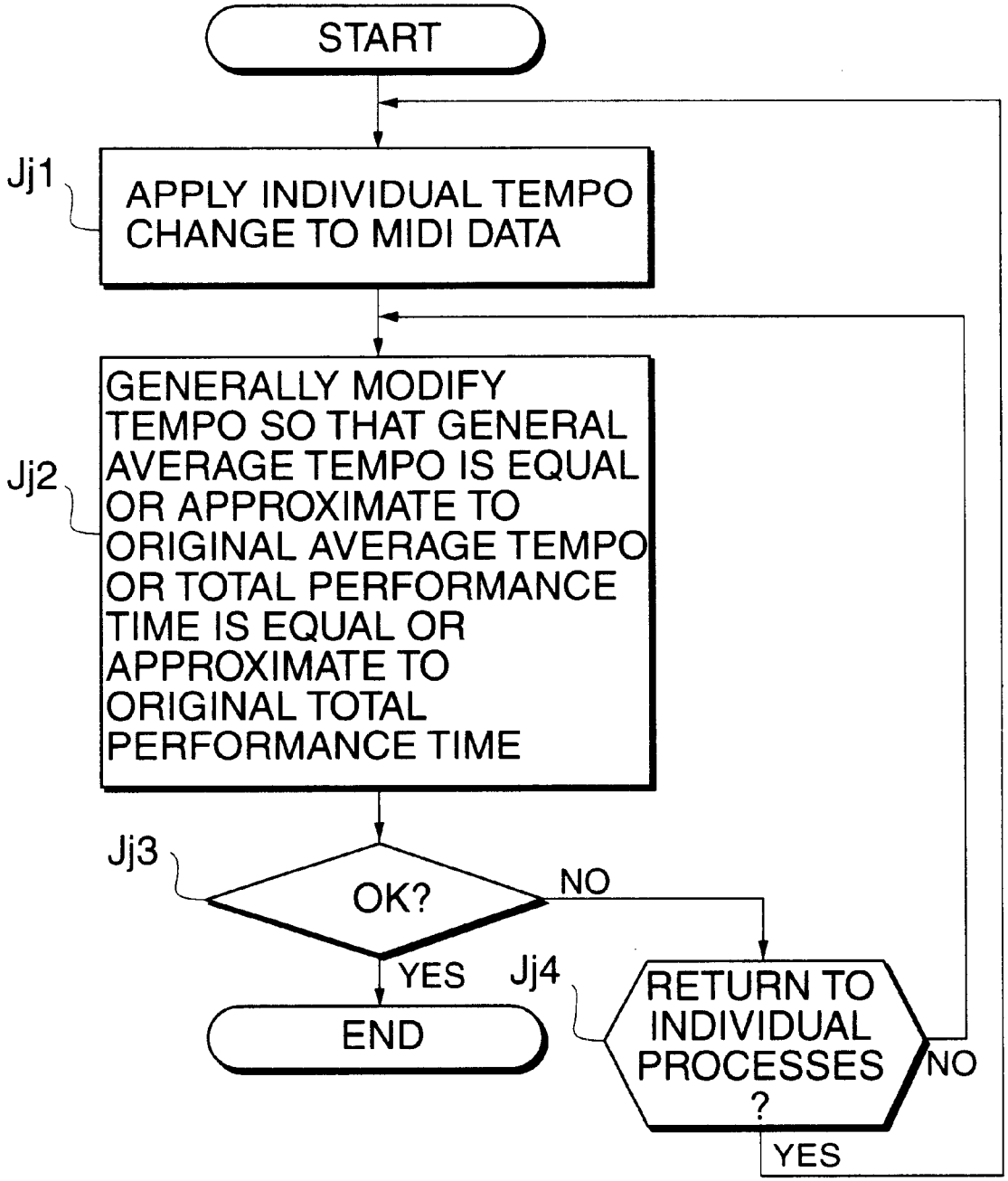
FIG. 19 is a flow chart showing a comprehensive review process according to Example (10) of the present invention.

FIG. 19 is a flow chart showing an example of an entire review process executed by the expression adding module EM according to an example of the present invention. At a first step Jj1 of this process, individual tempo changes are applied to the original MIDI data OD based on a predetermined rule selected as required from the above described tempo change rules (1) to (30). At a step Jj2, the tempo is generally modified so that the general tempo of the MIDI data with individual tempo changes added is equal or approximate to the original average tempo or the total playing time is equal or approximate to an original one.

Then, the process proceeds to a step Jj3, wherein an automatic calculation, reproduction and audition of the entire music, composed of the MIDI data, or the like is executed to check whether a desired tempo or total playing time has been obtained. If the data are determined to be satisfactory or good, the entire review process is terminated. On the other hand, if the data are determined to be unsatisfactory, the process proceeds to a step Jj4 to check whether or not to execute an individual tempo change process. If the individual tempo change process is determined to be necessary (YES), the process returns to the step Jj1 to execute the processing at the steps Jj1 and Jj2, and otherwise (NO), the processing at the step Jj2 is executed again.

According to a variation of this example, the entire review process method described with reference to FIG. 19 can be applied to changing of the interval parameter in such a manner that the interval can be adjusted again with respect to the entire music. If expressions are added using various intervals, the entire music may finally have its interval shifted by a certain value (for example, due to pitch bend data). In this case, it is sometimes preferable to review the entire music and then make adjustments using other parameters such as master tuning, pitch shift, and fine tuning.

EMBODIMENT 2

Figure 20:
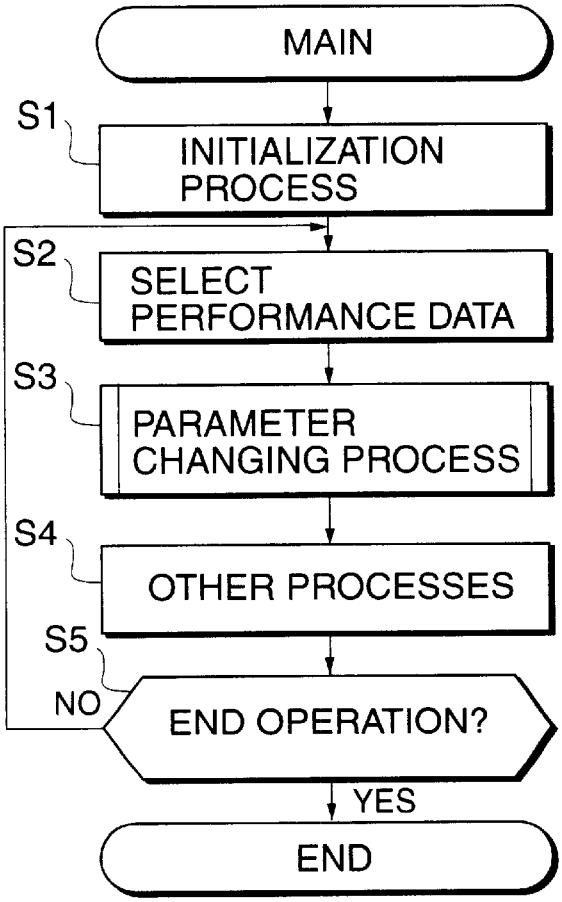
FIG. 20 is a flow chart showing a procedure of a main routine executed by an automatic parameter editing apparatus in FIG. 1, particularly by a CPU thereof.
Figure 21:
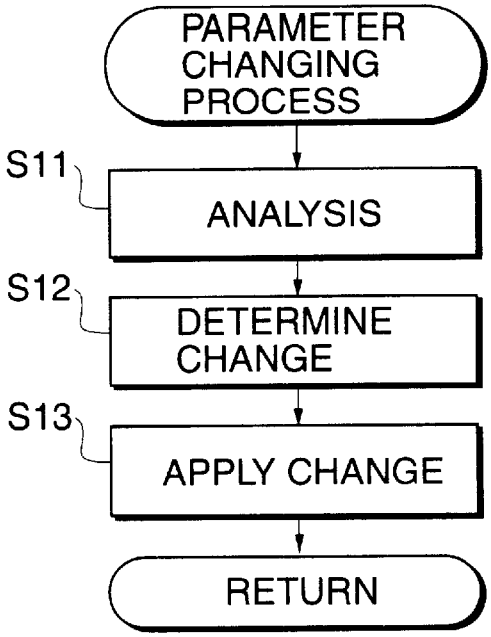
FIG. 21 is a flow chart showing a procedure of a parameter changing process in FIG. 2.

Next, "Embodiment 2" will be described, which adds expressions mainly using the volume parameter as a specific performance parameter (the specific performance parameter may also be other performance parameters such as the interval parameter). FIGS. 20 and 21 show flow charts useful in explaining an outline of functions of the expression adding module of the system shown in FIG. 2, in terms of automatic parameter editing and as a process flow executed by the CPU 1. First, the outline will be described with reference to FIGS. 20 and 21, and specific examples (A) to (K) of "Embodiment 2" will then be described with reference to FIGS. 22 to 38.

An automatic parameter editing apparatus according to the present embodiment principally executes the following control processes:

[1] A parameter changing process of analyzing supplied performance data, then based on results of the analysis, selecting a parameter to be changed and determining how the parameter is to be changed, and then applying a parameter change to the performance data.

[2] A reproduction process of reproducing the performance data with expressions added by means of the process [1].

[3] A checking process of checking the performance data with expressions added by means of the process [1].

Although the present embodiment assumes the performance data to be in an SMF (Standard MIDI File) format, a different format may be employed. The checking of the performance data of the checking process [3] is comprised of displaying the performance data on the display 14 in a certain form, and displaying the parameter value applied during the above described process [1] and its applied position in a fashion overlapping the already displayed performance data so that the user can check results of the process [1]. During this checking process, the user may designate positions to which the parameter changing process is not to be applied.

It goes without saying that such a method as described in each example of "Embodiment 2" may be employed as the reproduction and checking processes [2] and [3]; that is, the dynamic value $\alpha$ is set for a predetermined performance parameter such as the volume or the interval (for example, the step A2), the performance data (MIDI data or the like) with this performance parameter applied are reproduced, and the dynamic value $\alpha$ is again set depending on a result of determination of whether the performance data with the parameter applied are satisfactory or good (for example, teh step A7).

FIG. 20 is a flow chart showing a procedure of a main routine executed by the automatic parameter editing apparatus according to the present embodiment, particularly by the CPU 1.

In the figure, an initialization process is first executed by, for example, clearing the RAM 3 or selecting the performance data to be processed (one of the processes [1] to [3]) (step S1).

Next, the user-selected performance data are retrieved, for example, from various storage media (the above described hard disk, FD, CD-ROM, or the like) or an external device (the above described MIDI equipment 17, server computer 20, or the like) and stored in a performance data storage area provided in a predetermined location of the RAM 3 (step S2).

Next, the parameter changing process [1] (its specific process procedure will be described later with reference to FIG. 21) is executed (step S3). The parameter changing process in FIG. 21 is a combination of extractions of processes common to all of the plural (in the present embodiment, 19) parameter changing processes. Thus, at the step S3, more specifically, at least one of the parameter changing processes 1 to 19 which is selected by the user is executed.

Further, another process different from the above parameter changing process is executed (step S4). In this case, the above described processes [2] and [3] are executed, but a process for generating new performance data may additionally be executed.

Then, it is determined whether the user has performed an operation for completing this main routine (step S5). If the user has performed this operation, this main routine is terminated, and if the user has not performed this operation, the process returns to the step S2 to repeat the processing from the step S2 to the step S5.

FIG. 21 is a flow chart showing a procedure of the parameter changing process at the step S3.

In the figure, performance data stored in the above described performance data storage area are analyzed (step S11). Specifically, the analysis of the performance data comprises extracting from the performance data portions for which the parameter value is to be changed.

Next, an optimal parameter value (variable) is determined for each of the extracted portions (step S12).

The determined parameter values are each applied to the performance data at a corresponding position (step S13), and this parameter changing process is terminated.

It goes without saying that the processes described with reference to FIGS. 20 and 21 are used to change not only the volume parameter but also the temporal control information (time parameters) for the tempo, the timing, or the like described above or other parameters such as the interval.

The present invention is characterized by this parameter changing process, and specific process methods therefor will be described below in detail.

(A) Process for Portions where Note Pitch Rises

Figure 22:
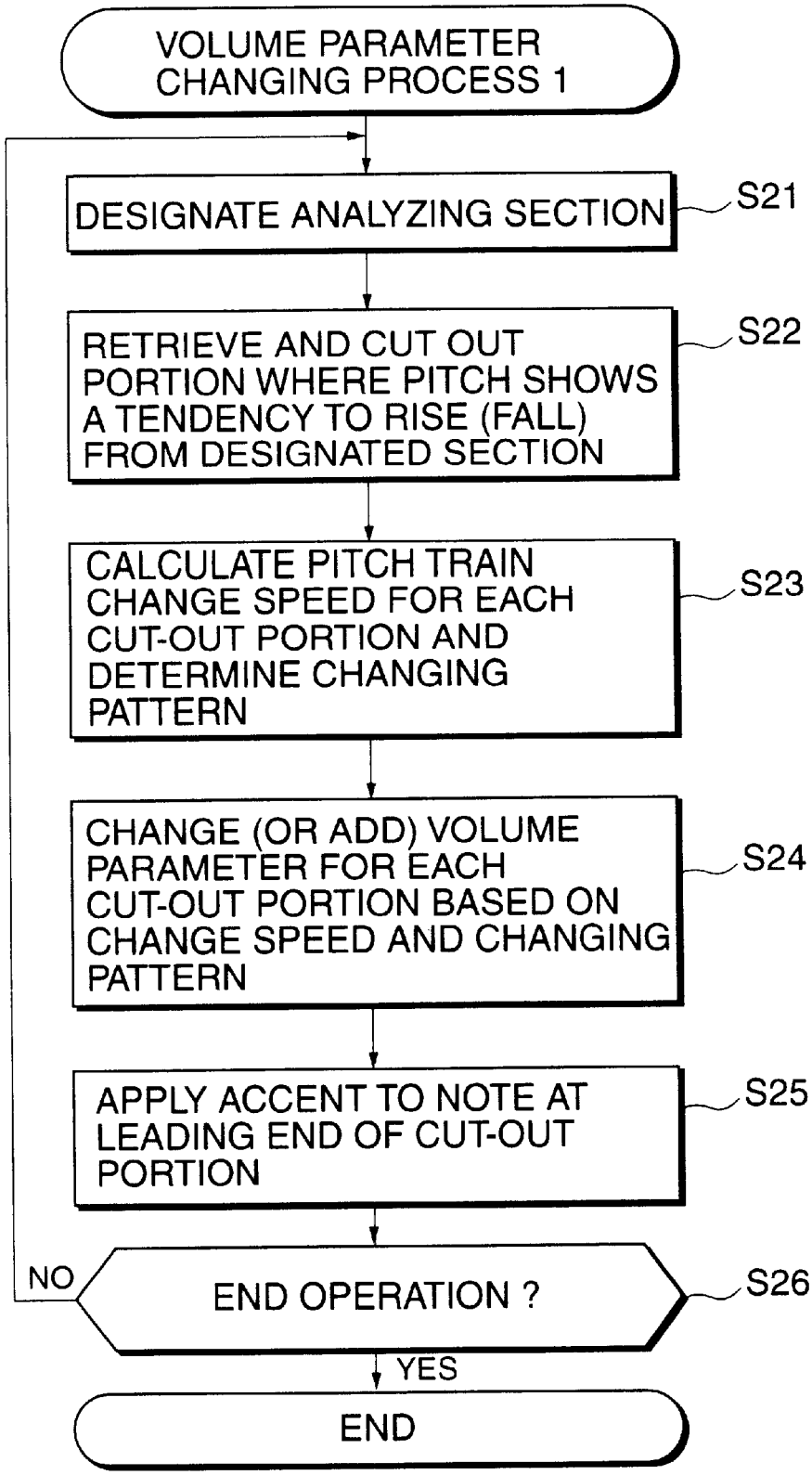
FIG. 22 is a flow chart showing a procedure of a volume parameter changing process 1 for changing a volume parameter for performance data depending on changes in the pitch of the performance data.

FIG. 22 is a flow chart showing a procedure of a volume parameter changing process 1. In the volume parameter changing process 1, expressions are added such that the volume parameter for the performance data is changed depending on a change in the pitch of performance data. Specifically, the volume parameter is changed in accordance with the following algorithm:

(1) The volume is progressively increased when the pitch (note number) of a note event train shows a tendency to rise.

(2) When the pitch of the note event train changes from a tendency to rise to a tendency to fall, an accent is applied to a note event at this change point.

The term "note event" normally includes both a note-on event and a note-off event. The present embodiment, however, does not take note-off events into consideration, so that this term is used to mean only a note-on event.

In FIG. 22, when the user designates a section of performance data stored in the above-mentioned performance data storage area for which the volume is to be changed (the performance data will be hereinafter referred to as "the selected performance data), the designated section is stored in a work area of the RAM 3 as an analyzing section (step S21). It goes without saying that all the sections of the performance data may be set to be analyzing sections instead of designating specific sections. In this case, since the performance data are sequence data, each of the performance data spreads along the time axis. Thus, the concept of "section" can be introduced into the performance data.

Subsections where the pitch of the note event train shows a tendency to rise and a tendency to fall are retrieved and cut out from the analyzing section (step S22).

Figure 23A:
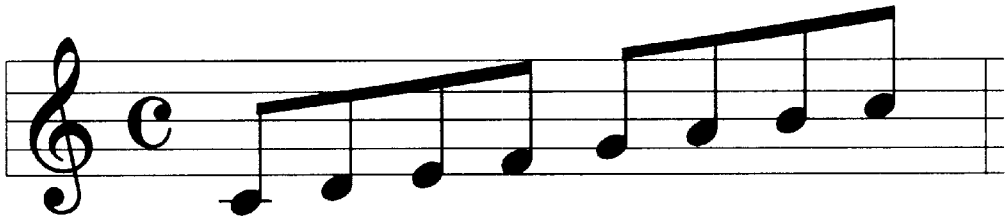
FIGS. 23A and 23B are views showing an example of a note event where the pitch shows a tendency to rise.
Figure 23B:
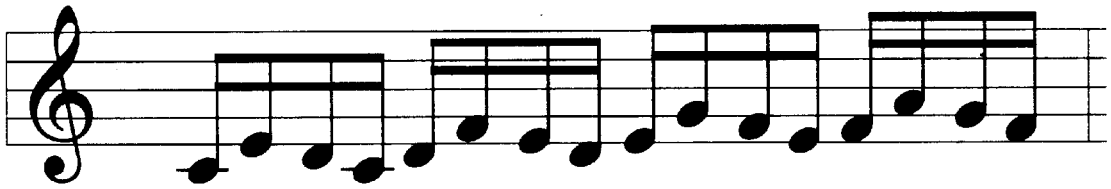

FIGS. 23A and 23B are views showing examples of note event trains where the pitch shows a tendency to rise. FIG. 23A shows an example of a simple rising tone system, and FIG. 23B shows an example that is not a simple rising tone system but a generally rising tone system. That is, in the present embodiment, a section of the note event train as shown in FIG. 23A is cut out as a subsection where the pitch shows a tendency to rise but a section of the note event train as shown in FIG. 23B is also cut out as such a subsection. A method of retrieving these subsections will be explained hereinbelow.

First, only a note event is extracted from the selected performance data, and note numbers contained in this note event are arranged in time series to generate a note number train in time series. This note number train is subjected to processing by a high-pass filter (HPF) to calculate a tendency of change in the interval. If the change in the calculated value obtained only by this HPF processing is too small relative to time, the calculated value (data train) is further subjected to processing by a low-pass filter (LPF) to smooth the change relative to time. Filtering the note number train in this manner allows a generally rising tone system such as one shown in FIG. 23B to be retrieved in a similar manner to the retrieval of a simple rising tone system such as one shown in FIG. 23A.

Figure 24:
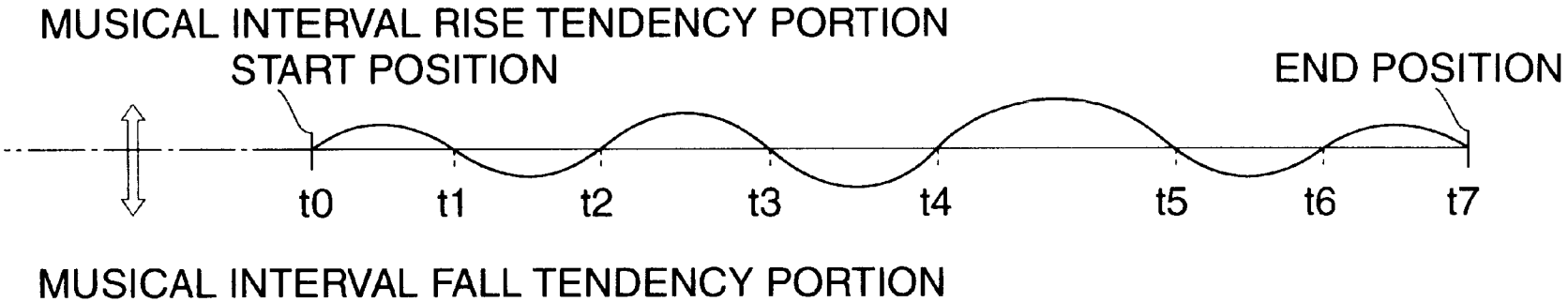
FIG. 24 is a view showing an example of filtered time series data.

FIG. 24 is a view showing an example of time series data representative of a tendency of change in the interval calculated in the above manner. In the figure, the ordinate indicates a musical-interval rise tendency on its positive side and a musical-interval fall tendency on its negative side. The abscissa indicates time. That is, in the figure, sections t0–t1, t2–t3, t4–t5, and t6–t7 are cut out from an analyzing section t0–t7 as subsections where the pitch shows a tendency to rise.

Subsections where the pitch shows a tendency to fall can also be cut out easily while the subsections where the pitch shows a tendency to rise are being cut out. That is, in FIG. 24, sections t1–t2, t3–t4, and t5–t6 where the time series data assume negative values correspond to subsections where the pitch shows a tendency to fall and may thus be cut out as such subsections.

The length of each cutout section may be an integral multiple of the bar or beat length or may be arbitrary. When one analyzing section contains a plurality of subsections where the pitch shows a tendency to rise as shown in FIG. 24, all these subsections are cut out.

Referring again to FIG. 22, the change speed of the pitch of a note number train belonging to each of the cutout subsections is calculated, and depending on a result of the calculation, a volume parameter changing pattern to be applied to each note event of the note event train belonging to the subsection is determined (step S23). The pitch change speed means an inclination of change of the pitch, that is, an amount of change of the pitch per unit time. The changing pattern refers to a template prepared in advance and representing, for example, a tendency of change in the volume parameter stored in the ROM 2. Specifically, the template represents time series data formed of data that replace the original volume parameter value or data that modify the original volume parameter value. In the present embodiment, the tendency of change in the volume parameter refers to a progressive increase in the volume parameter value in a subsection where the pitch shows a tendency to rise, and the rate of this increase is varied for each template so that a template with a large increase rate set is selected for a subsection where the pitch changes at a high speed.

The changing pattern may be calculated from a predetermined arithmetic expression instead of using the template.

Next, the volume parameter value to be applied to each note event of the note event train belonging to each cutout subsection is changed based on the determined changing pattern (step S24). If there is no volume parameter to be changed, a new volume parameter may be added. In this case, if, as the volume parameter, specifically a velocity value contained in the note event is used, a change in the volume parameter value means a change in the velocity value. Expression data may be inserted into the subsection in a manner affixed to each note event.

Next, the subsections cut out at the step S22 are arranged in time series, points of time when the pitch changes from a tendency to rise to a tendency to fall, that is, points of time when the sign of the filtered time series data changes from positive to negative in FIG. 24 (points of time t1, t3, t5) are detected, and volume data representative of accents are applied to notes at these points time, that is, notes (note events) at leading end and trailing end positions of the cutout subsection (step S25).

Then, it is determined at a step S26 whether the user has performed an operation for completing the volume parameter changing process 1. If the user has performed this operation, the volume parameter changing process 1 is terminated, and if the user has not performed this operation, the process returns to the step S21 to repeat the processing from the step S21 to the step S26.

According to a variation of this example, the method of the "volume parameter changing process 1" described with reference to FIGS. 22 to 24 is applicable to changing of the interval parameter. That is, in a pitch rise system, the performance may show a phenomenon that the interval progressively shifts downward and "fail to finish rising". Correspondingly to this phenomenon, by retrieving a portion of the performance data (MIDI data or the like) where the pitch rises (the step S22), using a HPF (in some cases, also using a LPF) to evaluate the pitch rise speed (step S23), calculating a change in the interval based on a predetermined interval applying pattern or the like (step S24), and applying the calculated change to the performance data (step S25), addition of expressions can be performed such that the interval is progressively lowered in steps smaller than the key in portions where the pitch of notes rises.

In this manner, by using a HPF or the like to detect the pitch rise speed from performance data and changing the interval depending on the detected value, the interval can be more significantly shifted upward if the pitch rises at a rapid rate, whereas the interval can be more significantly shifted downward if the pitch falls at a rapid rate. In some cases, however, the interval is desired to be more sharply shifted downward as the pitch changes more rapidly irrespective of whether the change is downward or upward. In this case, a change in the interval may be calculated depending on an absolute value detected by the HPF.

For keyboard instruments or the like in which the interval is unlikely to shift, more natural sounds are obtained when the above described expression adding function for shifting the interval downward in the pitch rise system is not used. Accordingly, when the performance data are analyzed (for example, at the step S22), the tone color should also be checked to determine the type of the instrument.

This expression adding process system allows changes in performance range to be observed, thereby enabling an automatic expression where a portamento (for fretless stringed instruments) or a slide (for fretted stringed instruments) is added when the performance range changes significantly.

(B) Process for Expressing Excitement with Progress of Music

Figure 25:
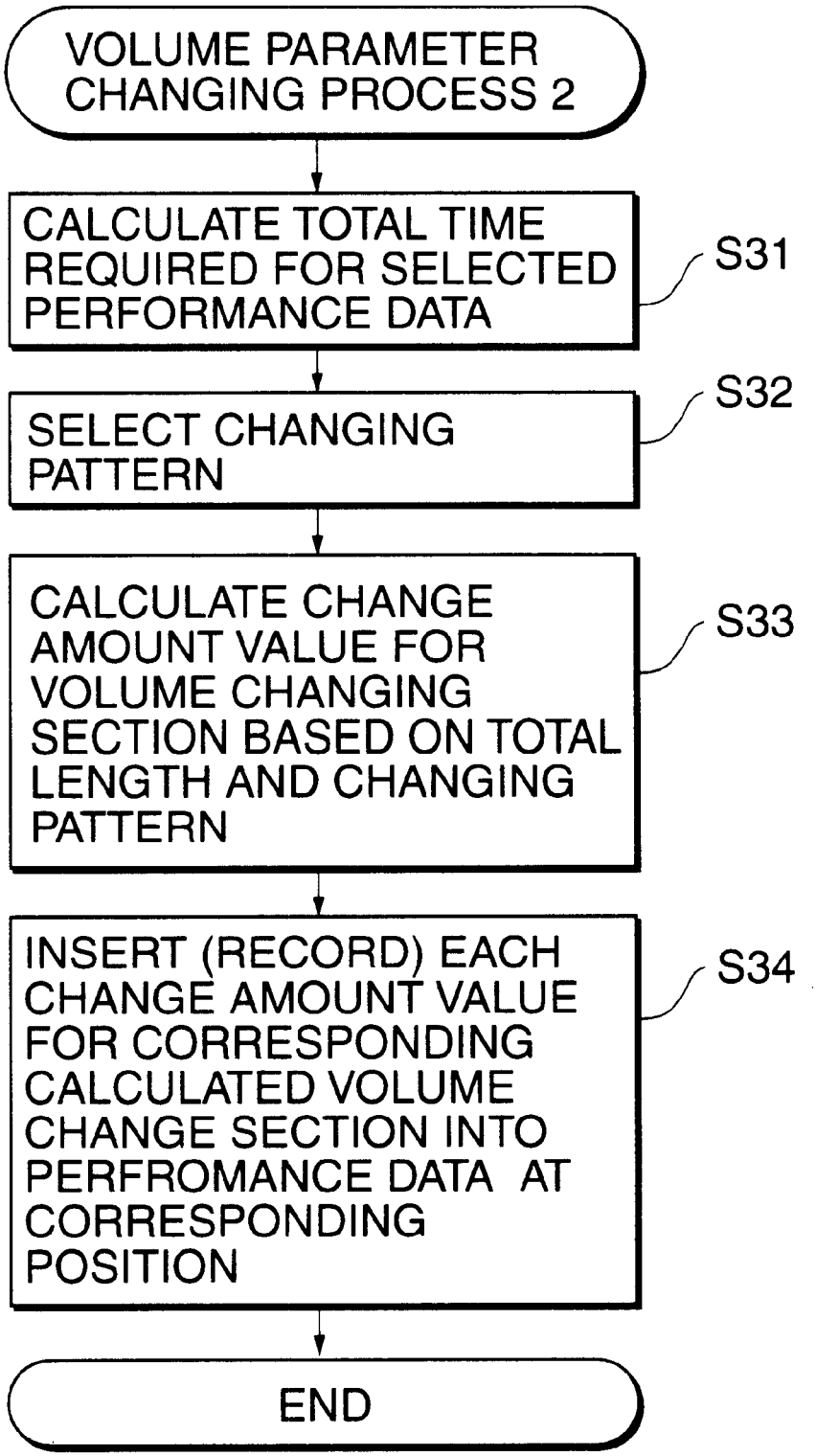
FIG. 25 is a flow chart showing a procedure of a volume parameter changing process 2 for adding expressions such that the value of the volume parameter for performance data is progressively increased to enhance listeners' excitement.

FIG. 25 is a flow chart showing a procedure of a volume parameter changing process 2. This volume parameter changing process 2 comprises adding expressions such that excitement is enhanced by progressively increasing the value of the volume parameter for the performance data.

In the figure, the total length of time of selected performance data is first calculated (step S32).

Figure 26:
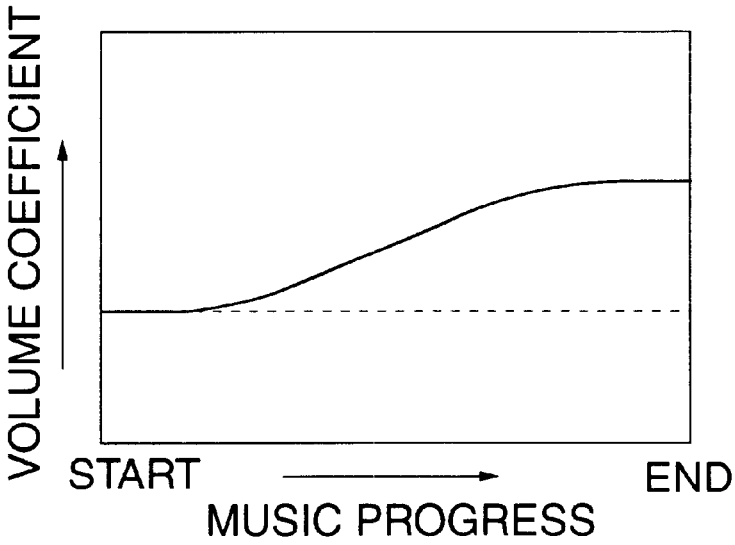
FIG. 26 is a view showing an example of a change applying pattern.

Next, a changing pattern is selected (step S32). The changing pattern refers to pattern data representative of a tendency of change in the volume throughout music. For example, plural types of pattern data are provided in the ROM 2 in the form of table data, and one of the data is selected automatically or depending on the user's selection. FIG. 26 shows an example of the changing pattern. The ordinate indicates a volume coefficient, while the abscissa indicates a music progress direction. As shown in the figure, the volume coefficient, that is, a coefficient for weighting volume data (or expression data) increases as the music progresses. Since, however, an infinite increase in the volume data is limited by the limited hardware of the tone generator circuit 7 and spoils addition of natural expressions to the music, the volume coefficient is desirably characterized by converging to a predetermined finite value as the music progresses, as shown in FIG. 26.

Next, a change amount value is calculated for each volume changing section based on the total time length data calculated at the step S31 and the changing pattern selected at the step S32 (step S33). This operation is performed because the length of a piece of music varies depending on the performance data, while the changing pattern is based on a predetermined fixed length, so that once the selected performance data has been determined, the total length of the changing pattern has to be correspondingly increased or reduced so as to match the total time length of the selected performance data (scaling). In this manner, the change amount is determined for each volume changing section (for example, for each bar, but the present invention is not limited to this but the change amount may be determined for each performance phrase) from the changing pattern having its total length matched with the total time length of the selected performance data. That is, in the present embodiment, the changing pattern is in the form of table data, so that data are read from positions of the scaled table data which correspond to respective volume changing sections. Since the table data are composed of volume coefficient values as mentioned above, each of the read volume coefficient values has to be converted into a change amount value by multiplying it by volume data for each volume changing section (weighting).

Finally, the calculated change amount value for each volume changing section is inserted into the selected performance data at a corresponding position (step S34). Specifically, the calculated change amount value for each volume changing section or bar (the volume data weighted by the corresponding volume coefficient value) is recorded (inserted) in the selected performance data at the leading end position of the bar.

When the selected performance data are composed of a plurality of tracks, the same or a different changing pattern may be used for each track. Further, a function may be provided, which allows the user to generate or edit changing patterns. Specifically, if the changing pattern is table data as shown in FIG. 26 and when the user selects a numerical value indicating a multiplying factor, all the data values are uniformly increased or decreased depending on the selected multiplying factor with the general characteristics of the table data unchanged. In this case, one of words "strong", "medium", "weak", and "no change" may be selected instead of the numerical value, and then, when the user selects one of the words, the CPU 1 converts the selected word into a multiplying factor to uniformly increase or reduce all the data values depending on the multiplying factor. Further, the data value may be increased or reduced depending on a different multiplying factor for each predetermined range.

According to a variation of this example, the "volume parameter changing process 2" described with reference to FIGS. 25 and 26 is applicable not only to changing of the volume parameter but to changing of the interval parameter, and provides equivalent effects on the interval. That is, by evaluating the length of music of the performance data (MIDI data or the like) (step S31), determining a parameter for a changing pattern (a musical-interval changing table) (step S32), calculating a change amount in the interval based on the determined parameter (step S33), and applying the calculated change amount (step S34), addition of expressions can be performed such that the value of the interval parameter is progressively increased to progressively enhance the interval to enhance excitement.

Figure 27:
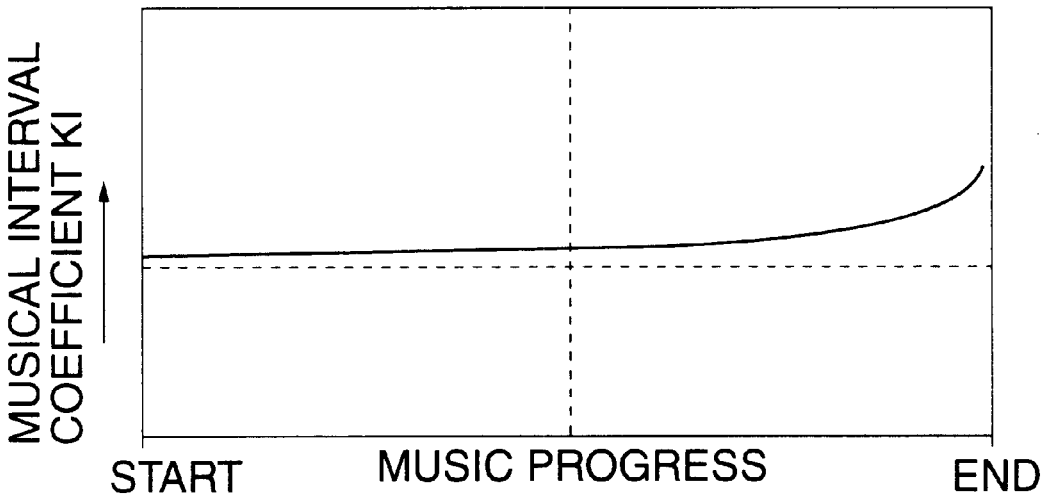
FIG. 27 is a view showing an example of the relationship between note density and instability of musical intervals according to an example of the present invention.

The changing pattern is preferably in the form of a "music progress-interval coefficient" table (the ordinate indicates the "interval coefficient") where the coefficient value increases as in the table in FIG. 26, as shown in FIG. 27. In this case, the interval may be increased, for example, for each bar using a multiplying factor in accordance with the "music progress-interval coefficient" table in FIG. 27. Such a "music progress-interval coefficient" table is desirably configured to multiply a set target value of the interval by a normalized interval change curve to obtain an actual change curve. The effects of this function for changing the interval parameter are not always effective, so that it has to be designed such that this function can be canceled.

(C) Process for Same/Similar Phrases

Figure 28:
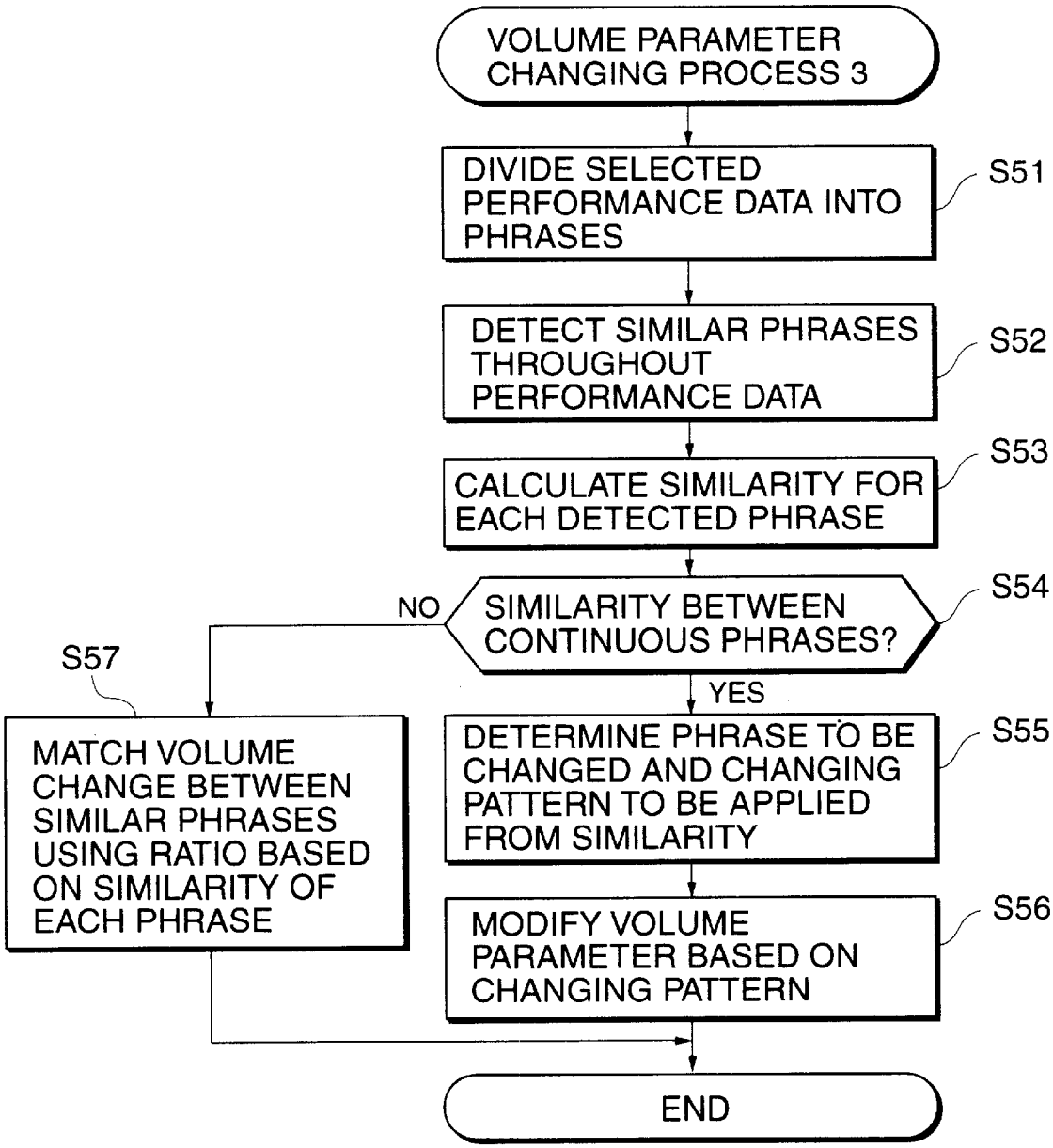
FIG. 28 is a flow chart showing a procedure of a volume parameter changing process 3 for adding expressions to selected performance data having similar phrases appearing repeatedly by changing a volume parameter for second and subsequent phrases depending on similarity between these phrases and a manner of their appearance.

FIG. 28 is a flow chart showing a procedure of a volume parameter changing process 3. In this volume parameter changing process 3, for selected performance data with similar phrases appearing repeatedly, the volume parameter is changed for the second and subsequent similar phrases depending on their similarity and on how they appear. Specifically, the volume parameter is changed in accordance with the following algorithm:

(1) If phrases with a high similarity appear continuously, the second and subsequent similar phrases each have its volume parameter value reduced below that of the first similar phrase.

(2) If similar phrases appear repeatedly but not continuously, the second and subsequent similar phrases each have its volume parameter value changed to a value close to that of the first similar phrase and depending on their similarity.

In FIG. 28, first, selected performance data are divided into phrases (step S51). In the present embodiment, the phrase corresponds to, for example, one bar length. The present invention, however, is not limited to this but the phrase may correspond to a length of a plurality of bars or another unit length. Further, the phrase may be what is called "performance phrase" such as an introduction section, a fill-in section, or a main section.

Next, performance data (specifically, note-on event, delta time, or the like) contained in each of the phrases obtained by the division are compared between the phrases to detect similar phrases (step S52).

Then, similarity is calculated for each of the detected similar phrases (step S53). The similarity between the phrases to be compared is indicated by four level values: ① all the performance data are the same, ② the performance data are only partly different, ③ the performance data are only partly the same, and ④ no performance data are the same. More or less levels may be used. The similarity ④ is impossible at the step S53 because similar phrases have been detected at the preceding step S52.

Next, it is determined whether or not the similar phrases are continuous (step S54), and if the similar phrases appear continuously, a phrase to be changed and the changing pattern to be applied to this phrase are determined from the calculated similarity (step S55). The volume parameter for the performance data contained in the determined phrase is modified based on the determined changing pattern (step S56).

At the step S55, the phrase to be changed refers to the second and subsequent ones of the continuously-appearing similar phrases, and the changing pattern refers to a pattern of volume coefficient values (ratios) for weighting the value of the volume parameter for each of the performance data contained in the first appearing phrase (specifically, this volume parameter corresponds to a velocity of the note event). The volume coefficient values are changed depending on the similarity. For example, the volume coefficient value is set to "0.8" for the similarity ①, "0.9" for the similarity ②, and "1.0" for the similarity ③. In addition to the similarity, the order of appearance may be used to determine the volume coefficient value. For example, for the similarity ①, the volume coefficient value is set to "0.8" for the second appearing similar phrase, and the volume coefficient value is set to "0.7" for the third appearing similar phrase.

At the step S56, the volume coefficient determined in this manner is multiplied by each velocity value in the first appearing phrase, and each result of the calculation replaces the corresponding velocity value in the second and subsequent similar phrases to modify the volume parameter.

On the other hand, if the similar phrases are not determined to be continuous at the step S54, the volume change is matched between the similar phrases using a ratio based on the similarity therebetween (step S57). Specifically, if the similar phrases have the similarity ①, the volume parameter for each of the performance data contained in the first appearing phrase (specifically, the velocity of the note event) replaces the volume parameter for each of the performance data contained in the second and subsequent appearing phrases. If the similar phrases have the similarity ②, then for portions of the performance data which are the same between the similar phrases, the volume parameter for the corresponding portion of the first appearing phrase replaces the volume parameter for the corresponding portion of the second and subsequent appearing phrases, and for portions that are different between the similar phrases, the volume parameter for each of these portions is edited (the ratio of the velocity value is adjusted) so as to be adapted to the replaced portion.

According to a variation of this example, the manner of the "volume parameter changing process 3" described with reference to FIG. 28 is directly applicable to addition of expressions by changing the interval parameter for the performance data. That is, since similar phrases have similar interval expressions, the process flow in FIG. 28 can be applied to modification of the interval parameter; for example, if the same phrase is continuously repeated and this is reproduced in a different portion, the expressions of the first interval are directly copied to the second occurrence, and if the phrases are not exactly the same but are simply "similar", an interval change similar to the expressions of the first interval may be set.

(D) Process Corresponding to Phrase End Feeling

Figure 29:
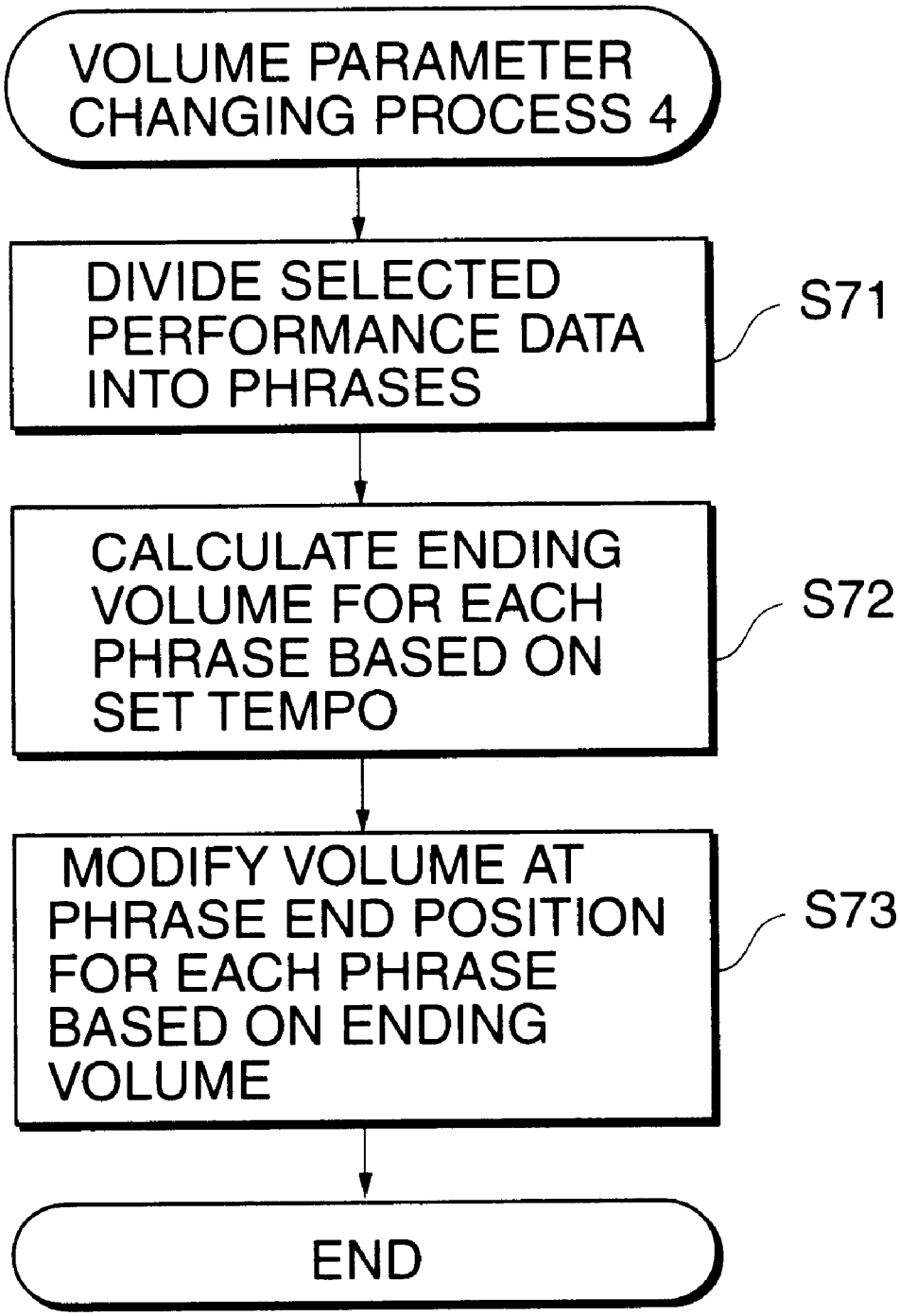
FIG. 29 is a flow chart showing a volume parameter changing process 4 for adding expressions by reducing the volume at an end of a phrase.

FIG. 29 is a flow chart showing a procedure of a volume parameter changing process 4. In this volume parameter changing process 4, expressions are added such that the volume is diminished or suppressed at the end of a phrase.

In the figure, selected performance data are first divided into phrases as in the step S51 (step S71).

Next, an ending volume is calculated for each of the phrases obtained by the division, based on a tempo set for the phrase (step S72). The ending volume does not mean that the volume of a note at an end position of the phrase is reduced but that the volume of the note is progressively diminished after the start of sounding of the note. The period of time from the start of sounding and before the stop of sounding is determined depending on the tempo set for the phrase and on the note length. To carry out such control of progressively decreasing the volume of the note, the note has to be a type that generates a sustain sound. If, however, the note is a type that generates a decay sound, the ending volume is calculated such that the volume of the note is simply reduced or the volume of several notes preceding this note is progressively decreased. Of course, such an ending volume may be calculated even if the note generates a sustain sound.

Then, the volume of the end position of each of the phrases obtained by the division (specifically, the value of the velocity of the note event at the end position) is modified based on the calculated ending volume (step S73).

In this volume parameter changing process 4, the volume of the end position of the phrase is reduced in the above manner, but conversely, a note (note event) at a leading end position of the phrase may be detected and have its volume (velocity value) increased, providing similar effects. This is particularly effective if the selected performance data are for bass rhythm instruments.

(E) Process for Trill and Roll by a Percussion Instrument

Figure 30:
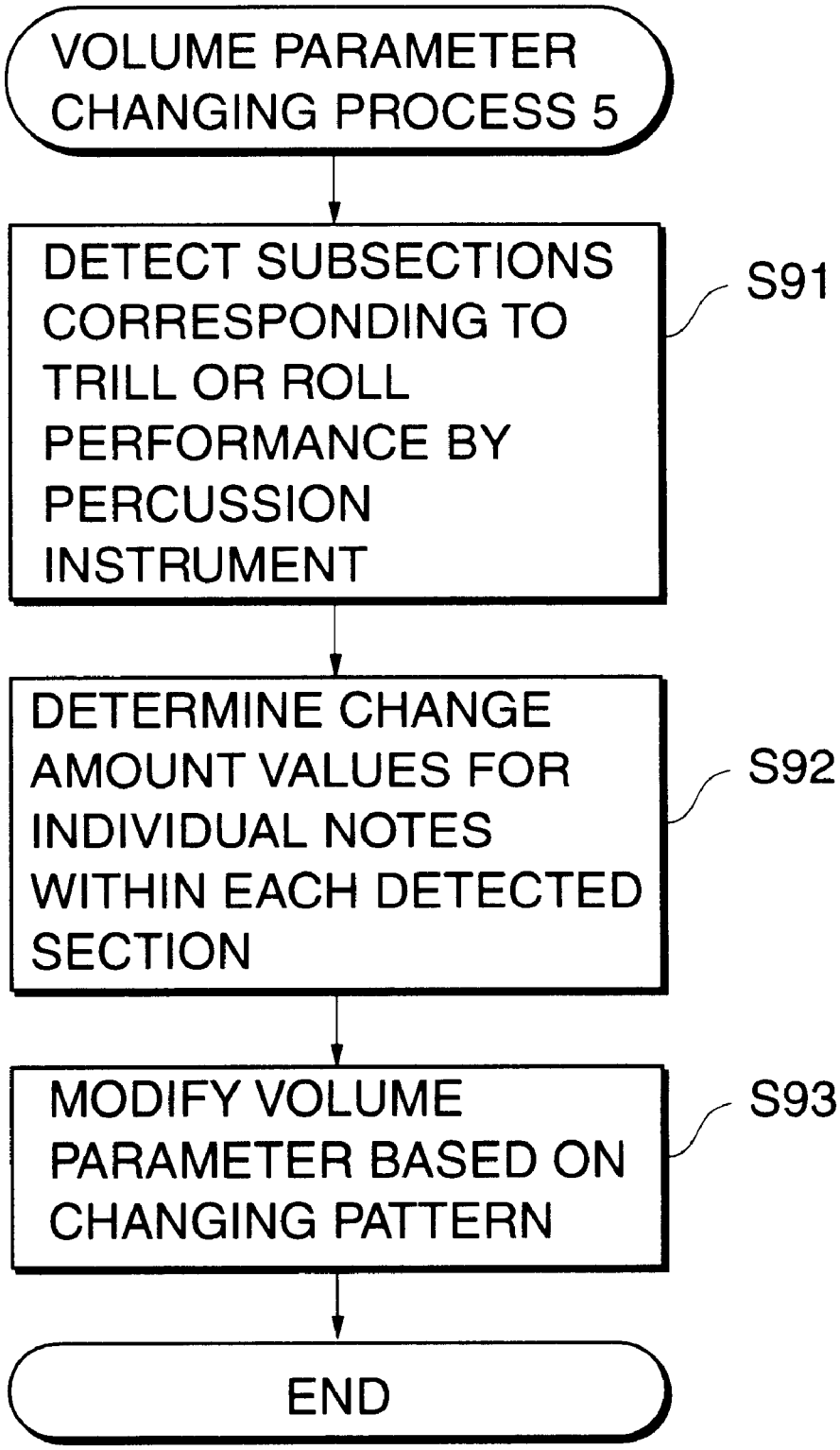
FIG. 30 is a flow chart showing a volume parameter changing process 5 for adding natural expressions to performance data during a trill or a roll performance by a percussion instrument.

FIG. 30 is a flow chart showing a procedure of a volume parameter changing process 5. In this volume parameter changing process 5, natural expressions are added to a trill or a roll by a percussion instrument.

In the figure, first, subsections of the selected performance data which correspond to a trill or a percussion roll are detected (step S91).

Next, change amount values for the volume of individual notes in each of the detected subsections are determined (step S92). These change amount values make a trill or a percussion roll sound natural, that is, make the volume (velocity values) of the individual notes uneven or irregular. The method of determining such change amount values includes simple generation of random values as uneven or irregular values, and provision of a changing pattern (template) having a flow of uneven or irregular values recorded therein so that the change amount values can be determined based on this pattern.

(F) Process for Performance where Plural Tones are Simultaneously Generated

Figure 31:
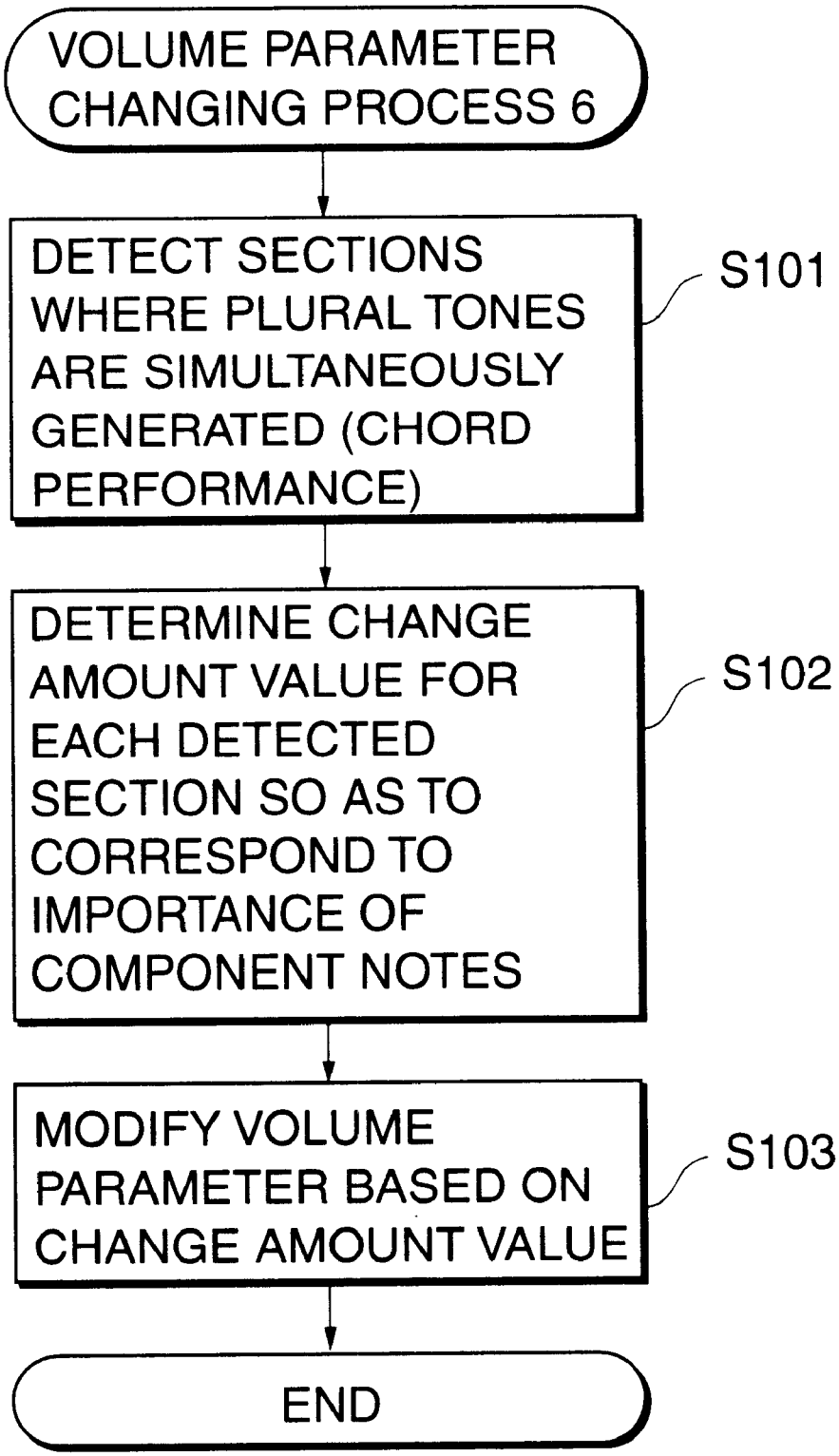
FIG. 31 is a flow chart showing a volume parameter changing process 6 for adding expressions to performance data containing a chord, by making the chord provide a clear tone.

FIG. 31 is a flow chart showing a procedure of a volume parameter changing process 6. In this volume parameter changing process 6, expressions are added to performance data containing chords in such a manner that the chords each generate clear tones.

In the figure, first, portions where a plurality of tones are to be generated simultaneously, that is, chord portions are detected from selected performance data (step S101).

Next, change amount values corresponding to the importance of respective component notes are determined for each of the detected chords (step S102). The change amount values each change the value of the volume parameter (the velocity of each note event) for each component note of the chord (the change amount values are, for example, volume coefficient values). In the present embodiment, the change amount values are varied depending on the importance of respective corresponding component notes. That is, since performance of all the component notes of the chord at the same volume may result in a simply noisy sound, only an important component note of the chord is set to a larger volume to provide a clear chord performance. As a criterion for determining how important the component note, it can be assumed that a tonic of the chord is most important and that a dominant is second most important. Further, the importance of each chord is detected using one of chord importance templates provided in advance, specifically templates each having recorded thereon information indicating a priority for each component note of the chord (for example, component notes with higher priorities are more important). The change amount values can be determined by, for example, using predetermined values for respective levels of importance or by increasing or reducing the current volume depending on the importance.

Then, the volume parameter is modified based on the change amount values determined at the step S102 (step S103).

In the volume parameter changing process 6, the volume of important notes is increased, but conversely, the volume of notes that are not important may be reduced.

Further, instead of using the concept of the importance, the volume of only the lowest and highest notes of the chord may be increased above those of the other component notes, or the volume of only a root of the chord may be increased above that of the other component notes.

Though not a chord, what is called "broken chord" is often played by guitars. Emphasizing the tonic of the broken chord provides a feeling of tonality that makes the performance clear. In this case as well, the tonic emphasizing processing can also be easily realized by simply changing part of the volume parameter changing process 6.

Further, if during performance of octave unison, all the parts are played at the same volume, the respective tone colors may be mixed together to prevent the unison from being expressed properly. Thus, when an octave unison is detected in the selected performance data, it may be effective to change the volume of the octaves by sequentially increasing or reducing the volume starting with the highest octave. This volume change can be easily achieved by simply changing part of the volume parameter changing process 6. For a unison of the same octave instead of the octave unison, the volume may be adjusted depending on the tone color, or other unisons such as 3rd and 5th may be similarly processed.

According to a variation of this example, the manner of "the volume parameter changing process 6" described with reference to FIG. 31 is also applicable to the interval. Thus, addition of expressions can be performed such that a chord is automatically changed to a chord of pure temperament or just intonation. In terms of the interval, fretless stringed instruments and wind instruments are characterized by their ability to generate chords of pure temperaments. Correspondingly to this, first, a portion of selected performance data to be generated in a chord is detected (this corresponds to the step S101), the type of the detected chord is evaluated, and a change amount of interval for a pure temperament is calculated according to the evaluated chord (this corresponds to the step S102). In this case, the change amount of interval can be easily calculated by referring to an interval table for each chord or the like. Then, expressions are added such that the interval parameter is modified based on the change amount of interval to change the interval (this corresponds to the step S103) to output a pure temperament.

(G) Process for Staccato Performance

Figure 32:
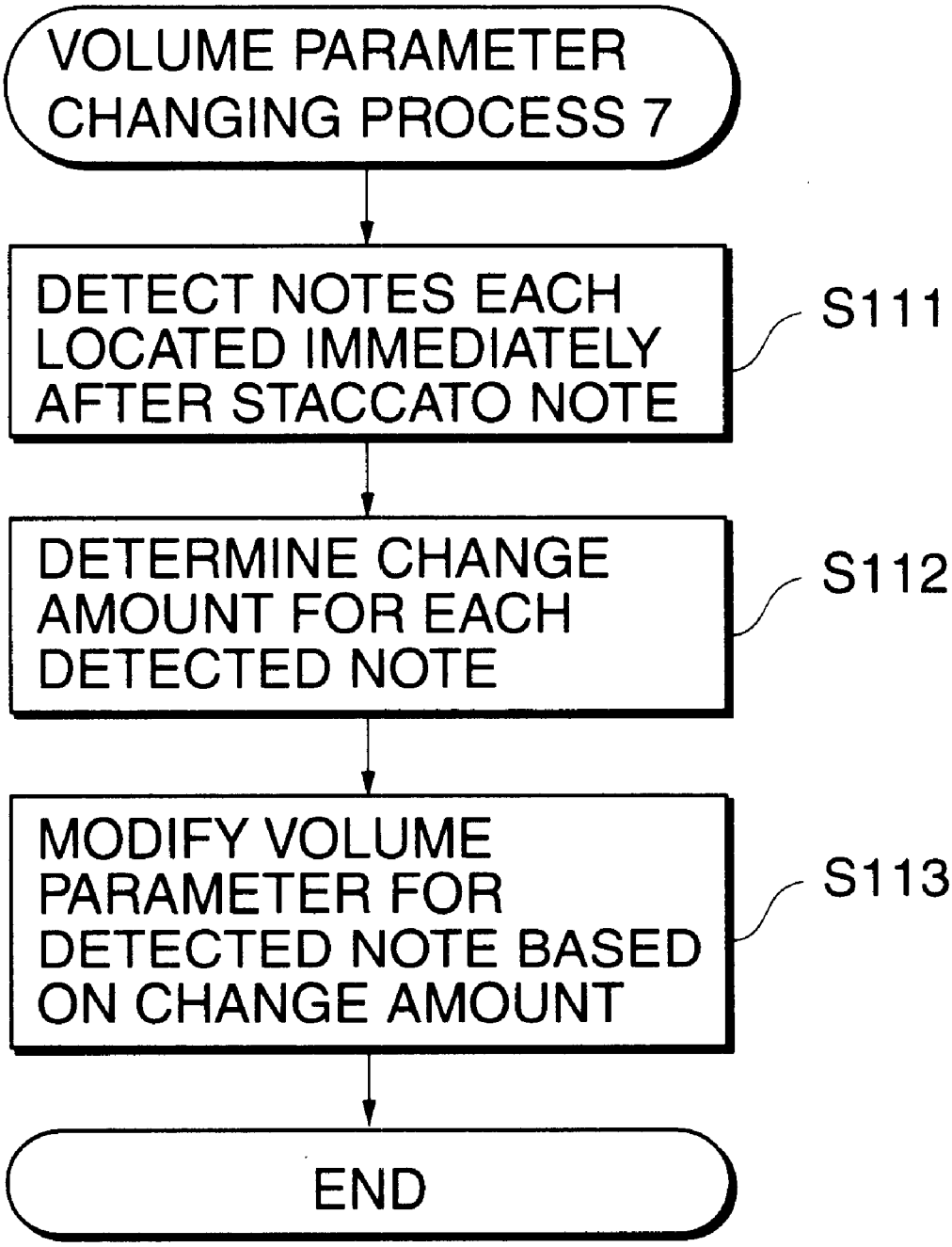
FIG. 32 is a flow chart showing a volume parameter changing process 7 for adding expressions to performance data containing a staccato by simulating a live staccato performance.

FIG. 32 is a flow chart showing a procedure of a volume parameter changing process 7. In this volume parameter changing process 7, expressions are added to performance data containing a staccato so as to simulate a vivid staccato performance.

In the figure, first, a note immediately after a note to be generated in a staccato is detected from selected performance data (step S111).

Next, a change amount is determined for each of the detected notes (step S112). In a live staccato performance, the staccato does not only shorten the tone length but also emphasizes it. One method to emphasize a staccato tone is to reduce the volume of the note immediately after the staccato note. At a step S112, this volume control is carried out. Thus, determining the change amount means determining an amount by which the value of the volume parameter (specifically, the velocity of the note event) for the detected note (note event) is reduced.

Then, the volume parameter for the note detected at the step S111 is modified based on the change amount determined at the step S112 (step S113).

In general, the degree of change of a staccato expression depends on the note value or tempo of the staccato note, so that the extent to which the note immediately after the staccato note is changed is preferably adjusted depending on the note value or tempo of the staccato note. Further, if there is a period of time of a rest between the detected note immediately after the staccato note and the staccato note and this time period of a rest is not to be detected, "a note within a predetermined period of time immediately after the staccato note" may be detected at the step S111.

(H) Process for Performance with Fluctuation/Randomness

Figure 33:
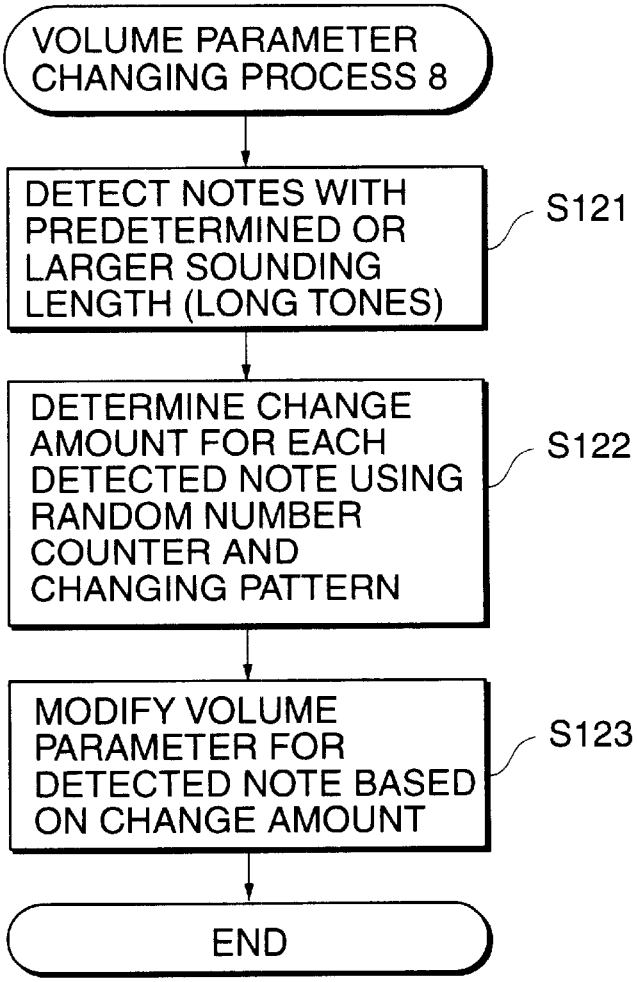
FIG. 33 is a flow chart showing a volume parameter changing process 8 for adding expressions to performance data having a long tone by causing the long tone to be fluctuated in volume.

FIG. 33 is a flow chart showing a procedure of a volume parameter changing process 8. In this volume parameter changing process 8, expressions are added such that the volume of a long tone is fluctuated.

In the figure, first, a note equal to or longer than a predetermined sounding length (long tone) is detected (step S121), as in the step S81.

Figure 34:
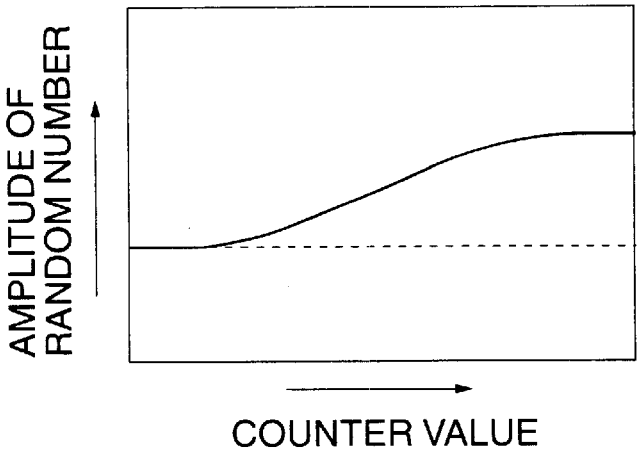
FIG. 34 is a view showing an example of table data for changing amplitude of a random number generated by a random number counter, depending on a count value of the random number counter.

Next, a change amount is determined for each of the detected notes using a random number counter and a changing pattern (step S122). When a long tone is played live, it shows a tendency to generate a progressively increased fluctuation. At a step S122, a change amount for simulating this phenomenon is determined. That is, the amplitude of a random number output from the random number counter is changed based on the changing pattern provided in advance, specifically table data for changing the amplitude of a random number from the random number counter depending on a count value of the random number counter as shown in FIG. 34. The value of random number from the random number counter with the amplitude thus changed is set as the change amount. Thus, as time elapses after the start of generation of the long tone, the amplitude of the output random number increases, thereby enabling, determination of such a change amount as to progressively increase the fluctuation. If the amplitude of the random number is infinitely increased with an increase in the counter value, the correspondingly determined change amount will be unreasonable. Therefore, the amplitude of the random number is preferably converged to a predetermined value as the counter value increases.

Then, the volume parameter (specifically, the velocity of the note event) for the note (note event) detected at the step S121 is modified based on the change amount determined at the step S122 (step S123).

Although the volume parameter changing process 8 uses the random number counter, a fluctuation table may be used instead. Further, data for irregular parameter changes which are collected from performance data generated by live instruments can be effectively used as the changing pattern.

If a section of the selected performance data to which is attached an f (forte) as a volume symbol contains a long tone and when this long tone continues to be played at the same volume, then the effects of the forte are progressively lost; that is, the long tone no longer sounds like a forte. In this case, the volume of the long tone is progressively increased, providing effective results. This volume control can also be realized by changing part of the volume parameter changing process 8. Specifically, a process for detecting the f symbol is added to the beginning of the processing at the step S121, an ordinary counter is used instead of the random number counter at the step S122, and the processing at the step S123 is executed without any change. In wind instruments, a too long tone progressively declines in volume. In this case, the volume may be controlled by omitting the above described f symbol detection process and replacing the above-mentioned ordinary counter by a subtraction counter so that the volume falls progressively.

According to a variation of this example, the manner of "the volume parameter changing process 8" described with reference to FIGS. 33 and 34 is also applicable to the interval. That is, addition of expressions can be performed such that the interval of a long tone is fluctuated. Fretless stringed instruments or wing instruments, when played by human beings, cannot keep the interval unchanged but it fluctuates to some degree. To realize such a fluctuation, a long tone with a dynamic mark (f) is detected from score data (step S121), a change amount of interval is calculated (step S122), and the interval parameter is changed based on the calculated change amount (step S123) to change "the interval" using a random number, as is the case with the volume.

In this case, it is sometimes effective to use a bandpass filter to apply a band restriction to a random number, instead of using a simple random number to arbitrarily change the interval. Further, the interval may be changed using a table instead of a random number. In particular, natural sounds are obtained with a table having interval changes of a live instrument recorded therein.

Further, fluctuations in the interval of a long tone in live performance tend to increase progressively with an increase in the tone length, and therefore the system is preferably configured such that fluctuations in the interval of a long tone are progressively increased during performance of the long tone by issuing a command to a random number table having a characteristic as shown in FIG. 34 in response to an output from a counter which is reset by a new note, as in the case of volume fluctuations. On the other hand, for keyboard instruments or the like which are unlikely to have their intervals shifted, more natural sounds are obtained when this interval fluctuation function is not used. That is, when the performance data (MIDI data or the like) are analyzed (step S121), the tone color has to be checked to determine the type of the instrument.

Further, according to a variation of this example, apart from the above described interval fluctuation process, addition of expressions can be performed such that the randomness of the interval is increased. For example, if a section of performance data with the volume symbol f (forte) contains a long tone and the performance continues with the interval unchanged, the presence of the forte is progressively lowered with the forte effect being progressively lost. Accordingly, in this case, it is effective to progressively increase the instability of the interval. That is, in performance of a long tone, it is effective to progressively increase the randomness of the interval. Further, preferably, the randomness of the interval is changed according to the tone color or changed between a melody and an accompaniment (back).

To perform such a process, it is first detected at a dynamics detecting step whether the dynamic mark is f (or higher than f), a note of a long tone is detected within the range of the dynamic mark f, the length of the note is then evaluated, and expressions are added such that the interval progressively grows unstable. The purpose of evaluating the note length is to effectively change the instability of the interval within the length of time of the note, that is, to prevent the instability of the interval from being infinitely increased. Accordingly, a curve of change of the instability of the interval has to be adjusted depending on the length of the note.

Such instability of the interval can occur even if the dynamic mark is p (piano), and accordingly, the above dynamic mark detecting step is configured such that a dynamic mark that does not indicate a medium degree can be detected, so that the interval can be made unstable in response to detection of such a dynamic mark. Alternatively, all the dynamic marks may be neglected.

Further, some tone colors are unnatural when the randomness is significantly large, and therefore, the randomness has to be controlled depending on the tone color. In particular, in keyboard instruments such as piano, the tone becomes unnatural due to randomness, and among wind instruments, clarinet will suffer from unnatural tones. Further, if the accompaniment part also has an unnecessarily higher randomness, the performance sound will be noisy. Therefore, the randomness is preferably varied between the melody part and the accompaniment part.

(I) Parameter Process Depending on Fingering

Figure 35:
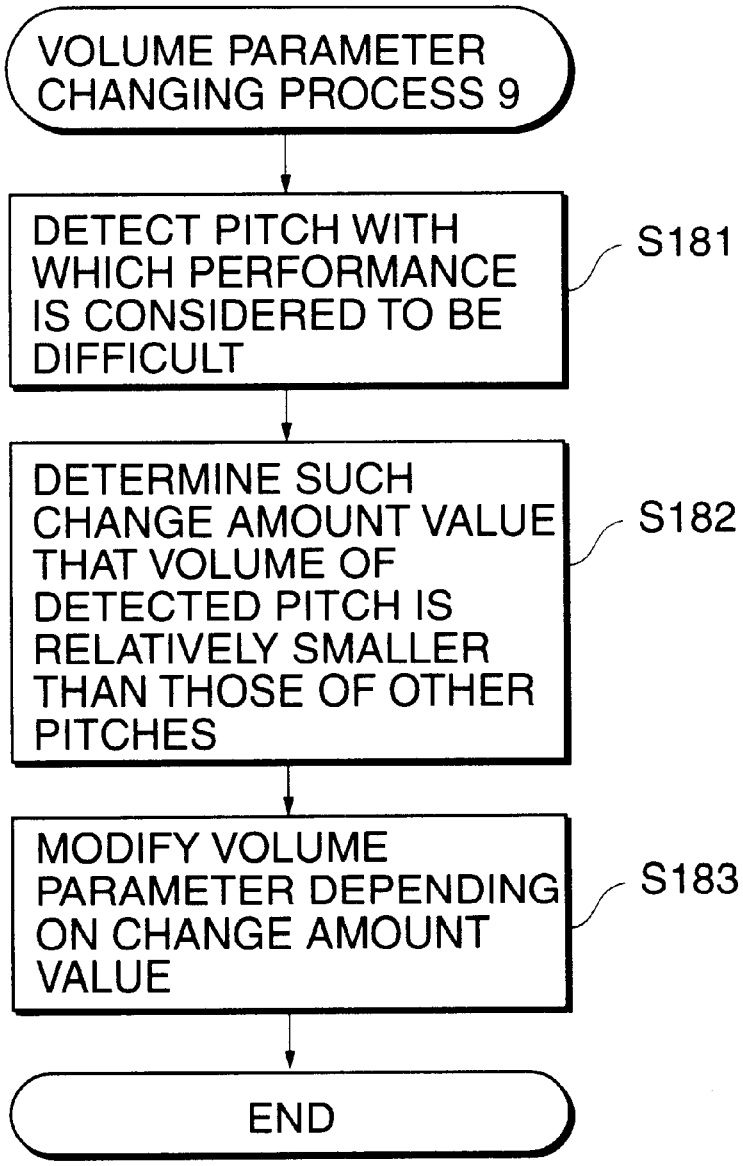
FIG. 35 is a flow chart showing a volume parameter changing process 9 for adding expressions by changing the volume depending on fingering to reproduce a vivid performance.

FIG. 35 is a flow chart showing a procedure of a volume parameter changing process 9. In this volume parameter changing process 9, expressions are added such that a vivid performance is realized by changing the volume depending on fingering.

In the figure, first, a pitch, of which performance operation is considered to be difficult to perform, is detected from selected performance data (step S181). Specifically, the pitch that is considered to be difficult to play refers to, for example, one for the piano or the guitar to be played with a little finger or one corresponding to a particularly quick arpeggio in performance by the piano. Of course, other determination criteria may be used.

Next, a change amount is determined such that the volume of the detected pitch is reduced relative to those of the other pitches (step S182).

Then, the volume parameter (specifically, the velocity of the note event corresponding to the detected pitch) is modified depending on the determined change amount (step S183).

According to a variation of this example, in the volume parameter changing process 9, addition of expressions can be performed such that the randomness of the interval is changed depending on fingering with respect to the tone color. For example, in a live performance with a fretless stringed instrument, some tones are likely to be high in pitch while other tones are likely to be low in pitch, and this often occurs with quick fingering. Therefore, by changing the interval depending on fingering, more vivid performances can be realized. Further, some tones from wood-wind instruments are likely to be high in pitch while other tones are likely to be low in pitch, depending on a combination of holes to be closed. This is also applicable to brass instruments, in which the pitch varies depending on the positions of a valve and a slide that determine the length of the tube. Therefore, such an addition of expressions is not limited to the stringed instruments.

To change the randomness of the interval depending on fingering, a process of automatically changing the interval depending on fingering is executed by determining fingering from performance data (MIDI data or the like) (this corresponds to a step S181), calculating a change of interval corresponding to the determined fingering (this corresponds to a step S182), and applying an interval parameter based on the calculated interval change.

Figure 36:
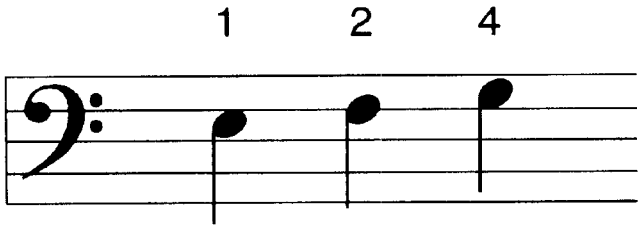
FIG. 36 is a view showing an example of fingering the cello.

In the case of a cello, for example, if, to play a section of music represented by a score such as one shown in FIG. 36, by fingering called "First Position", the fingering is executed in the order of "mi"→"forefinger", "fa"→(middle finger), and "sol"→(little finger). In this case, human beings' fingers are structured so that the forefinger, the middle finger, the ring finger, and the little finger are not opened at equal intervals but the interval between the middle finger and the ring finger is smaller than those between the other pairs. As a result, with the score in FIG. 36, the interval of the "fa" shows a tendency to shift upward. Skilled players know such a phenomenon and can correct it through training, but the degree of the above shifting of the interval is significant depending on the player's skill. Conversely, the interval of a note corresponding to the ring finger shows a tendency to shift downward, so that the player's unskillfulness can be reproduced by registering such a tendency.

Since this process expresses the player's unskillfulness, preferable results are not obtained if this tendency is too significantly expressed. A moderate degree of unskillfulness, however, is rather expressed as a natural form of performance, so that the unskillfulness can preferably be adjusted using an appropriate parameter.

Further, if the fingering position moves, a tone representing a change in the interval may be added depending on this position movement. Thus, preferably, after the fingering has been determined, the magnitude of the fingering position movement is evaluated to add a portamento (or a slide) (this corresponds to the step S182) and the interval parameter is applied based on this addition, thereby automatically changing the interval depending on results of the evaluation of the position movement. In changing the interval depending on results of the evaluation of the position movement in the above manner, a continuous change like a portamento is preferably added to the interval in a fretless stringed instrument, whereas a step-wise change is preferably added to the musical interval in a fretted stringed instrument.

If the fingering determination results in that the fingering is open string, more natural expressions can be reproduced by inhibiting vibrato. Further, in the case of a wind instrument, if the fingering requires a register tube to be simultaneously opened and closed, a slur cannot be played smoothly. Therefore, the evaluation of fingering is preferably also used to determine whether or not a smooth slur is permitted, so that a vivid performance can be realized.

Further, according to a variation of this example, the volume parameter changing process 9 can be applied so as to add expressions such as "noise sound" or "chopper" when the fingering is determined to have a high velocity at a low position. For example, at a first step, fingering is determined from performance data (MIDI data or the like (this corresponds to the step S181), at a second step, a high velocity is detected at a low position to calculate corresponding noise (this corresponds to the step S182), and at a third step, the noise is added to the performance data (this corresponds to the step S183). As a result, a system can be constructed, which automatically adds noise depending on the fingering.

In simulating a live performance with a stringed instrument, if a string is picked hard at a low position, a sound representing striking of the string against the finger board is likely to be generated, regardless of the presence of frets. By adding noise depending on such fingering, a more vivid performance can be realized. Further, some tones from a wood-wind instrument are likely to be high in pitch while other notes are likely to be low in pitch, depending on a combination of holes to be closed. This is also applicable to brass instruments, in which the pitch varies depending on the positions of a valve and a slide that determine the length of the tube. Therefore, the above described form of performance is not limited to stringed instruments.

Further, in a bass guitar tone color, instead of adding noise, the tone color of the bass guitar is switched to that of slapping, providing effective results. In this case, an automatic fingering-responsive tone changing system may be constructed, which temporarily changes the tone color in response to detection of a large velocity at a low position at a second step (corresponding to the step S182). If the fingering determination results in that the fingering is open string, the tone color may be changed to one for open string, providing effective results.

(J) Parameter Process Responsive to Lyrics Information

Figure 37:
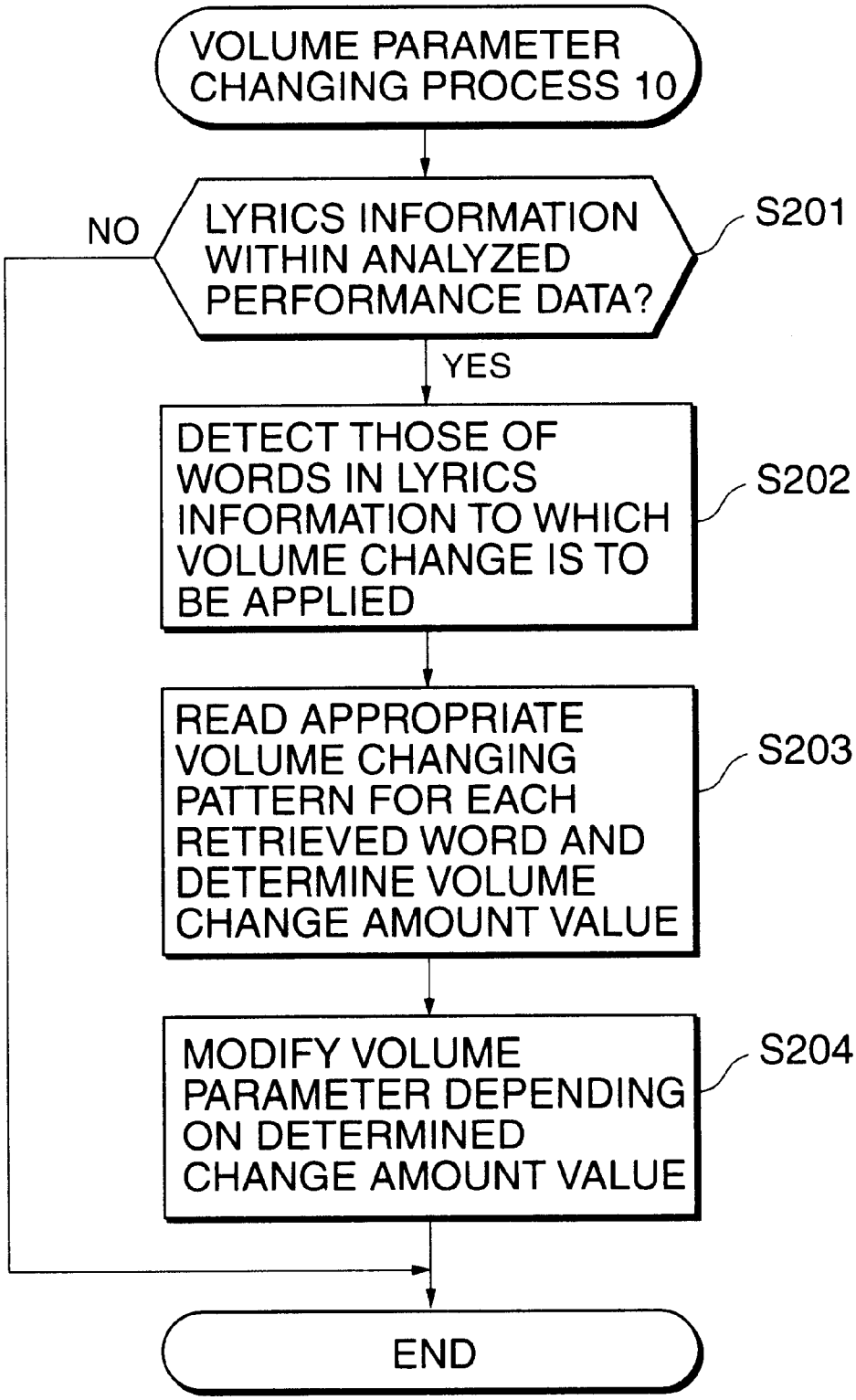
FIG. 37 is a flow chart showing a volume parameter changing process 10 for adding expressions to performance data with lyrics by changing the intonation according to contents of the lyrics.

FIG. 37 is a flow chart showing a procedure of a volume parameter changing process 10. According to this volume changing process 10, for performance data with lyrics, expressions are added such that the intonation is changed depending on the contents of the lyrics.

In the figure, it is first determined whether or not analyzed performance data (selected performance data) contain lyrics information (step S201). If the data contain no lyrics information, the volume parameter changing process 10 is immediately terminated, and if the data contain lyrics information, the process proceeds to the next step S202.

At the step S202, words in the lyrics information to which a volume change is to be applied are detected. The word detecting method may comprise preparing beforehand a list of words to which a volume change is preferably applied, and checking words in the lyrics information against the list to detect words to which a volume change is to be applied.

Next, a volume change pattern to be used is read for each of the detected words to determine a volume change amount value (step S203). Specifically, a volume change pattern (table) describing what volume change is to be applied is provided for each of the words in the list, and at the step S202, this volume change pattern is read to determine a volume change amount value. The volume change pattern has recorded therein a curve indicating a change in volume while the word is being sounded so that the volume change amount value can be determined by elongating or shortening the time axis of this curve (it is assumed that the ordinate represents the volume change amount value while the abscissa represents time). Desirably, in determining the volume change amount value, the original volume of the note corresponding to the word position is also taken into consideration.

Then, the volume parameter (expression data) is modified depending on the determined change amount value (step S204).

According to a variation of this example, the manner of the volume parameter changing process 10 described with reference to FIG. 37 is applicable to changing of the musical interval so as to configure a composition system which operates when lyrics are input, to slightly change the interval based on word intonation and syllable data. In some music with a song, a more natural sound may be generated if the intonation is changed depending on the contents of the rylics even with the same melody, and therefore, a more natural performance may be realized by changing the intonation depending on the contents of the lyrics with the melody unchanged, and the intonation is effectively realized by slightly changing the pitch. Thus, certain words are registered in syllables with interval coefficient values so that when one of the words appears in the performance data, the interval is slightly changed. In this case, changing the interval based on words does not mean changing the music interval in words but changing the interval within a period of time of a note corresponding to a syllable of a word.

(K) Various Embodiments

If the above described volume parameter changing processes 1 to 10 are employed to perform corresponding expression processes for applying various volume changes to the selected performance data, a very large volume or a small volume may be applied throughout the selected performance data. To prevent this, an average value of the volume of the entire selected performance data may be calculated so that an offset can be added to the volume of the entire selected performance data to obtain a desired average value. In this case, the volume of some portions may exceed or fall below the maximum value or the minimum value that can be output by the tone generator circuit 7. Accordingly, in calculating the average value of the volume of the selected performance data, maximum and minimum values for the entire selected performance data may preferably be determined. When the offset is added, no problem occurs unless the maximum value for the entire data plus the offset exceeds the maximum value for the tone generator circuit 7, and if the former exceeds the latter, a maximum value for the entire data which does not exceed the maximum value for the tone generator circuit 7 may be added to the entire data as an offset value. If the maximum value for the entire data only instantaneously exceeds the maximum value for the tone generator circuit, only this value may preferably be clipped by the maximum value for the tone generator circuit. Therefore, an allowable time (threshold) may be determined beforehand which indicates what % of the period of time required to reproduce the entire selected performance data is allowed as a maximum period of time over which the maximum value is exceeded. A similar manner to this is also applicable to the minimum value.

Further, types of addition of expressions that can be applied to the selected performance data may be defined depending on the types of instruments assumed for use in performing the selected performance data. For example, for the piano tone color, it is unrealistic to make a note crescendo after the note is sounded. If unrealistic effects are desired, such an operation can be used, but in simulating piano sounds, it is preferable to inhibit changing the volume of a note after sounding the same. To achieve this, a volume control flag may be provided for each tone color. Depending on this flag, it is determined to carry out volume control such that for the aforementioned decay sound, the volume control is inhibited after generating the decay sound, while for sustain sound, the volume control is permitted after generating the sustain sound. FIG. 38 shows an example of table data for defining volume control after sounding a note. The above described volume control flag is set to a value which is read from the table data. Further, a sweeping function may be provided, which utilizes the table data, such that if table data are already set for a tone color that is inhibited from being subjected to volume control after generation thereof, all volume control data contained in a range from note-on to note-off of the tone color are deleted, thereby automatically eliminating unnaturalness.

Further, in the present embodiment (the volume parameter changing processes 1 to 10), the present invention is applied only to the control of the volume parameter. The present invention, however, is not limited to this but can be effectively applied to control of parameters other than the volume, for example, the pitch, effects (reverb, chorus, panning, and the like), and the tone color.

Moreover, when performance data, which are composed of an orchestra score, are reproduced by the tone generator circuit 7, and if a large number of parts are required, it may not be so effective to individually control the volume of each part. In this case, conventionally, volume control data (in particular, expression data and pitch bend data) created for one part are copied and applied to the other parts. Then, however, a large number of duplicates of the same data are wastefully created. Therefore, a plurality of parts are preferably grouped so that one volume control data can be used to control the plurality of parts.

EMBODIMENT 3

Further examples (a) to (e) according to the present invention will be explained below as "Embodiment 3".

(a) "Slightly Increase Interval for Accented Tone"

In general, to express an accent, mainly the volume is emphasized, but more natural expressions can be achieved if expressions are added so as to further change the interval to simulate live performance expressions. Besides the accent, performance expressions in general that are said to change the volume actually often involve changes in the interval. Thus, it is desirable that a performance symbol that instructs a volume changing process should also instruct an interval changing process. Therefore, in an example of the present invention, when an accent is detected from note data, a temporal change in volume as well as a temporal change in interval are calculated so that addition of expressions can be performed based on these changes.

Figure 39:
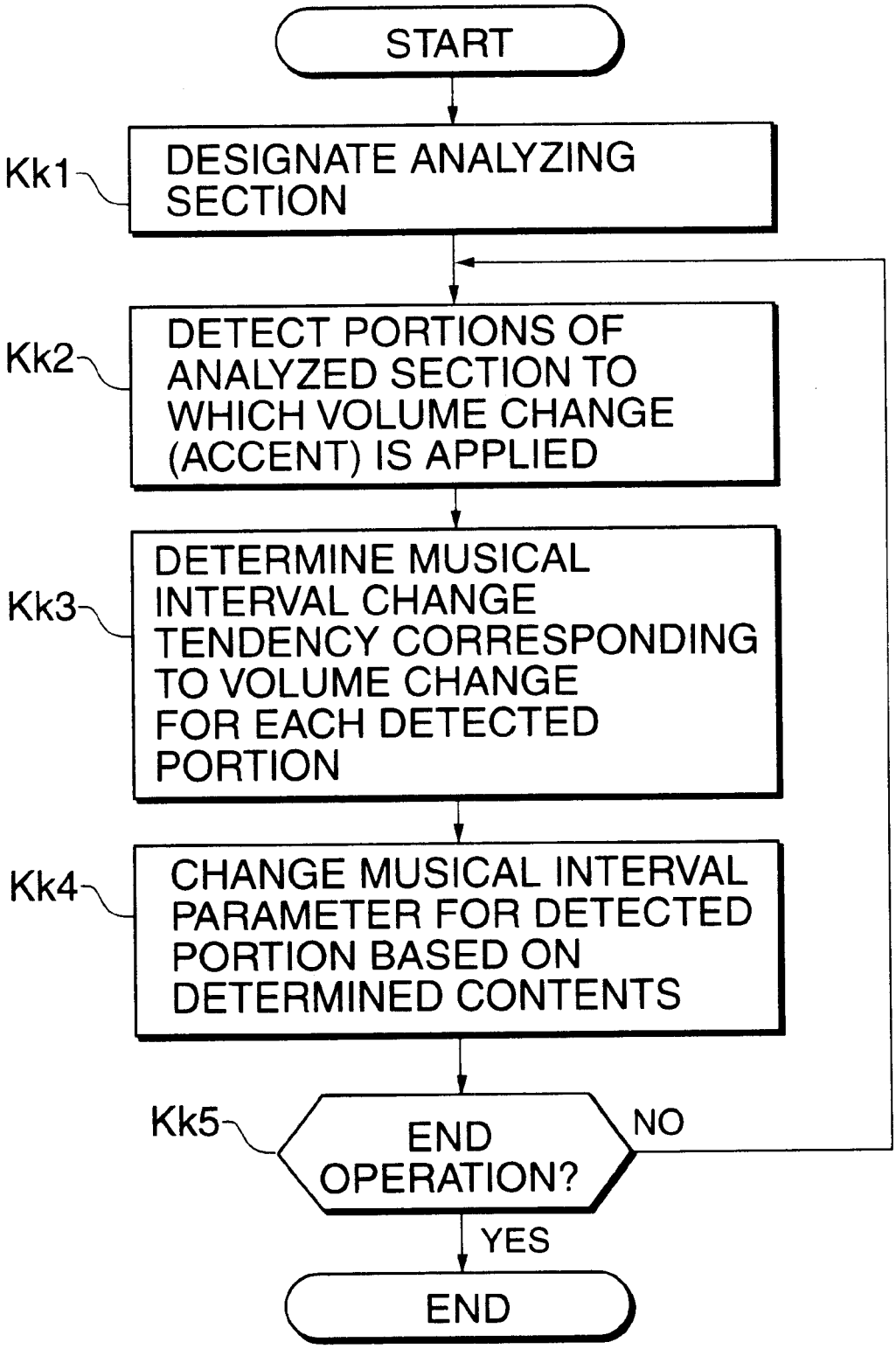
FIG. 39 is a flow chart showing a process for changing the musical interval depending on accent notes according to Example (a) of the present invention.
Figure 40:
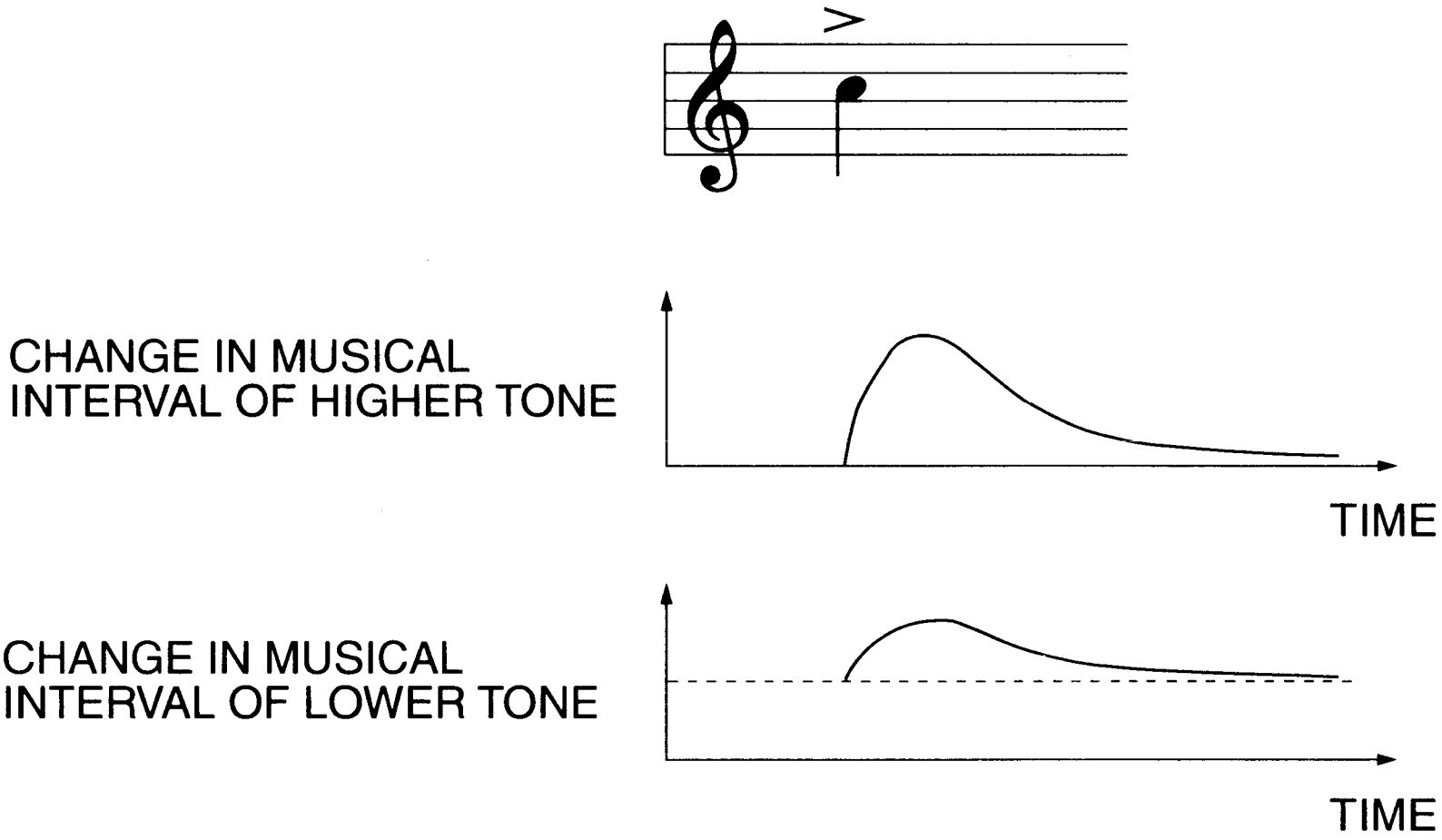
FIG. 40 is a chart showing how the volume and the musical interval change as a function of time according to Example (a) of the present invention.

FIG. 39 is a flow chart showing an example of a process for slightly increasing the interval of an accented tone. First, at a step Kk1, a section of selected performance data on which volume control is to be executed is designated, and at the following step Kk2, portions of the designated section for which a volume change (accent) is designated are detected to calculate temporal changes in volume and interval for these portions, as shown in FIG. 40, for example. The entire performance data may be analyzed instead of designating a section as described above.

Further, at a step Kk3, a tendency of interval change corresponding to the volume change is determined for each of the detected portions. The interval change tendency may be determined by performing arithmetic operations using a volume change tendency or by reading an interval changing pattern provided beforehand and corresponding to the volume change tendency. At a step Kk4, the interval parameter for the detected portion is changed based on the determined tendency. Then, the process proceeds to a step Kk5 to terminate this process if a terminating operation has been performed. If the terminating operation has not been performed, the process returns to the step Kk2 to repeat the processing from the step Kk2 to the step Kk5.

For keyboard instruments or the like which are unlikely to have an interval shift, more natural sounds are obtained when the above described accented tone process function is not used. Further, besides the accent, it is effective to automatically apply an accent-like function to a note at a leading end of time or a note at a leading end of a tuplet. Further, a higher tuplet such as a quintuplet or a septuplet is effectively decomposed into lower tuplets such as a doublet+triplet or a doublet+doublet+triplet so that a normal accent can be applied to a note at an original leading end while a slightly weaker accent can be applied to a note at a leading end of each of the tuplets obtained by the decomposition, thereby enabling a beat feeling to be easily exhibited.

With respect to changing the volume simultaneously with changing the interval, when the interval shifts during vibrato or portamento, if the volume is slightly reduced, more natural expressions are obtained. To achieve this, an expression symbol such as vibrato which changes the interval is retrieved from the note data, and the magnitude of a change in the interval of a note with the retrieved expression is calculated so that the volume is reduced based on a result of the calculation. In this case, extraction using an HPF is preferably used to calculate the interval change, but if the HPF output is too sharp, an LPF is desirably located after the HPF.

(b) "For Double Bending, Avoid Parallel Interval Changes/Intentionally Divide Channel"

Figure 41:
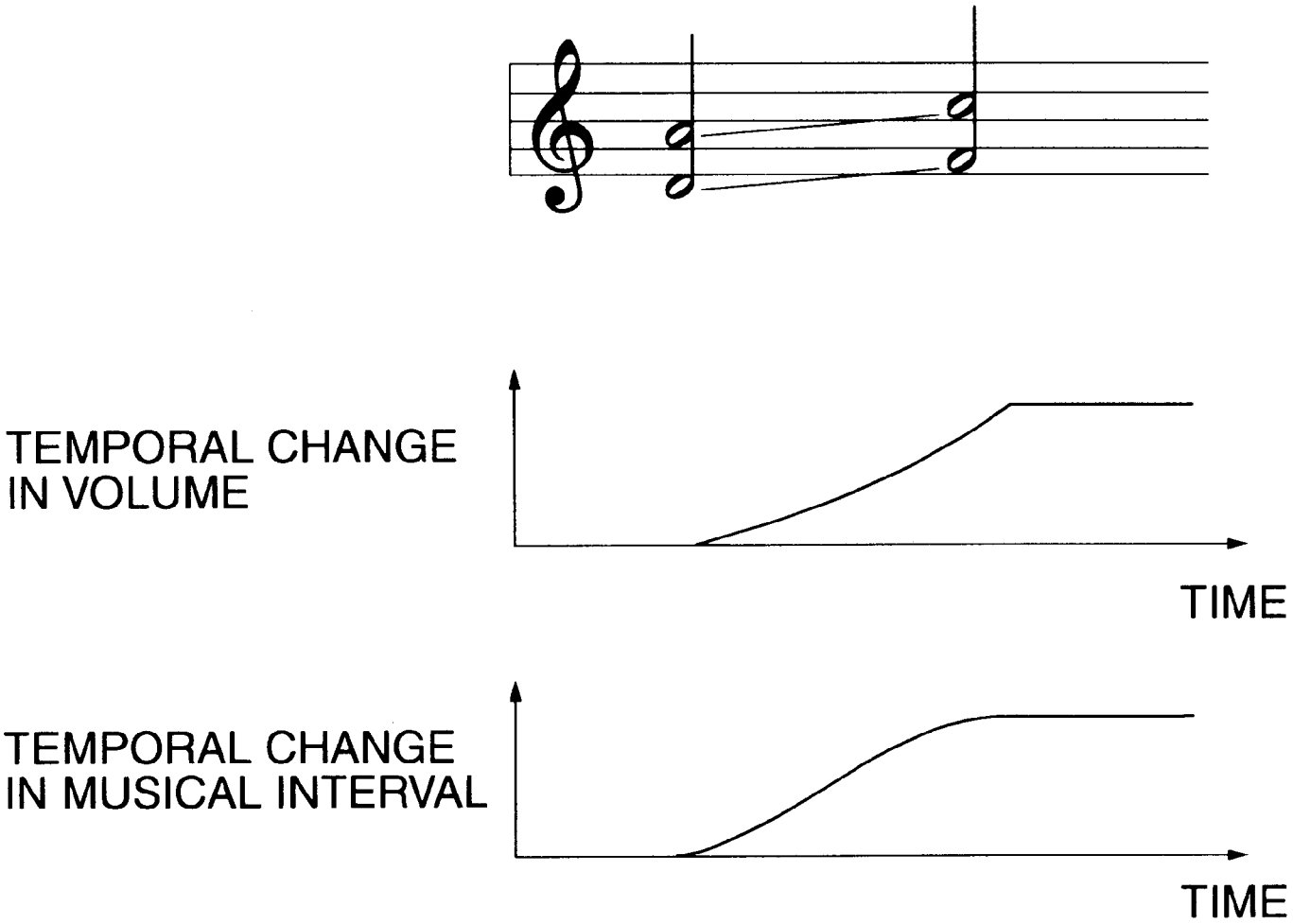
FIG. 41 is a chart showing how the musical interval of double bending changes as a function of time according to Example (b) of the present invention.

In playing the guitar, if two strings of the guitar are simultaneously picked while bending the strings, it is impossible for the live instrument to change the two intervals so as to be parallel. In view of this fact, according to an example of the present invention, in executing double bending, the timing of changing the interval is intentionally changed between the strings to reproduce a natural performance expression. For example, when double bending is executed, the timing of temporal change in the volume is shifted between a higher tone and a lower tone of the double bending, as shown in FIG. 40. The "manner of shifting the timing" may be shifting the timing of starting the volume change between the two tones while the same shape of temporal change is applied to the two tones, or changing the shape of temporal change itself between the two tones as shown in FIG. 41.

Figure 42:
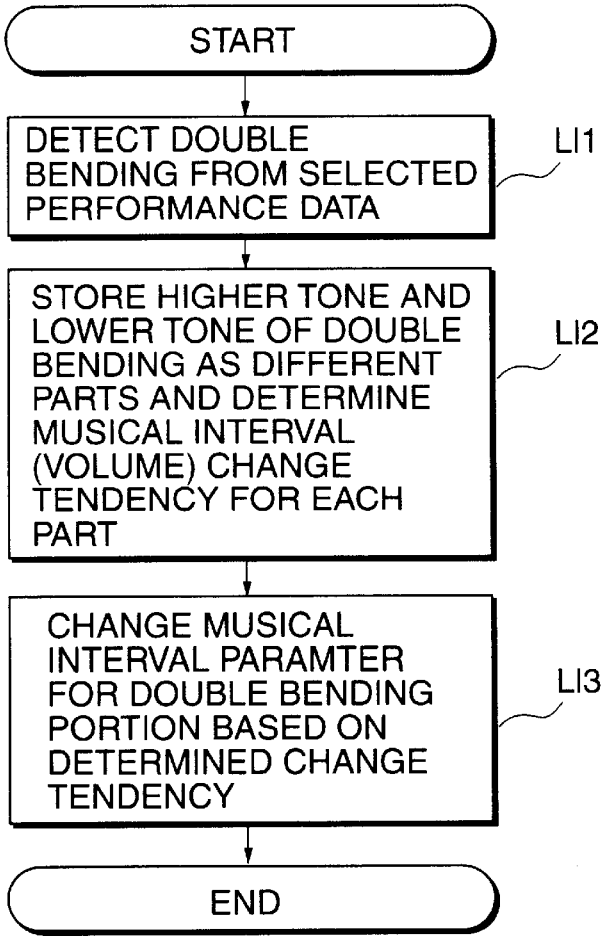
FIG. 42 is a flow chart showing a process for changing the musical interval depending on double bending according to Example (b) of the present invention.

FIG. 42 is a flow chart showing an example of a process for avoiding parallel temporal changes for double bending according to an example of the present invention. Upon start of this process, at a step L11, a double bending portion is detected from selected performance data. If a plurality of double bending portions are detected, an expression adding process is executed for each of the detected portions at steps L12 et seq. Alternatively, one or more portions of the plurality of detected portions for which an expression adding process is to be executed may be selected.

At the step L12, first, in order to apply different interval (or volume) changes to the higher tone and lower tone of the double bending, the higher tone and lower tone are separated into two parts, which are then stored, and an interval (volume) change tendency is then determined for each part. For this change tendency, the temporal change timing is shifted between the two parts as shown in FIG. 40, but change tendencies such as ones shown in FIG. 41 may be stored beforehand as change tendency patterns or arithmetically determined. Once the change tendency patterns have been determined in this manner, at a step L13, the interval (volume) parameter for the double bending portion is changed based on the determined change tendencies, to complete this process.

A realistic feeling is obtained if a parameter called "nature of strings" is provided and this parameter is associated with bending curves. Further, a more natural feeling is obtained if a target interval is shifted from the original difference in interval. That is, in the example in FIG. 41, the interval between the higher tone and the lower tone is 5 degrees but it shifts from 5 degrees during the interval change, and if it is not 5 degrees even after completion of the interval change, a more natural feeling is obtained.

Further, to automatically realize "the manner of shifting the timing" described above, interval changes corresponding to the two strings have to be independently effected, so that the resulting tones have to be automatically separated into two MIDI tracks. Thus, in an example of the present invention, "channel division" is intentionally carried out for double bending. That is, when double bending is detected from the performance data (MIDI data or the like), performance data for a plurality of parts with expressions added are generated and the plurality of double bending are automatically allotted, respectively, to the plurality of parts (see the step L12).

(c) "Select Tone Color Depending on Score Symbols"

Considering the correspondence between score symbols and tone colors, for example, in a score for a rubbed instrument such as violin which includes switching between arco (an arco playing method of rubbing strings with a bow) and a pizz. (pizzicato: a pizzicato playing method of picking strings), as shown in FIG. 43, the first bar indicates string rubbing, the second bar indicates string picking (pizzicato string), and the third bar again indicates string rubbing. In this case, it is convenient to arrange such that the tone color is automatically changed to the pizzicato string where the score shows "pizz." and the tone color is returned to the arco string where the score shows "arco". For example, the tone colors according to the current GM system (MIDI Sound Source Standard) include only one pizzicato tone but include many types of arco tones. Thus, a means should be provided, which stores a tone color to be recovered when "arco" is displayed after the tone color has been changed to the pizzicato string.

Thus, according to an example of the present invention, data indicating the pizzicato (the symbol "pizz.") are retrieved from the performance data (MIDI data or the like), and when the data are detected, the current tone color is held and a tone color for the pizzicato tone is set to add relevant expressions, thereby enabling the tone color to be automatically changed in response to the pizzicato symbol. If the number of pizzicato tone is not limited to one as in the GM system, tones corresponding to pizzicato symbols are preferably registered separately.

Further, such a correspondence between score symbols and tone colors is not limited to the above described "pizz.", and this manner can be directly applied to temporarily change a bass tone to a slapping tone. Various other applications are contemplated; for example, this manner can be applied to temporarily change a strings part to a solo tone or a tone of a special playing method such as col legno. Further, as a similar function, it is effective to automatically set a piano pedal symbol in response to operation of a damper for control change. Therefore, in an example of the present invention, a system is provided for selecting a predetermined tone color depending on a score symbol.

Figure 44:
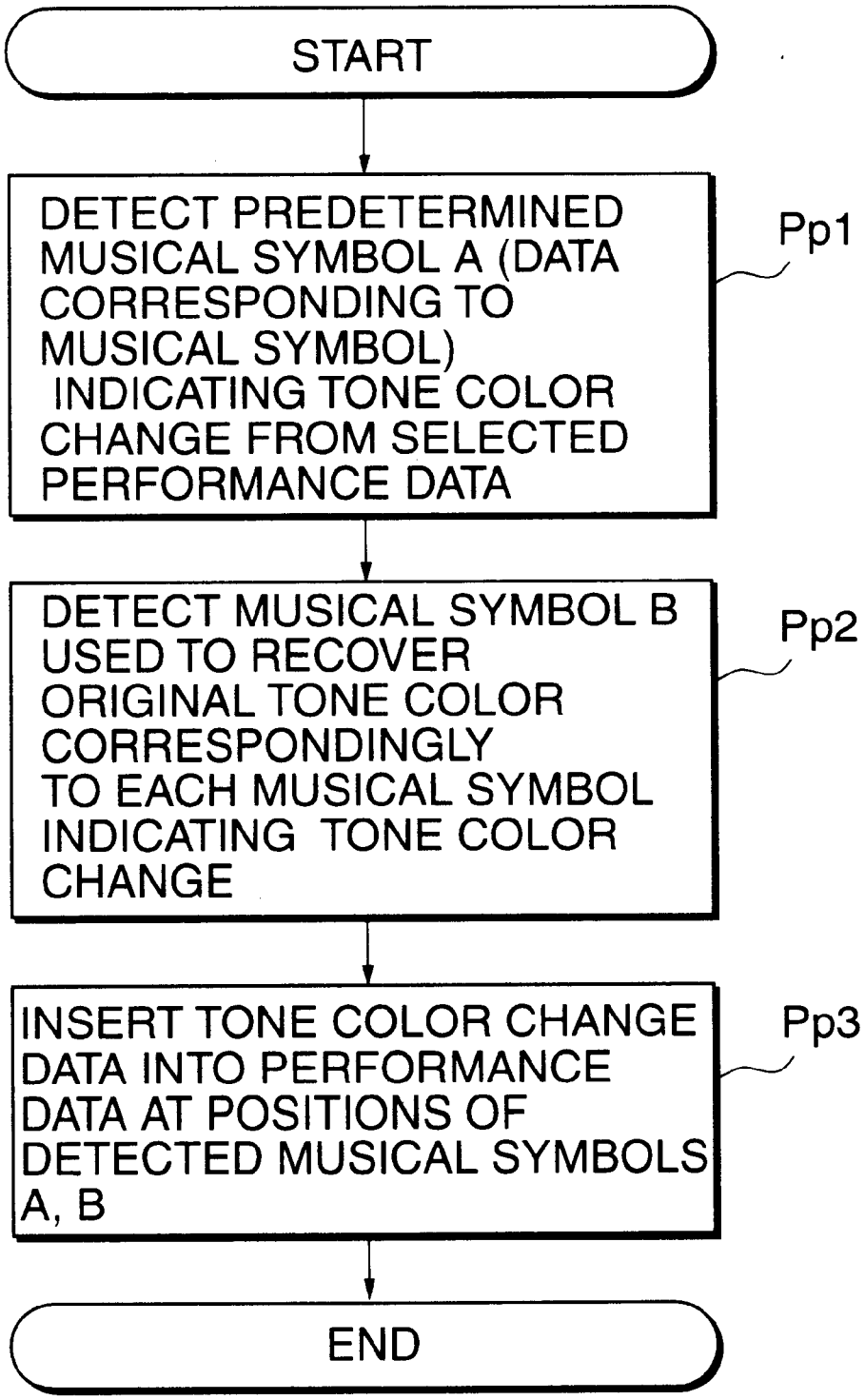
FIG. 44 is a flow chart showing a tone color selecting process using score symbols according to Example (c) of the present invention.

FIG. 44 is a flow chart showing a procedure of a process for selecting a tone color in response to a score symbol according to an example of the present invention. Upon start of this process, first, a predetermined musical symbol (data corresponding to this symbol) A indicating a tone color change is detected from selected performance data at a step Pp1. Then, if a plurality of such symbols are detected, an expression adding process is carried out for each detected symbol at steps Pp2 et seq. Alternatively, one or more of the plurality of detected symbols for which the expression adding process is to be executed may be selected.

At the step Pp2, a musical symbol B is detected, which is used to recover the original tone color correspondingly to the tone color change-indicating musical symbol A detected at the Pp1. In case that a plurality of symbols A are detected, as many symbols B may be provided for the respective symbols A. Then, at the following step Pp3, tone color change data are inserted into the performance data at the positions of the musical symbols A and B detected at the steps Pp1 and Pp2. For example, a tone color changing event representing a tone color after the change (this event is composed of program change data and bank select data) is inserted between the position of the change-indicating musical symbol A and the position of the recovery-indicating musical symbol B and data representing a tone color after the recovery, i.e. the original tone color is inserted at and after the position of the musical symbol B. In this case, the tone color after the change is determined beforehand for each musical symbol, and for the tone color after the recovery, the tone color before the change is held and then inserted into the data.

VARIOUS EMBODIMENTS

The object of the present invention can also be achieved by providing a system or apparatus with a storage medium containing a software program code for realizing the functions of any of the above described embodiments and reading the program code from the storage medium by a computer (or the CPU 1 and the MPU) of the system or apparatus for execution.

In this case, the program code read from the storage medium realizes the novel functions of the present invention, and the storage medium containing the program code constitutes the present invention.

Examples of the storage medium containing the program code are a floppy disk as described above, a hard disk, an optimal disk, a magneto optimal disk, a CD-ROM, a CD-R, a non-volatile memory card and the ROM 2. Alternatively, the program code may be supplied from the server computer 20 through the MIDI equipment 17 and the communication network 19.

Of course, the functions of the above described embodiments can be realized not only by executing the program code read by means of the computer but also by executing a part or the whole of the actual processing by means of an operating system or the like working on the computer in accordance with commands of the program code.

Moreover, it goes without saying that the functions of the above described embodiments can be realized by executing a part or the whole of the actual processing by means of the CPU 1 provided in a function expansion board inserted in the computer or a function expansion unit connected to the computer in accordance with commands of the program code after the program code read from the storage medium is stored in a memory provided in the function expansion board or the function expansion unit.

As described above with reference to the various preferred embodiments, according to the present invention, correspondence between predetermined characteristic information and musical tone control information for addition of expressions is set as rules in an expression adding module (expression addition algorithm) and generating method information representative of the expression addition rules is stored beforehand in a storage device so that when the characteristic information is obtained from the supplied performance data, musical tone control information (various performance parameters such as a time parameter, a musical interval parameter, and a volume parameter) is generated and added to the performance data based on the generating method information corresponding to the obtained characteristic information. As a result, based on the obtained characteristic information, even a beginner can add a variety of expressions to music by means of simple operations to automatically generate more musical performance data. Further, the performance data output with the musical tone control information added are evaluated so that the musical tone control information can be adjusted based on results of the evaluation. As a result, addition of expressions can be performed based on the optimal musical tone control information.

Further, characteristics of the performance data include note time information such as note density and interval between two notes or tones, the progress of performance, small vibration tone information such as long tone trill, pitch bend, and vibrato, breaks in phrases or phrase borders (trailing ends of phrases), pitch information, pitch change direction-turning information (pitch rise-to-fall turning points), sequence of identical or similar patterns or similar phrases, registered figures (phrase templates), volume information, atmosphere information such as "tense atmosphere", note group/train information (a group of notes and long tuplets), chord note number information, tone color information, fingering information such as fingers, position movement, and positions, playing method information such as guitar pulling-off and hammering-on, and piano sustain pedal, small changing tone information such as trill, lyrics information, and performance symbols such as dynamic marks and staccato. A variety of expressive performance outputs can be obtained according to these various characteristics.

Further, according to the present invention, correspondence between predetermined characteristic information and musical tone control information from already supplied performance data is stored in a storage device, and when characteristics are extracted from newly supplied performance data, musical tone control information is generated and added to the newly supplied performance data in accordance with the correspondence stored in the storage device. As a result, addition of expressions can be performed such that the tempo is set using a learning function.

Still further, correspondence between predetermined characteristic information and musical tone control information for performance data is stored in a library, and when characteristic information is detected from supplied performance data, the library is referred to to generate and add musical tone control information to the performance data. As a result, addition of expressions can be performed such that the library is used to set the tempo.

Further, according to the present invention, musical tone control information is generated based on predetermined characteristic information from supplied performance data and then compared with musical tone control information from the supplied performance data in terms of the entire performance data, and based on results of the comparison, the generated musical tone control information is modified. As a result, the entire performance data can be reviewed to set musical tone control information that is well-balanced and optimal in terms of the entire performance data.

Furthermore, according to the present invention, characteristics such as tone generation length (sounding length), same-tone color parts, melody parts, volume change (accent), double bending, continuous bending, arpeggio, and tone color change/recovery-indicating musical symbol information are extracted from supplied performance data, and based on these characteristic information, the volume parameter, the interval parameter, overtone generation by other parts, tone color data, and others are edited, thereby providing further various and diverse expressive performance outputs.

What is claimed is:

1. A storage medium that stores a program for executing a performance data generating method, said method comprising the steps of:

supplying performance data comprising a plurality of parameters;

obtaining characteristic information from the supplied performance data;

storing generating method information corresponding to predetermined characteristic information and representative of at least one method of generating musical tone control information;

obtaining generating method information corresponding to the obtained characteristic information from the stored generating method information;

generating the musical tone control information from the obtained characteristic information and generating method information corresponding to the obtained characteristic information; and adding the generated musical tone control information to the supplied performance data.

2. A storage medium according to claim 1, wherein said method further comprises the steps of outputting the performance data with the musical tone control information added by said adding step, evaluating the output performance data, and adjusting the generated musical tone control information based on results of the evaluation.

3. A storage medium according to claim 1 wherein said performance data comprises MIDI format data.

4. A storage medium that stores a program for executing a performance data generating method, said method comprising the steps of:

supplying performance data comprising a plurality of parameters;

extracting characteristic information corresponding to time intervals of occurrence of notes from the supplied performance data;

storing generating method information representative of at least one method of generating musical tone control information corresponding to the characteristic information corresponding to the time intervals of occurrence of notes;

generating the musical tone control information based on the extracted characteristic information and the stored generating method information; and adding the generated musical tone control information to the supplied performance data.

5. A storage medium according to claim 4, wherein said characteristic information represents a number of notes per predetermined unit time, said generating method information representing a method of generating such musical tone control information as to increase a value of tempo with which the performance data are reproduced when said number of notes per said predetermined unit time exceeds a predetermined number.

6. A storage medium according to claim 4 wherein said performance data comprises MIDI format data.

7. A storage medium that stores a program for executing a performance data generating method, said method comprising the steps of:

supplying performance data comprising a plurality of parameters;

storing generating method information representative of at least one method of generating musical tone control information corresponding to progress of performance data;

generating the musical tone control information based on the progress of the supplied performance data and the stored generating method information; and adding the generated musical tone control information to the supplied performance data.

8. A storage medium according to claim 7, wherein said generating method information represents a method of generating such musical tone control information as to progressively increase volume of the supplied performance data in accordance with the process of the performance data.

9. A storage medium according to claim 7 wherein said performance data comprises MIDI format data.

10. A storage medium that stores a program for executing a performance data generating method, said method comprising the steps of:

supplying performance data comprising a plurality of parameters;

extracting breaks in phrases from the supplied performance data;

storing generating method information representative of at least one method of generating musical tone control information corresponding to the breaks in phrases;

generating the musical tone control information based on the extracted breaks in phrases and the stored generating method information; and adding the generated musical tone control information to the supplied performance data.

11. A storage medium according to claim 10, wherein said generating method information represents a method of generating such musical tone control information as to progressively reduce volume at the breaks in phrases.

12. A storage medium according to claim 10 wherein said performance data comprises MIDI format data.

13. A storage medium that stores a program for executing a performance data generating method, said method comprising the steps of:

supplying performance data comprising a plurality of parameters;

extracting characteristic information corresponding to a tendency of pitch change from the supplied performance data;

storing generating method information representative of at least one method of generating musical tone control information corresponding to the characteristic information corresponding to the tendency of pitch change;

generating the musical tone control information based on the extracted characteristic information and the stored generating method information; and adding the generated musical tone control information to the supplied performance data.

14. A storage medium according to claim 13, wherein said characteristic information represents switching positions of the supplied performance data where a tendency for pitch to rise and a tendency for pitch to fall are switched, said generating method information representing a method of generating such musical tone control information as to apply an accent to volume of a note at each of the switching positions.

15. A storage medium according to claim 13 wherein said performance data comprises MIDI format data.

16. A storage medium according to claim 13, wherein said characteristic information represents at least one portion of the supplied performance data where pitch shows a tendency to rise, said generating method information representing a method of generating such musical tone control information as to progressively increase volume at the portion of the supplied performance data where the pitch shows a tendency to rise.

17. A storage medium that stores a program for executing a performance data generating method, said method comprising the steps of:

supplying performance data comprising a plurality of parameters;

extracting at least one portion of the supplied performance data where identical or similar data trains exist continuously;

storing generating method information representative of at least one method of generating musical tone control information corresponding to the portion of the supplied performance data where identical or similar data trains exist continuously;

generating the musical tone control information based on the extracted portion of the supplied performance data where identical or similar data trains exist continuously and the stored generating method information; and adding the generated musical tone control information to the supplied performance data.

18. A storage medium according to claim 17, wherein said generating method information represents methods of generating such musical tone control information as to change volume of a trailing one of said identical or similar data trains which exist continuously, depending on degrees of similarity of said identical or similar data trains.

19. A storage medium according to claim 17 wherein said performance data comprises MIDI format data.

20. A storage medium that stores a program for executing a performance data generating method, said method comprising the steps of:

supplying performance data comprising a plurality of parameters;

extracting similar data trains from the supplied performance data;

storing generating method information representative of at least one method of generating such musical tone control information as to change a value of tempo with which the performance data are reproduced, based on a difference between the similar data trains;

generating the musical tone control information based on the extracted data trains and said generating method information; and adding the generated musical tone control information to the supplied performance data.

21. A storage medium according to claim 20 wherein said performance data comprises MIDI format data.

22. A storage medium that stores a program for executing a performance data generating method, said method comprising the steps of:

supplying performance data comprising a plurality of parameters;

extracting at least one previously registered figure from the supplied performance data;

storing generating method information representative of at least one method of generating musical tone control information corresponding to the extracted figure;

generating the musical tone control information based on the extracted figure and the stored generating method information; and adding the generated musical tone control information to the supplied performance data.

23. A storage medium according to claim 22 wherein said performance data comprises MIDI format data.

24. A storage medium that stores a program for executing a performance data generating method, said method comprising the steps of:

supplying performance data comprising a plurality of parameters;

extracting at least one portion of the supplied performance data where a plurality of tones are simultaneously sounded;

storing generating method information representative of at least one method of generating musical tone control information corresponding to the portion of the performance data where a plurality of tones are simultaneously sounded;

generating the musical tone control information based on the extracted portion of the performance data and the stored generating method information; and adding the generated musical tone control information to the supplied performance data.

25. A storage medium according to claim 24, wherein said generating method information represents a method of generating such musical tone control information as to define importance of each of the simultaneously sounded tones and change volume of each of the tones depending on the defined importance.

26. A storage medium according to claim 24 wherein said performance data comprises MIDI format data.

27. A storage medium that stores a program for executing a performance data generating method, said method comprising the steps of:

supplying performance data comprising a plurality of parameters;

extracting information on fingering from the supplied performance data;

storing generating method information representative of at least one method of generating musical tone control information corresponding to the information on fingering;

generating the musical tone control information based on the extracted information on fingering and the stored generating method information; and adding the generated musical tone control information to the supplied performance data.

28. A storage medium according to claim 27, wherein said generating method information represents a method of generating such musical tone control information as to define the information on fingering corresponding to at least one portion of the supplied performance data that are difficult to play and reduce volume at the portion.

29. A storage medium according to claim 27, wherein said generating method information represents a method of generating such musical tone control information as to define the information on fingering corresponding to at least one portion of movement of position of fingering and change musical interval at the portion of movement of position of fingering.

30. A storage medium according to claim 27 wherein said performance data comprises MIDI format data.

31. A storage medium that stores a program for executing a performance data generating method, said method comprising the steps of:

supplying performance data comprising a plurality of parameters;

extracting at least one portion of the supplied performance data which correspond to a particular instrument playing method;

storing generating method information representative of at least one method of generating musical tone control information corresponding to the particular instrument playing method;

generating the musical tone control information based on the extracted portion of the supplied performance data corresponding to the particular instrument playing method and the stored generating method information; and adding the generated musical tone control information to the supplied performance data.

32. A storage medium according to claim 31, wherein said particular instrument playing method is a piano sustain pedal playing method, said generating method information representing a method of generating such musical tone control information as to reduce a value of reproduction tempo at the extracted portion of the supplied performance data corresponding to the piano sustain pedal playing method.

33. A storage medium according to claim 31, wherein said particular instrument playing method is a strings trill playing method, said generating method information representing a method of generating such musical tone control information as to divide at least one portion of the performance data corresponding to the strings trill playing method into a plurality of parts and set a different value of reproduction tempo at the portion of the performance data corresponding to the strings trill playing method for each of the parts.

34. A storage medium according to claim 31, wherein said particular instrument playing method is a trill playing method or a drum roll playing method, said generating method information representing a method of generating such musical tone control information as to make uneven or irregular volumes of notes of the portion of the performance data corresponding to the trill playing method or drum roll playing method.

35. A storage medium according to claim 31 wherein said performance data comprises MIDI format data.

36. A storage medium that stores a program for executing a performance data generating method, said method comprising the steps of:

supplying performance data comprising a plurality of parameters;

extracting lyrics information from the supplied performance data;

storing generating method information representative of at least one method of generating musical tone control information corresponding to the lyrics information;

generating the musical tone control information based on the extracted lyrics information and the stored generating method information; and adding the generated musical tone control information to the supplied performance data.

37. A storage medium according to claim 36, wherein said generating method information represents a method of generating such musical tone control information as to define a tempo control value for at least one particular word and change a value of reproduction tempo of the performance data based on the defined tempo control value.

38. A storage medium according to claim 36, wherein said generating method information represents a method of generating such musical tone control information as to define a volume change for at least one particular word and change volume of the supplied performance data based on the defined volume change.

39. A storage medium according to claim 36 wherein said performance data comprises MIDI format data.

40. A storage medium that stores a program for executing a performance data generating method, said method comprising the steps of:

supplying performance data comprising a plurality of parameters;

extracting information on at least one performance symbol from the supplied performance data;

storing generating method information representative of at least one method of generating musical tone control information corresponding to the performance symbol;

generating the musical tone control information based on the extracted information on the performance symbol and the stored generating method information; and adding the generated musical tone control information to the supplied performance data.

41. A storage medium according to claim 40, wherein said information on the performance symbol indicates a staccato symbol, said generating method information representing a method of generating such musical tone control information as to change a sounding length of a note immediately before a note marked with the staccato symbol.

42. A storage medium according to claim 40, wherein said information on the performance symbol indicates a staccato symbol, said generating method information representing a method of generating such musical tone control information as to reduce volume of a note immediately before a note marked with the staccato symbol.

43. A storage medium according to claim 40 wherein said performance data comprises MIDI format data.

44. A storage medium that stores a program for executing a performance data generating method, said method comprising the steps of:

supplying performance data comprising a plurality of parameters;

storing a relationship between predetermined characteristic information and musical tone control information, of already supplied performance data;

extracting said predetermined characteristic information from newly supplied performance data;

generating the musical tone control information based on the extracted predetermined characteristic information and in accordance with the relationship stored at said storing step; and adding the generated musical tone control information to the newly supplied performance data.

45. A storage medium according to claim 44 wherein said performance data comprises MIDI format data.

46. A storage medium that stores a program for executing a performance data generating method, said method comprising the steps of:

supplying performance data comprising a plurality of parameters;

extracting characteristic information from the supplied performance data;

generating musical tone control information by referring to a library that stores a plurality of relationships between predetermined characteristic information and musical tone control information for performance data, based on the extracted characteristic information; and adding the generated musical tone control information to the supplied performance data.

47. A storage medium according to claim 32 wherein said performance data comprises MIDI format data.

48. A storage medium that stores a program for executing a performance data generating method, said method comprising the steps of:

supplying performance data comprising a plurality of parameters;

extracting at least one portion of the supplied performance data which indicates sounding and has a sounding length larger than a predetermined sounding length;

storing generating method information representative of at least one method of generating musical tone control information corresponding to the portion of the performance data having a sounding length larger than the predetermined sounding length, the generating method information being representative of at least one method of generating such musical tone control information as to make uneven or irregular volume of the portion of the performance data having a sounding length larger than the predetermined sounding length;

generating the musical tone control information based on the extracted portion of the performance data and the stored generating method information; and adding the generated musical tone control information to the supplied performance data.

49. A storage medium according to claim 48 wherein said performance data comprises MIDI format data.

50. A storage medium that stores a program for executing a performance data generating method, said method comprising the steps of:

supplying performance data comprising a plurality of parameters;

extracting at least one portion of the supplied performance data to which is added a volume change;

storing generating method information representative of at least one method of generating musical tone control information corresponding to the portion imparted with the volume control, the generating method information being representative of at least one method of generating such musical tone control information as to apply a musical interval change corresponding to the added volume change, to the portion to which is added the volume control;

generating the musical tone control information based on the extracted portion and the stored generating method information; and adding the generated musical tone control information to the supplied performance data.

51. A storage medium according to claim 50 wherein said performance data comprises MIDI format data.

52. A storage medium that stores a program for executing a performance data generating method, said method comprising the steps of:

supplying performance data comprising a plurality of parameters;

extracting at least one portion of the supplied performance data where double bending is performed;

storing generating method information representative of at least one method of generating musical tone control information corresponding to the portion of the performance data where the double bending is performed, the generating method information being representative of at least one method of generating such musical tone control information as to divide the portion of the performance data where the double bending is performed into two parts with a higher tone and a lower tone and apply different volume changes, respectively, to said parts;

generating the musical tone control information based on the extracted portion of the performance data and the stored generating method information; and adding the generated musical tone control information to the supplied performance data.

53. A storage medium according to claim 52 wherein said performance data comprises MIDI format data.

54. A storage medium that stores a program for executing a performance data generating method, said method comprising the steps of:

supplying performance data comprising a plurality of parameters;

extracting at least one portion of the supplied performance data which corresponds to at least one predetermined musical symbol indicative of a tone color change;

storing generating method information representative of at least one method of generating musical tone control information corresponding to the predetermined musical symbol indicative of the tone color change, the generating method information being representative of at least one method of generating such musical tone control information as to change a tone color already set for the portion of the performance data corresponding to the predetermined musical symbol indicative of the tone color change to a tone color corresponding to the music symbol for the same portion;

generating the musical tone control information based on the extracted portion and the stored generating method information; and adding the generated musical tone control information to the supplied performance data.

55. A storage medium according to claim 54 wherein said performance data comprises MIDI format data.

56. A performance data generating apparatus comprising:

a supply device that supplies performance data comprising a plurality of parameters;

a first obtaining device that obtains characteristic information from the supplied performance data;

a storage device that stores information corresponding to predetermined characteristic information and representative of at least one method of generating musical tone control information;

a second obtaining device that obtains generating method information corresponding to the obtained characteristic information from the stored generating method information;

a generating device that generates the musical tone control information from the obtained characteristic information and the obtained generating method information corresponding to the obtained to the characteristic information; and an adding device that adds the generated musical tone control information to the supplied performance data.

57. A performance data generating apparatus according to claim 50 wherein said performance data comprises MIDI format data.

58. A performance data generating apparatus comprising:

a supply device that supplies performance data comprising a plurality of parameters;

an extracting device that extracts characteristic information corresponding to time intervals of occurrence of notes from the supplied performance data;

a storage device that stores information representative of at least one method of generating musical tone control information corresponding to the characteristic information corresponding to the time intervals of occurrence of notes;

a generating device that generates the musical tone control information based on the extracted characteristic information and the stored generating method information; and an adding device that adds the generated musical tone control information to the supplied performance data.

59. A performance data generating apparatus according to claim 58 wherein said performance data comprises MIDI format data.

60. A performance data generating apparatus comprising:

a supply device that supplies performance data comprising a plurality of parameters;

a storage device that stores generating method information representative of at least one method of generating musical tone control information corresponding to progress of performance data;

a generating device that generates the musical tone control information based on the progress of the supplied performance data and the stored generating method information; and an adding device that adds the generated musical tone control information to the supplied performance data.

61. A performance data generating apparatus according to claim 60 wherein said performance data comprises MIDI format data.

62. A performance data generating apparatus comprising:

a supply device that supplies performance data comprising a plurality of parameters;

an extracting device that extracts at least one break in phrases from the supplied performance data;

a storage device that stores information representative of at least one method of generating musical tone control information corresponding to the break in phrases;

a generating device that generates the musical tone control information based on the extracted break in phrases and the stored generating method information; and an adding device that adds the generated musical tone control information to the supplied performance data.

63. A performance data generating apparatus according to claim 62 wherein said performance data comprises MIDI format data.

64. A performance data generating apparatus comprising:

a supply device that supplies performance data comprising a plurality of parameters;

an extracting device that extracts characteristic information corresponding to a tendency of pitch change from the supplied performance data;

a storage device that stores generating information information representative of at least one method of generating musical tone control information corresponding to the characteristic information corresponding to the tendency of pitch change;

a generating device that generates the musical tone control information based on the extracted characteristic information and the stored generating method information; and an adding device that adds the generated musical tone control information to the supplied performance data.

65. A performance data generating apparatus according to claim 64 wherein said performance data comprises MIDI format data.

66. A performance data generating apparatus comprising:

a supply device that supplies performance data comprising a plurality of parameters;

an extracting device that extracts at least one portion of the supplied performance data where identical or similar data trains exist continuously;

a storage device that stores generating method information representative of at least one method of generating musical tone control information corresponding to the portion of the performance data where identical or similar data trains exist continuously;

a generating device that generates the musical tone control information based on the extracted portion of the supplied performance data where identical or similar data trains exist continuously and the stored generating method information; and an adding device that adds the generated musical tone control information to the supplied performance data.

67. A performance data generating apparatus according to claim 66 wherein said performance data comprises MIDI format data.

68. A performance data generating apparatus comprising:

a supply device that supplies performance data comprising a plurality of parameters;

an extracting device that extracts similar data trains from the supplied performance data;

a storage device that stores generating method information representative of at least one method of generating such musical tone control information as to change a value of tempo with which the performance data are reproduced, based on a difference between the similar data trains;

a generating device that generates the musical tone control information based on the extracted data trains and the stored generating method information; and an adding device that adds the generated musical tone control information to the supplied performance data.

69. A performance data generating apparatus according to claim 68 wherein said performance data comprises MIDI format data.

70. A performance data generating apparatus comprising:

a supply device that supplies performance data comprising a plurality of parameters;

an extracting device that extracts at least one previously registered figure from the supplied performance data;

a storage device that stores generating method information representative of at least one method of generating musical tone control information corresponding to the extracted figure;

a generating device that generates the musical tone control information based on the extracted figure and the stored generating method information; and an adding device that adds the generated musical tone control information to the supplied performance data.

71. A performance data generating apparatus according to claim 70 wherein said performance data comprises MIDI format data.

72. A performance data generating apparatus comprising:

a supply device that supplies performance data comprising a plurality of parameters;

an extracting device that extracts at least one portion of the supplied performance data where a plurality of tones are simultaneously sounded;

a storage device that stores generating method information representative of at least one method of generating musical tone control information corresponding to the portion of the performance data where a plurality of tones are simultaneously sounded;

a generating device that generates musical tone control information based on the extracted portion of the performance data and the stored generating method information; and an adding device that adds the generated musical tone control information to the supplied performance data.

73. A performance data generating apparatus according to claim 72 wherein said performance data comprises MIDI format data.

74. A performance data generating apparatus comprising:

a supply device that supplies performance data comprising a plurality of parameters;

an extracting device that extracts information on fingering from the supplied performance data;

a storage device that stores generating method information representative of at least one method of generating musical tone control information corresponding to the information on fingering;

a generating device that generates the musical tone control information based on the extracted information on fingering and the stored generating method information; and an adding device that adds the generated musical tone control information to the supplied performance data.

75. A performance data generating apparatus according to claim 74 wherein said performance data comprises MIDI format data.

76. A performance data generating apparatus comprising:

a supply device that supplies performance data comprising a plurality of parameters;

an extracting device that extracts at least one portion of the supplied performance data which correspond to a particular instrument playing method;

a storage device that stores generating method information representative of at least one method of generating musical tone control information corresponding to the particular instrument playing method;

a generating device that generates the musical tone control information based on the extracted portion of the supplied performance data corresponding to the particular instrument playing method and the stored generating method information; and an adding device that adds the generated musical tone control information to the supplied performance data.

77. A performance data generating apparatus according to claim 76 wherein said performance data comprises MIDI format data.

78. A performance data generating apparatus comprising:

a supply device that supplies performance data comprising a plurality of parameters;

an extracting device that extracts lyrics information from the supplied performance data;

a storage device that stores generating method information representative of at least one method of generating musical tone control information corresponding to the lyrics information;

a generating device that generates the musical tone control information based on the extracted lyrics information and the stored generating method information; and an adding device that adds the generated musical tone control information to the supplied performance data.

79. A performance data generating apparatus according to claim 78 wherein said performance data comprises MIDI format data.

80. A performance data generating apparatus comprising:

a supply device that supplies performance data comprising a plurality of parameters;

an extracting device that extracts information on at least one performance symbol from the supplied performance data;

a storage device that stores generating method information representative of at least one method of generating musical tone control information corresponding to the performance symbol;

a generating device that generates the musical tone control information based on the extracted information on the performance symbol and the stored generating method information; and an adding device that adds the generated musical tone control information to the supplied performance data.

81. A performance data generating apparatus according to claim 80 wherein said performance data comprises MIDI format data.

82. A performance data generating apparatus comprising:

a supply device that supplies performance data comprising a plurality of parameters;

a storage device that stores a relationship between predetermined characteristic information and musical tone control information, of already supplied performance data;

an extracting device that extracts said predetermined characteristic information from newly supplied performance data;

a generating device that generates the musical tone control information based on the extracted predetermined characteristic information and in accordance with the relationship stored in said storage device; and an adding device that adds the generated musical tone control information to the newly supplied performance data.

83. A performance data generating apparatus according to claim 82 wherein said performance data comprises MIDI format data.

84. A performance data generating apparatus comprising:

a library that stores a plurality of relationships between predetermined characteristic information and musical tone control information for performance data;

a supply device that supplies performance data comprising a plurality of parameters;

an extracting device that extracts characteristic information from the supplied performance data;

a generating device that generates the musical tone control information by referring to said library based on the extracted characteristic information; and an adding device that adds the generated musical tone control information to the supplied performance data.

85. A performance data generating apparatus according to claim 84 wherein said performance data comprises MIDI format data.

86. A performance data generating apparatus comprising:

a supply device that supplies performance data comprising a plurality of parameters;

a generating device that generates musical tone control information based on predetermined characteristic information from the supplied performance data;

a comparing device that compares the generated musical tone control information with musical tone control information from the supplied performance data in terms of an entirety of the performance data; and a modifying device that modifies the generated musical tone control information based on results of the comparison.

87. A performance data generating apparatus according to claim 86 wherein said performance data comprises MIDI format data.

88. A performance data generating apparatus comprising:

a supply device that supplies performance data comprising a plurality of parameters;

an extracting device that extracts at least one portion of the supplied performance data which indicates sounding and has a sounding length equal to or larger than a predetermined sounding length;

a storage device that stores generating method information representative of at least one method of generating musical tone control information corresponding to the portion of the performance data having a sounding length larger than the predetermined sounding length, the generating method information being representative of at least one method of generating such musical tone control information as to make uneven or irregular volume of the portions of the performance data having a sounding length larger than the predetermined sounding length;

a generating device that generates the musical tone control information based on the extracted portion of the performance data and the stored generating method information; and an adding device that adds the generated musical tone control information to the supplied performance data.

89. A performance data generating apparatus according to claim 88 wherein said performance data comprises MIDI format data.

90. A performance data generating apparatus comprising:

a supply device that supplies performance data comprising a plurality of parameters;

an extracting device that extracts at least one portion of the supplied performance data to which is added a volume change;

a storage device that stores generating method information representative of at least one method of generating musical tone control information corresponding to the portion of the performance data to which is added the volume change, the generating method information being representative of at least one method of generating such musical tone control information as to apply a musical interval change corresponding to the added volume change, to the portion of the performance data to which is added the volume change;

a generating device that generates the musical tone control information based on the extracted portion of the performance data and the stored generating method information; and an adding device that adds the generated musical tone control information to the supplied performance data.

91. A performance data generating apparatus according to claim 90 wherein said performance data comprises MIDI format data.

92. A performance data generating apparatus comprising:

a supply device that supplies performance data comprising a plurality of parameters;

an extracting device that extracts at least one portion of the supplied performance data where double bending is performed;

a storage device that stores generating method information representative of at least one method of generating musical tone control information corresponding to the portion of the performance data where the double bending is performed, the generating method information being representative of at least one method of generating such musical tone control information as to divide performance data for the portion of the performance data where the double bending is performed into two parts with a higher tone and a lower tone and apply different volume changes, respectively, to said parts;

a generating device that generates the musical tone control information based on the extracted portion of the performance data and on the stored generating method information; and an adding device that adds the generated musical tone control information to the supplied performance data.

93. A performance data generating apparatus according to claim 92 wherein said performance data comprises MIDI format data.

94. A performance data generating apparatus comprising:

a supply device that supplies performance data comprising a plurality of parameters;

an extracting device that extracts at least one portion of the supplied performance data which corresponds to at least one predetermined musical symbol indicative of a tone color change;

a storage device that stores generating method information representative of at least one method of generating musical tone control information corresponding to the predetermined musical symbol indicative of the tone color change, the generating method information being representative of at least one method of generating such musical tone control information as to change a tone color already set for the portion of the performance data corresponding to the predetermined musical symbol indicative of the tone color change to a tone color corresponding to the music symbol for the same portion;

a generating device that generates the musical tone control information based on the extracted portion of the performance data and the stored generating method information; and an adding device that adds the generated musical tone control information to the supplied performance data.

95. A performance data generating apparatus according to claim 94 wherein said performance data comprises MIDI format data.

96. A performance data generating method comprising the steps of:

supplying performance data comprising a plurality of parameters;

obtaining characteristic information from the supplied performance data;

storing information corresponding to predetermined characteristic information and representative of at least one method of generating musical tone control information;

generating musical tone control information from the obtained characteristic information and generating method information corresponding to the obtained characteristic information; and adding the generated musical tone control information to the supplied performance data.

97. A performance data generating method comprising the steps of:

supplying performance data comprising a plurality of parameters;

extracting characteristic information corresponding to time intervals of occurrence of notes from the supplied performance data;

storing generating method information representative of at least one method of generating musical tone control information corresponding to the characteristic information corresponding to the time intervals of occurrence of notes;

generating the musical tone control information based on the extracted characteristic information and the stored generating method information; and adding the generated musical tone control information to the supplied performance data.

98. A performance data generating method comprising the steps of:

supplying performance data comprising a plurality of parameters;

storing generating method information representative of at least one method of generating musical tone control information corresponding to progress of performance data;

generating the musical tone control information based on the progress of the supplied performance data and the stored generating method information; and adding the generated musical tone control information to the supplied performance data.

99. A performance data generating method comprising the steps of:

supplying performance data comprising a plurality of parameters;

extracting breaks in phrases from the supplied performance data;

storing generating method information representative of at least one method of generating musical tone control information corresponding to the breaks in phrases;

generating the musical tone control information based on the extracted breaks in phrases and the stored generating method information; and adding the generated musical tone control information to the supplied performance data.

100. A performance data generating method comprising the steps of:

supplying performance data comprising a plurality of parameters;

extracting characteristic information corresponding to a tendency of pitch change from the supplied performance data;

storing generating method information representative of at least one method of generating musical tone control information corresponding to the characteristic information corresponding to the tendency of pitch change;

generating the musical tone control information based on the extracted characteristic information and the stored generating method information; and adding the generated musical tone control information to the supplied performance data.

101. A performance data generating method comprising the steps of:

supplying performance data comprising a plurality of parameters;

extracting at least one portion of the supplied performance data where identical or similar data trains exist continuously;

storing generating method information representative of at least one method of generating musical tone control information corresponding to the portion where identical or similar data trains exist continuously;

generating the musical tone control information based on the extracted portion of the supplied performance data where identical or similar data trains exist continuously and the stored generating method information; and adding the generated musical tone control information to the supplied performance data.

102. A performance data generating method comprising the steps of:

supplying performance data comprising a plurality of parameters;

extracting similar data trains from the supplied performance data;

storing generating method information representative of at least one method of generating such musical tone control information as to change a value of tempo with which the performance data are reproduced, based on a difference between the similar data trains;

generating the musical tone control information based on the extracted data trains and the stored generating method information; and adding the generated musical tone control information to the supplied performance data.

103. A performance data generating method comprising the steps of:

supplying performance data comprising a plurality of parameters;

extracting at least one previously registered figure from the supplied performance data;

storing generating method information representative of at least one method of generating musical tone control information corresponding to the extracted figure;

generating the musical tone control information based on the extracted figure and the stored generating method information; and adding the generated musical tone control information to the supplied performance data.

104. A performance data generating method comprising the steps of:

supplying performance data comprising a plurality of parameters;

extracting at least one portion of the supplied performance data where a plurality of tones are simultaneously sounded;

storing generating method information representative of at least one method of generating musical tone control information corresponding to the portion of the performance data where a plurality of tones are simultaneously sounded;

generating the musical tone control information based on the extracted portion of the performance data and the stored generating method information; and adding the generated musical tone control information to the supplied performance data.

105. A performance data generating method comprising the steps of:

supplying performance data comprising a plurality of parameters;

extracting information on fingering from the supplied performance data;

storing generating method information representative of at least one method of generating musical tone control information corresponding to the information on fingering;

generating the musical tone control information based on the extracted information on fingering and the stored generating method information; and adding the generated musical tone control information to the supplied performance data.

106. A performance data generating method comprising the steps of:

supplying performance data comprising a plurality of parameters;

extracting at least one portion of the supplied performance data which corresponds to a particular instrument playing method;

storing generating method information representative of at least one method of generating musical tone control information corresponding to the particular instrument playing method;

generating the musical tone control information based on the extracted portion of the performance data corresponding to the particular instrument playing method and the stored generating method information; and adding the generated musical tone control information to the supplied performance data.

107. A performance data generating method comprising the steps of:

supplying performance data comprising a plurality of parameters;

extracting lyrics information from the supplied performance data;

storing generating method information representative of at least one method of generating musical tone control information corresponding to the lyrics information;

generating the musical tone control information based on the extracted lyrics information and the stored generating method information; and adding the generated musical tone control information to the supplied performance data.

108. A performance data generating method comprising the steps of:

supplying performance data comprising a plurality of parameters;

extracting information on at least one performance symbol from the supplied performance data;

storing generating method information representative of at least one method of generating musical tone control information corresponding to the performance symbol;

generating the musical tone control information based on the extracted information on the performance symbol and the stored generating method information; and adding the generated musical tone control information to the supplied performance data.

109. A performance data generating method comprising the steps of:

supplying performance data comprising a plurality of parameters;

storing a relationship between predetermined characteristic information and musical tone control information, of already supplied performance data;

extracting said predetermined characteristic information from newly supplied performance data;

generating the musical tone control information based on the extracted predetermined characteristic information and in accordance with the relationship stored at said storing step; and adding the generated musical tone control information to the newly supplied performance data.

110. A performance data generating method comprising the steps of:

supplying performance data comprising a plurality of parameters;

extracting characteristic information from the supplied performance data;

generating musical tone control information by referring to a library that stores a plurality of relationships between predetermined characteristic information and musical tone control information for performance data, based on the extracted characteristic information; and adding the generated musical tone control information to the supplied performance data.

111. A performance data generating method comprising the steps of:

supplying performance data comprising a plurality of parameters;

extracting at least one portion of the supplied performance data which indicates sounding and have a sounding length equal to or larger than a predetermined sounding length;

storing generating method information representative of at least one method of generating musical tone control information corresponding to the portion of the performance data having a sounding length larger than the predetermined sounding length, the generating method information being representative of at least one method of generating such musical tone control information as to make uneven or irregular volume of the portions of the performance data having a sounding length larger than the predetermined sounding length;

generating the musical tone control information based on the extracted portion of the performance data and the stored generating method information; and adding the generated musical tone control information to the supplied performance data.

112. A performance data generating method comprising the steps of:

supplying performance data comprising a plurality of parameters;

extracting at least one portion of the supplied performance data to which is added a volume change;

storing generating method information representative of at least one method of generating musical tone control information corresponding to the portion of the supplied performance data to which is added the volume change, the generating method information being representative of at least one method of generating such musical tone control information as to apply a musical interval change corresponding to the added volume change, to the portion of the supplied performance data to which is added the volume change;

generating the musical tone control information based on the extracted portion of the performance data and the stored generating method information; and adding the generated musical tone control information to the supplied performance data.

113. A performance data generating method comprising the steps of:

supplying performance data comprising a plurality of parameters;

extracting at least one portion of the supplied performance data where double bending is performed;

storing generating method information representative of at least one method of generating musical tone control information corresponding to the portion of the performance data where the double bending is performed, the generating method information being representative of at least one method of generating such musical tone control information as to divide performance data for the portion of the performance data where the double bending is performed into two parts with a higher tone and a lower tone and apply different volume changes, respectively, to said parts;

generating the musical tone control information based on the extracted portion of the performance data and the stored generating method information; and adding the generated musical tone control information to the supplied performance data.

114. A performance data generating method comprising the steps of:

supplying performance data comprising a plurality of parameters;

extracting at least one portion of the supplied performance data which corresponds to at least one predetermined musical symbol indicative of a tone color change;

storing generating method information representative of at least one method of generating musical tone control information corresponding to the predetermined musical symbol indicative of the tone color change, the generating method information being representative of at least one method of generating such musical tone control information as to change a tone color already set or the portion of the performance data corresponding to the predetermined musical symbol indicative of the tone color change to a tone color corresponding to the music symbol for the same portion;

generating the musical tone control information based on the extracted portion of the performance data and the stored generating method information; and adding the generated musical tone control information to the supplied performance data.

* * * * *